US010044092B2

(12) United States Patent
Caldwell et al.

(10) Patent No.: US 10,044,092 B2
(45) **Date of Patent: *Aug. 7, 2018**

(54) METHODS OF MODIFYING ERECT CONCEALED ANTENNA TOWERS AND ASSOCIATED MODIFIED TOWERS AND DEVICES THEREFOR

(71) Applicant: TowerCo Staffing, Inc., Cary, NC (US)

(72) Inventors: Steven R. Caldwell, Cary, NC (US); Michael L. Lassiter, Apex, NC (US)

(73) Assignee: TowerCo Staffing, Inc., Cary, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/637,299

(22) Filed: Jun. 29, 2017

(65) Prior Publication Data

US 2017/0301977 A1 Oct. 19, 2017

Related U.S. Application Data

(60) Continuation of application No. 15/289,518, filed on Oct. 10, 2016, now Pat. No. 9,742,053, which is a division of application No. 14/266,224, filed on Apr. 30, 2014, now Pat. No. 9,490,523, which is a division of application No. 13/008,400, filed on Jan. 18, 2011, now Pat. No. 8,749,449, which is a continuation-in-part of application No. 12/558,800, filed on Sep. 14, 2009, now Pat. No. 8,624,793.

(51) Int. Cl.
*H01Q 1/12* (2006.01)

(52) U.S. Cl.
CPC ..... *H01Q 1/1242* (2013.01); *H01Q 1/1207* (2013.01)

(58) Field of Classification Search
CPC ..... H01Q 1/1207; H01Q 1/1242
See application file for complete search history.

(56) References Cited

U.S. PATENT DOCUMENTS

| | | | | |
|---|---|---|---|---|
| 5,641,141 | A | 6/1997 | Goodwin | |
| 5,880,701 | A | 3/1999 | Bhame et al. | |
| 5,963,178 | A | 10/1999 | Jones | |
| 5,995,063 | A | 11/1999 | Somoza et al. | |
| 5,999,145 | A | 12/1999 | Niekamp | |
| 6,222,503 | B1 | 4/2001 | Gietema et al. | |
| 6,658,797 | B2 | 12/2003 | Jones | |
| 6,901,717 | B2 | 6/2005 | Brunozzi et al. | |
| 7,849,659 | B2 | 12/2010 | Kopshever, Sr. | |
| 8,593,370 | B2 * | 11/2013 | Caldwell | H01Q 1/1242 343/879 |

(Continued)

OTHER PUBLICATIONS

Product photo, CUST-3C385-30X30" OD Flagpole Antenna Concealment Cylinder, Stealth (1 page) (dated Jan. 1, 2007).

(Continued)

*Primary Examiner* — Robert Karacsony
(74) *Attorney, Agent, or Firm* — Myers Bigel, P.A.

(57) ABSTRACT

The disclosure describes installing an antenna canister in a portion of a concealed antenna pole at a location that is below a top of the pole while the antenna pole is erect and associated components to facilitate the procedure, as well as multi-piece vertical rods, pole mounting bracket assemblies and retrofit kits.

20 Claims, 66 Drawing Sheets

(56) References Cited

U.S. PATENT DOCUMENTS

| | | | | |
|---|---|---|---|---|
| 8,624,793 | B2 * | 1/2014 | Caldwell | H01Q 1/1242 343/879 |
| 8,749,449 | B2 * | 6/2014 | Caldwell | H01Q 1/1242 343/879 |
| 9,490,523 | B2 * | 11/2016 | Caldwell | H01Q 1/1242 |
| 9,742,053 | B2 * | 8/2017 | Caldwell | H01Q 1/1242 |
| 2003/0010426 | A1 | 1/2003 | Lockwood | |
| 2004/0134161 | A1 | 7/2004 | Lockwood et al. | |
| 2005/0007295 | A1 | 1/2005 | Janoschka et al. | |
| 2012/0299796 | A1 | 11/2012 | Angseryd | |
| 2014/0240193 | A1 | 8/2014 | Caldwell et al. | |

OTHER PUBLICATIONS

Product photo, 26"OD X 10'-0" LG Heavy Duty AMS System II, EEI (Engineered Endevors Inc.) (1 page) (Date unknown, but assumed to be prior to the filing date of the present application).
Product Overview, Unicell™, JAYBEAMWireless™ (8 pages) © 2006.

* cited by examiner

TEMPORARY SUPPORT
STEP 1

PARTIAL DEMOLITION
STEP 2

TOP INSTALL
STEP 3

BOTTOM INSTALL
STEP 4

STEP 7

STEP 8

"FINAL" DEMOLITION STEP 9

INSTALL CANISTER COVER
STEP 10

TEMPORARY SUPPORT
STEP 1

PARTIAL DEMOLITION
STEP 2

INSTALL TOP BRACKET STEP 3

INSTALL BOTTOM BRACKET STEP 4

INSTALL UPPER INNER SLEEVE STEP 5

CAN INSTALL
STEP 7

REMOVE TEMPORARY
SUPPORT
STEP 8

FINAL DEMOLITION
STEP 9

INSTALL CANISTER COVER STEP 10

METHODS OF MODIFYING ERECT CONCEALED ANTENNA TOWERS AND ASSOCIATED MODIFIED TOWERS AND DEVICES THEREFOR

RELATED APPLICATIONS

This application is a continuation application of U.S. patent application Ser. No. 15/289,518, filed Oct. 10, 2016, which is a divisional application of U.S. patent application Ser. No. 14/266,224, filed Apr. 30, 2014, which issued as U.S. Pat. No. 9,490,523 on Nov. 8, 2016, which is a divisional application of U.S. patent application Ser. No. 13/008,400, filed Jan. 18, 2011, which issued as U.S. Pat. No. 8,749,449 on Jun. 10, 2014, which is a continuation-in-part of U.S. patent application Ser. No. 12/558,800, filed Sep. 14, 2009, which issued as U.S. Pat. No. 8,624,793 on Jan. 7, 2014, the contents of which are hereby incorporated by reference as if recited in full herein.

FIELD OF THE INVENTION

This invention relates to towers that house antennas for cellular, PCS, GPS or other wireless communications or signals.

BACKGROUND

There are several types of towers used to hold land-based antennas for cellular/PCS communication. Where zoning requirements, restrictive covenants or other provisions or desires require aesthetically acceptable configurations, concealed (monopole) antenna towers are often used. These antennas are integrated within common pole-like objects such as, for example, flag poles, mono palms and other type tree poles, street-lights, stop-lights and other utility poles (e.g., any type of monopole structure). The concealed antenna towers are configured so that the antennas are not externally visually apparent. The concealed antenna towers have a tubular structure with an internal, longitudinally-extending cavity that holds cables/transmission lines. The concealed antenna towers can hold one or several vertically stacked antenna canisters within a shroud or exterior that surrounds and encloses the antenna canisters. The concealed antenna towers are thus known as "poles" and "slick sticks." See, e.g., U.S. Pat. Nos. 6,222,503 and 5,963,178, the contents of which are hereby incorporated by reference as if recited in full herein.

In the past, while some concealed antenna towers are designed to allow additional antenna canisters at the top of the tower after original placement, to add additional antenna canister space for additional antenna capacity beyond its original design to an erect concealed tower at other sub-top locations, the tower was taken down and usually replaced.

SUMMARY OF EMBODIMENTS OF THE INVENTION

Embodiments of the invention are directed to methods for modifying erect concealed antenna towers (e.g., poles) to add an antenna canister and/or allow for increased antenna capacity.

Some poles in the field have a single antenna cylinder and/or only provide for new antenna cylinders to be stacked on the top of existing structure. Embodiments of the present invention allow for antenna cylinders to be added to an erect pole at a position that is typically under an existing antenna cylinder in a region that is only a pole (e.g., a hollow pipe).

Embodiments of the invention are directed to methods of modifying an erect concealed antenna pole by installing an antenna canister in a portion of a concealed antenna pole at a location other than where a canister is currently located while the antenna pole is erect.

Embodiments of the invention are directed to methods of modifying an erect concealed antenna pole. The methods include: (a) forming an elongate opening into the antenna pole at a location that is below a top of the antenna pole while the concealed antenna pole is erect; then (b) installing a vertical member sized and configured to hold an antenna in the formed opening of the concealed antenna pole at a location that is below a top of the pole while the antenna pole is erect.

The installing step can be carried out at a location that is at least two feet below the top of the pole and at least two feet above the bottom of the pole. The method may optionally include supporting an upper portion of a concealed antenna pole with a crane while the antenna pole is erect before and/or during the forming step. The method can include removing the brace and placing a cover about the vertical member so that the antenna pole with the installed vertical member and cover has an external visual appearance of a concealed antenna pole.

The installing step can be carried out by attaching the vertical member to the pole below an existing antenna canister with the existing antenna canister having at least one antenna held thereon.

The forming step may be carried out by removing a plurality of spaced apart elongate wall segments from the pole at a single zone while temporarily leaving intermediate wall segments at that zone intact.

The method may include after the forming and installing steps, removing the intact wall segments of the pole at the zone.

The installing step can be carried out by attaching curved vertical plates to upper and lower portions of an outer wall of the pole to hold the vertical member aligned with a centerline of the pole to define a load bearing structure connecting adjacent longitudinally spaced apart sections of the pole.

The forming step can include grinding or cutting a steel wall segment having a length that is between about 3-10 feet and a width that is at least about 6 inches.

The forming step can be carried out to form a window with upper and lower edge portions. The concealed antenna pole has an outer wall, a longitudinally extending hollow core and at least one antenna held in the concealed antenna with associated cabling routed down from the antenna to a lower end of the antenna pole. The method can include, before the installing step, mounting upper and lower bracket assemblies to the tower outer wall, then installing the vertical member by attaching the vertical member to the upper and lower bracket assemblies to hold the vertical member in position aligned with a centerline of the hollow core of the pole.

The installing step can be carried out by placing the vertical member in the antenna pole as at least two attachable elongate members and assembling them together so that a center of the two assembled members is devoid of the antenna cabling.

The installing step can be carried out by placing the vertical member in the antenna pole as at least two attachable elongate members, then assembling them together so that a center of the two assembled members holds the antenna cabling.

The vertical member can be a center rod having a plurality of semi-circular shaped axially extending components that when assembled together define a substantially circular cross-sectional shape (cylindrical) cavity. The installing step can include attaching the semi-circular components to the pole and each other during the installing step. The method can also include routing cables from an existing antenna canister above the formed opening to reside inside the cavity formed by the multi-piece rod.

In some embodiments, the vertical member can be a center rod having a plurality of semi-circular shaped axially extending components that when assembled together define a substantially circular cavity. The installing step can include attaching the semi-circular components to the pole and each other during the installing step. The method can include routing cables from an existing antenna canister above the formed opening to reside outside the cavity formed by the multi-piece rod.

Yet other embodiments are directed to a concealed antenna tower. The tower includes a pole having at least a portion configured as a tubular body with a longitudinally extending cavity holding at least one antenna canister therein. The tubular body has an outer wall with an inner and outer surface and a cut wall section having substantially horizontal upper and lower cut edges residing below the at least one antenna canister. The tower also includes a first bracket assembly attached to the pole at a first location. The first bracket assembly has a plurality of curved vertical plates with upper and lower edge portions. The tower also includes a second bracket assembly attached to the pole at a second spaced apart location above the first location. The second bracket assembly has a plurality of curved vertical plates with upper and lower edge portions. The tower also includes a vertical member attached to the first and second bracket assemblies and being longitudinally aligned with the cavity of the pole. The vertical member configured to hold an antenna.

The upper and lower cut edges can be separated by a distance of at least 4 feet. The upper edge portions of the vertical plates of the first bracket assembly can be substantially flush with the lower cut edge of the tubular body and the lower edge portions of the vertical plates of the second bracket assembly can be substantially flush with the upper cut edge of the tubular body.

The pole can include a plurality of bolts extending through apertures in the wall of the pole and the curved vertical plates to hold the first and second bracket assemblies to the wall of the pole.

The pole can have vertically spaced apart first and second bolt patterns that reside about an external perimeter of the pole adjacent the first and second bracket assemblies, respectively.

The vertical member can include a plurality of longitudinally extending arcuate sections that attach together and define an open center space for allowing cables from the antenna canister located thereabove to extend therethrough.

The vertical member can include a plurality of longitudinally extending arcuate sections that attach together and define an open center space. The bracket assemblies can cooperate with the vertical member to route cables from the antenna canister located thereabove through channels formed by the bracket assemblies outside the open center space of the vertical member.

Still other embodiments are directed to kits for modifying and/or retrofitting an erect concealed antenna tower with an additional antenna canister. The kits include: (a) a first bracket assembly configured to attach to a concealed antenna pole at a first location; (b) a second bracket assembly configured to attach to the concealed antenna pole at a second spaced apart location above the first location; and (c) a vertical member configured to attach to the first and second bracket assemblies so that, in position, the vertical member is longitudinally aligned with an axially extending centerline of a hollow core of the pole.

The first and second bracket assemblies can include at least one curved vertical plate with apertures that attach to an outer wall of the pole.

The vertical member can include a plurality of longitudinally extending arcuate sections that attach together and define an open center space. The vertical member can have a length that is between about 5-15 feet.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

The foregoing and other objects and aspects of the present invention are explained in detail in the specification set forth below.

DESCRIPTION OF EMBODIMENTS OF THE INVENTION

Figure 1:
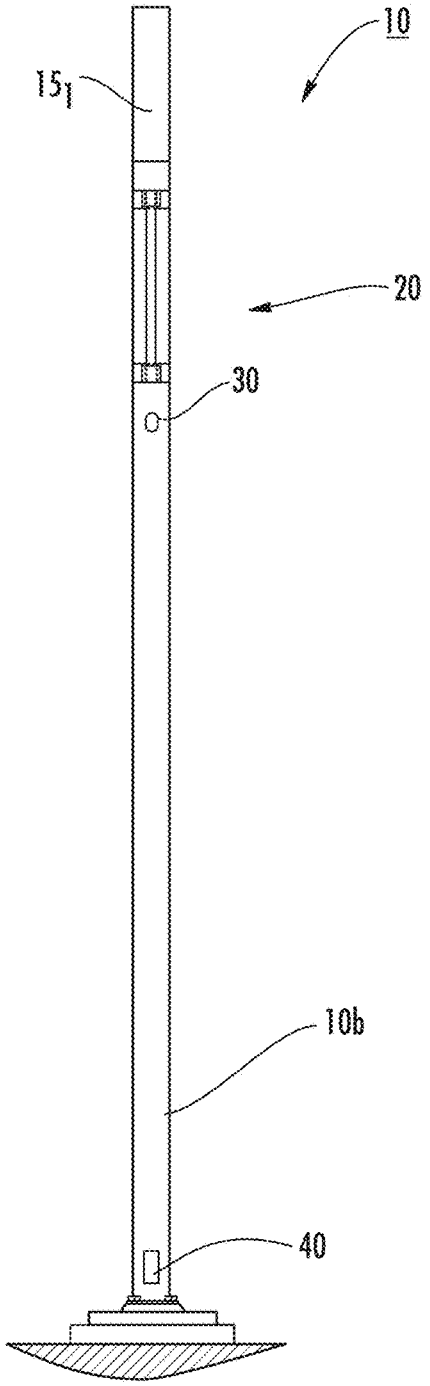
FIG. 1 is a front view of a concealed antenna pole according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes," and/or "including" when used in this specification, specify the presence of stated features, regions, steps, operations, elements, and/or components, but do not preclude the presence or addition of one or more other features, regions, steps, operations, elements, components, and/or groups thereof. As used herein, the term "and/or" includes any and all combinations of one or more of the associated listed items.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that although the terms "first" and "second" are used herein to describe various regions, layers and/or sections, these regions, layers and/or sections should not be limited by these terms. These terms are only used to distinguish one region, layer or section from another region, layer or section. Thus, a first region, layer or section discussed below could be termed a second region, layer or section, and similarly, a second without departing from the teachings of the present invention. Like numbers refer to like elements throughout.

The concealed antenna tower will be described as a pole herein. The term "pole" refers to a tubular structure that has at least a portion with a hollow core. The hollow core allows cabling to extend inside the pole from the antenna(s) to electronic circuitry that resides in a base of the pole and/or in a control station that is typically in a housing structure adjacent the pole. The pole may have a substantially circular, square or other geometric cross-sectional shape. For example, the outer wall of the housing or tower, may be circular or may be a multi-faceted polygon, e.g., hexagonal, octagonal and the like. The pole can have a substantially constant diameter or width over its length or it may increase in size such that the bottom portion is larger than a top and/or intermediate portion.

The pole can comprise galvanized steel for structural rigidity and support, particularly at the base portion of the pole. The pole can have at least a portion that is a steel pipe that is between about ¼ inch to about ¾ inch thick, typically about ½ inch. However, other suitable strength materials and thicknesses that can withstand environmental (weather and wind) conditions may be used, including, for example, composites, rigid polymers, wood, ceramics and concrete or combinations thereof.

The diameter or width of the pole can vary along its length as well as for different uses or types of poles. The pole can have a height that is between about 6 feet to about 220 feet, more typically between about 20-160 feet. The pole can include one or more hand holes along its length and may include one or more above ground exit ports for transmission lines proximate a lower portion of the pole and/or a below ground path for transmission lines. As is well known, the pole can be mounted to a base plate that is supported by a concrete pad and supported by the ground. Some poles have a top flange that will accommodate upward vertical growth. Some poles have multiple entry ports, particularly, if the "rad" centers (defined below) of co-location tenants (different cellular service providers on the same pole) are known.

The pole can have one or a plurality of stacked sections of antennas corresponding to or one or a plurality of "rads", respectively. The term "rad" refers to a centerline of an antenna with respect to ground. Some poles have multiple rads, each at different heights from the ground. Each antenna canister has an exterior wall or cover that is (also known as a "shroud") that encases the antenna. The shroud can comprise fiberglass, polymers or other suitable material that can blend into the shape and size of the remaining pole, e.g., the steel tubular base. The shroud can be formed, painted or deposited with a coating that matches the color/material of the base (steel) section of the pole. The pole can have a flag attachment at a top portion thereof wherein it acts as a flag pole.

The terms "antenna canister" and "antenna spool" are used interchangeably to refer to structures that mount concealed antennas to poles for cellular, PCS, GPS or other wireless (radio) communications. The concealed antennas are typically monopole antennas as is known to those of skill in the art, but it is contemplated that embodiments of the invention may be used for other antenna types. Conventional antenna canisters can have opposing upper and lower flanges and/or members and a vertically extending (center) rod or spool extending therebetween as is known to those of skill in the art. The antennas themselves are typically mounted in the field inside the canisters in the erect towers (after the tower is in position) by a service provider. However, antennas may also be pre-loaded and mounted to (typically inside) the antenna canister prior to erection of the tower as well.

The antenna canister can have various lengths and diameters or widths, such as, for example, between about 2-15 feet, typically between about 3-10 feet in length and about 3-50 inches wide (with radome/shroud), typically between about 5-27 inches (OD) wide. Examples of suppliers of commercially available antenna canisters include PN 219745 and PN 131531 from Valmont Structures, Salem, Oreg., PN 133742 and PN 135602 from PiRod Inc., Plymouth, Ind., Project No. 33201-187 (38 foot flag pole with single upper concealment cylinder on 28' long pipe) from Chameleon Engineering, Santa Maria, Calif., Job No. 33201-187 (25" antenna concealment cylinder) from Innovative Site Solutions, Santa Maria, Calif., and Cell-30-100-30 from Stealth Concealment Solutions, Charleston, S.C. Exemplary discussions of radomes, shoruds and/or concealed antenna poles can also be found in U.S. Pat. No. 6,222,503, (see, inter alia, FIGS. 8A/8B, col. 15) and U.S. Pat. No. 5,963,178 (see, inter alia, FIG. 4, col. 4, 6), the contents of which are hereby incorporated by reference as if recited in full herein.

Figure 2:
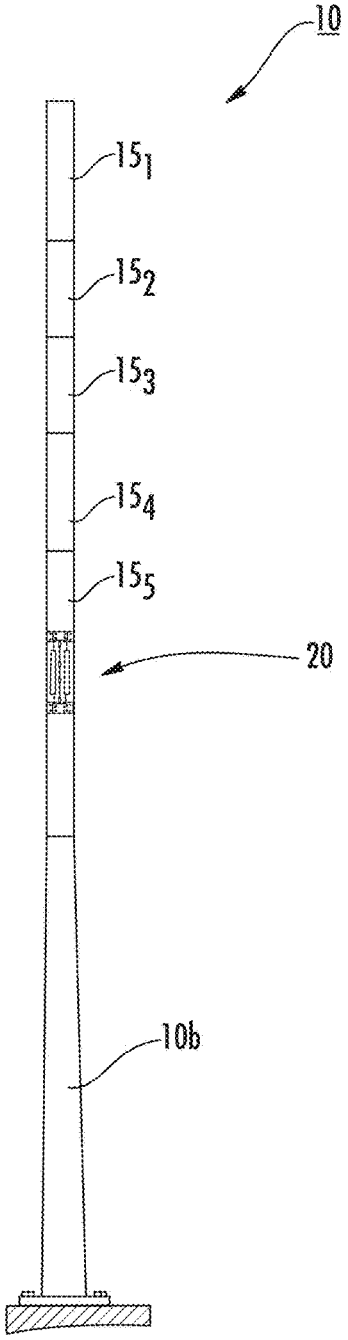
FIG. 2 is a front view of another concealed antenna pole according to embodiments of the present invention.

Referring now to the figures, FIGS. 1 and 2 illustrate exemplary concealed antenna poles 10. FIG. 1 shows that a "new" antenna canister 20 can be installed on an erect pole 10 at a location that is a distance below the top of the pole 10, typically below either an existing antenna canister $\mathbf{15}_1$ and above the base of the pole 10*b*, or a distance that is about 1 foot or more, typically, about 2 feet or more below the top of the pole and about 2 feet or more above the bottom of the pole. The base 10*b* of the pole 10 can include a cable exit port 40 as shown, and is typically a hollow core tube (e.g., a tubular pipe-like steel base). The size of the base 10*b* can be greater than a major portion of the remaining portion of the pole 10. The pole 10 can also include a hand hole 30 surrounded by a rim or perimeter (the hole can also be referred to as an exit port). Optionally, a hand hole 30 or tool entry port can exist or be formed or introduced in the pole 10 in a location that is proximate the new canister region of the pole. J-hooks or other tools can be attached to the pole 10 or inserted through the hand hole/port 30 to grasp cables (e.g., coax transmission lines) extending in the target region of the pole 10 so as to be able to move them and/or hold them away from a wall removal segment or zone.

FIG. 2 illustrates that the "new" antenna canister 20 can be introduced under a plurality of (rad) zones $\mathbf{15}_1$-$\mathbf{15}_5$, each having a length/height that is between about 10-15 feet. As shown, the new antenna canister 20 can be placed at rad 6. However, in other embodiments, one or more antenna canisters 20 can be added to other target zones. The word "zone" refers to a section of the pole 10 associated with a respective antenna and/or antenna canister 20.

Figure 3:
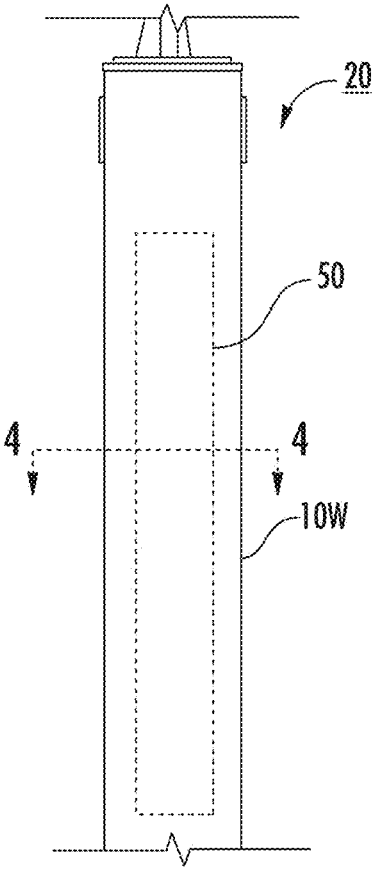
FIG. 3 is a partial front view of a concealed antenna pole targeted for modification according to embodiments of the present invention.
Figure 4:
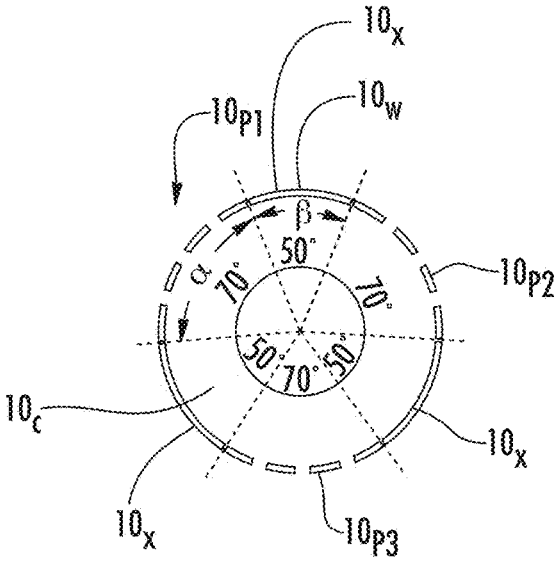
FIG. 4 is a cross section of the pole taken along line 4-4 in FIG. 3.

FIG. 3 illustrates a zone of the pole 10 which is targeted for modification to add the antenna canister 20. As shown in FIG. 4, the pole 10 includes a wall 10*w* that surrounds a hollow core 10*c*. As shown in FIGS. 3 and 4, to add the canister 20, a window 50 is formed in the wall 10*w* by removing at last one elongate segment of the wall $\mathbf{10}p_1$ at the target zone of the pole 10. FIG. 4 illustrates that wall regions $\mathbf{10}p_1$, $\mathbf{10}p_2$ and $\mathbf{10}p_3$ targeted for removal using broken lines. The window 50 is typically an elongate window having a length that is between about 2-15 feet, typically between about 5-10 feet. The window 50 can be about the same length or longer than a corresponding canister 20 or may be shorter but sufficiently sized to allow for insertion of a vertical member that holds a concealed antenna(s) and pole to vertical member attachment hardware such as those that will be described further below.

In the embodiment shown in FIG. 4, three spaced apart segments $\mathbf{10}p_1$, $\mathbf{10}p_2$ and $\mathbf{10}p_3$ of the wall 10*w* can removed, leaving other intermediate segments 10*x* intact (at least during the initial portion of the retrofit/modification) thereby forming three windows 50 (FIG. 3) spaced apart about the perimeter of the transverse cross-section. For substantially circular poles 10, there can be three circumferentially spaced apart windows. Although shown with three windows 50, one window, two windows or more than three windows may be used as suitable to allow for installation of the "new" canister 20.

As shown in FIG. 4, the three windows 50 can have an arc width "α" of between about 40-80 degrees, typically about 70 degrees. The intact segments 10*x* can have a smaller arc width "β" than the windows 50 or segments $\mathbf{10}p_1$-$p_3$, typically between about 30-60 degrees, and more typically about 50 degrees. Each window 50 (where more than one is used) can have the same or a different size, shape and/or arc width. Similarly, each intact segment 10*x* (where more than one is used) may have the same size, shape and/or arc width or may have a different size shape and/or arc width.

Figure 5A:
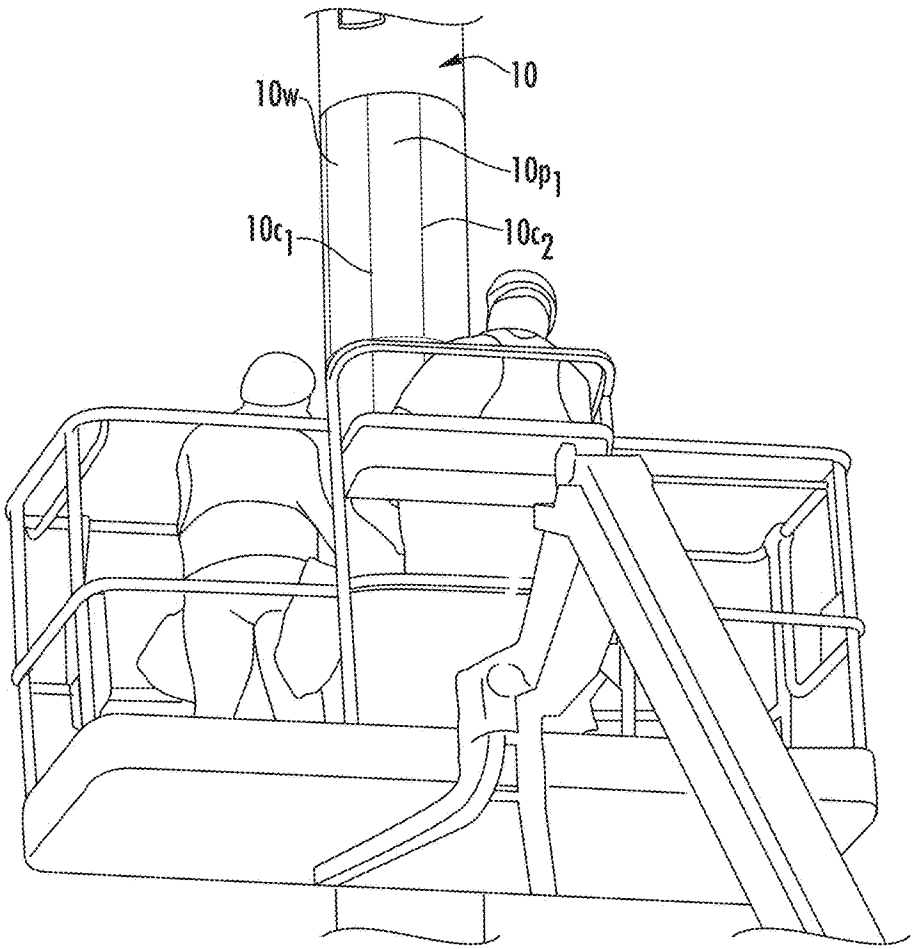
FIGS. 5A-5F are schematic illustrations of steps used to modify an erect antenna pole to add antenna capacity according to embodiments of the present invention.
Figure 5B:
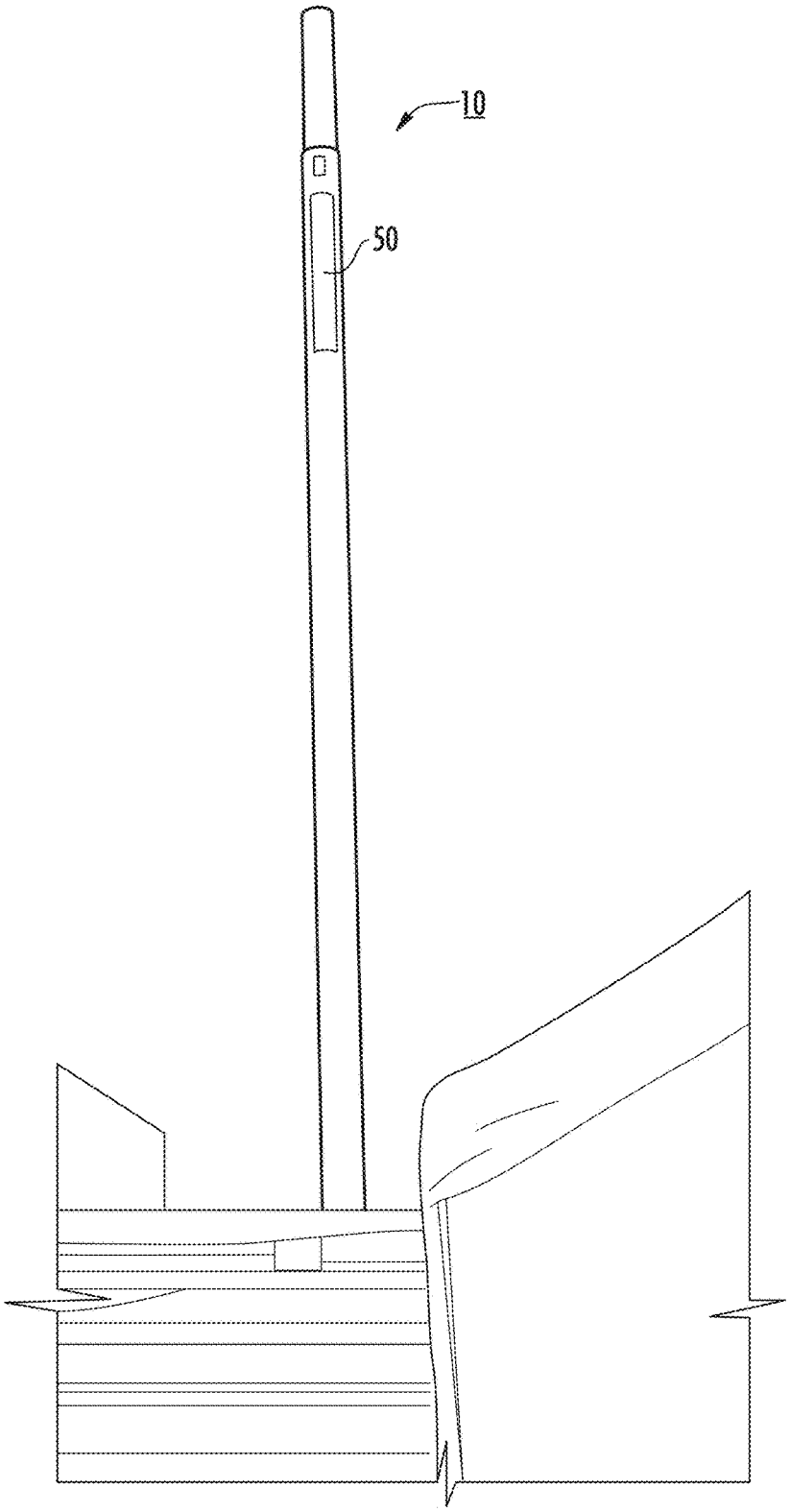

FIG. 5A illustrates exemplary cut lines $\mathbf{10}c_1$, $\mathbf{10}c_2$ associated with the removal segment $\mathbf{10}p_1$ formed into a wall 10*w* of the erect pole 10. The cut lines $\mathbf{10}c_1$, $\mathbf{10}c_2$ may be formed by any suitable means including, for example, grinding, sawing, cutting (e.g., laser cutting, high-pressure water cutting) and the like, taking care not to damage any cabling that may be in the core of the pole 10. FIG. 5B illustrates the window 50 formed into the pole 10 by removing elongate segment $\mathbf{10}p_1$.

Figure 5C:
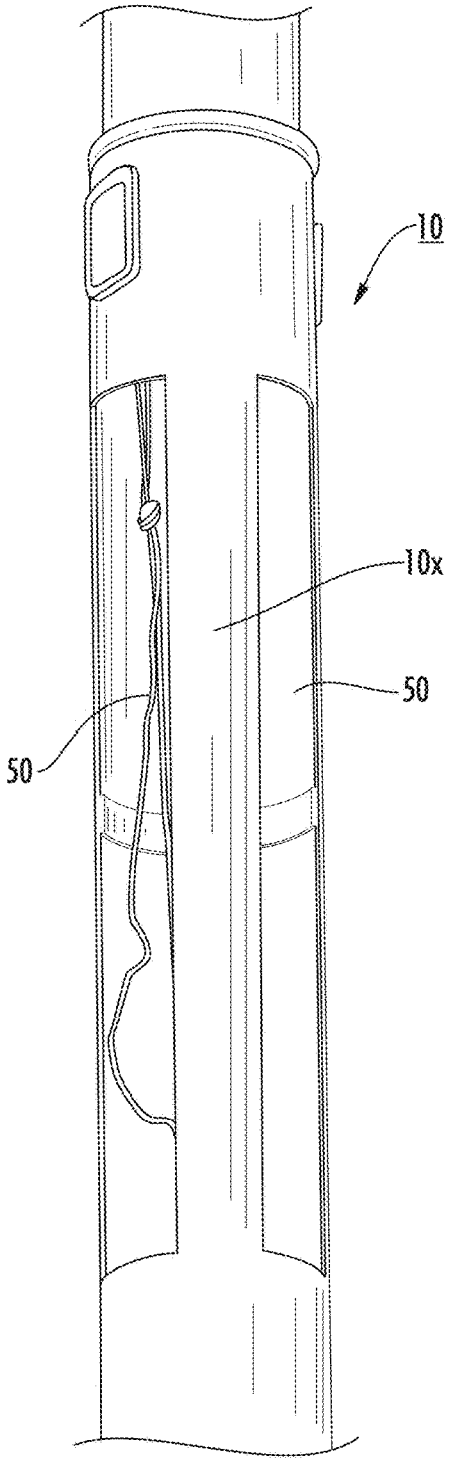
Figure 5D:
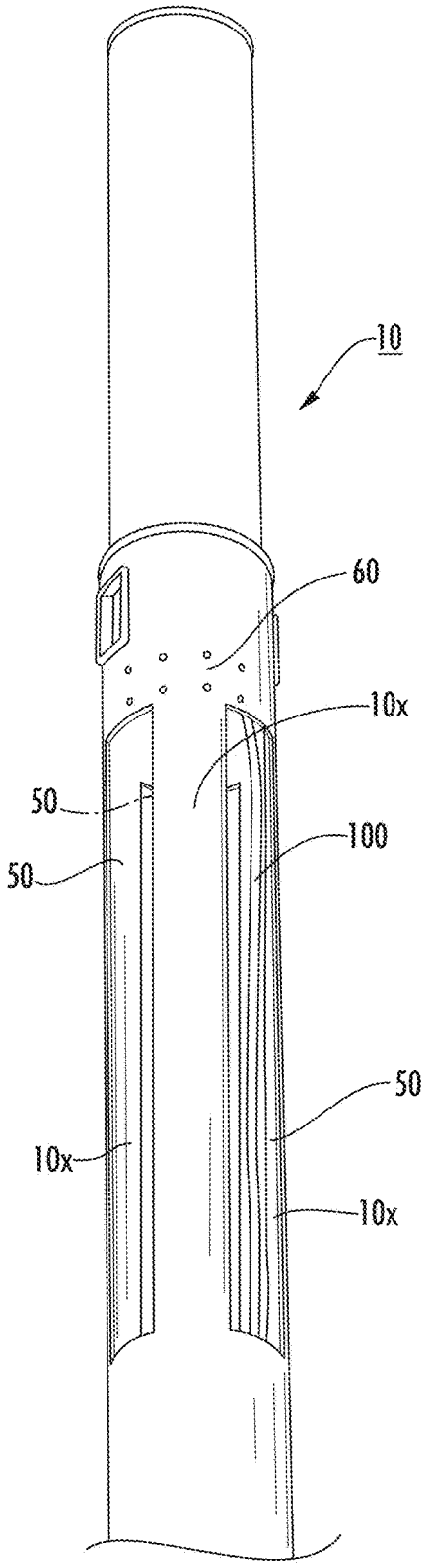

FIG. 5C illustrates the pole 10 with two spaced apart elongate windows 50 formed in situ with the pole erect leaving an intact region 10*x* therebetween. FIG. 5D also illustrates existing cabling 100 extending down the pole in the core 10*c* of the pole.

Figure 5E:
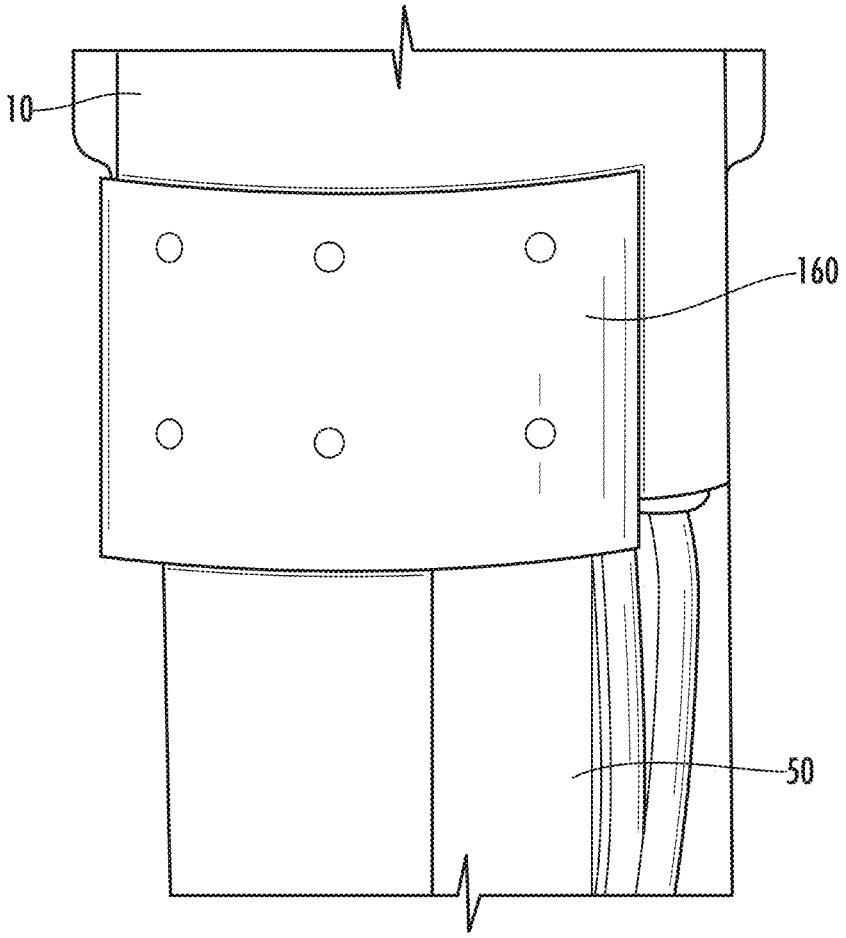
Figure 5F:
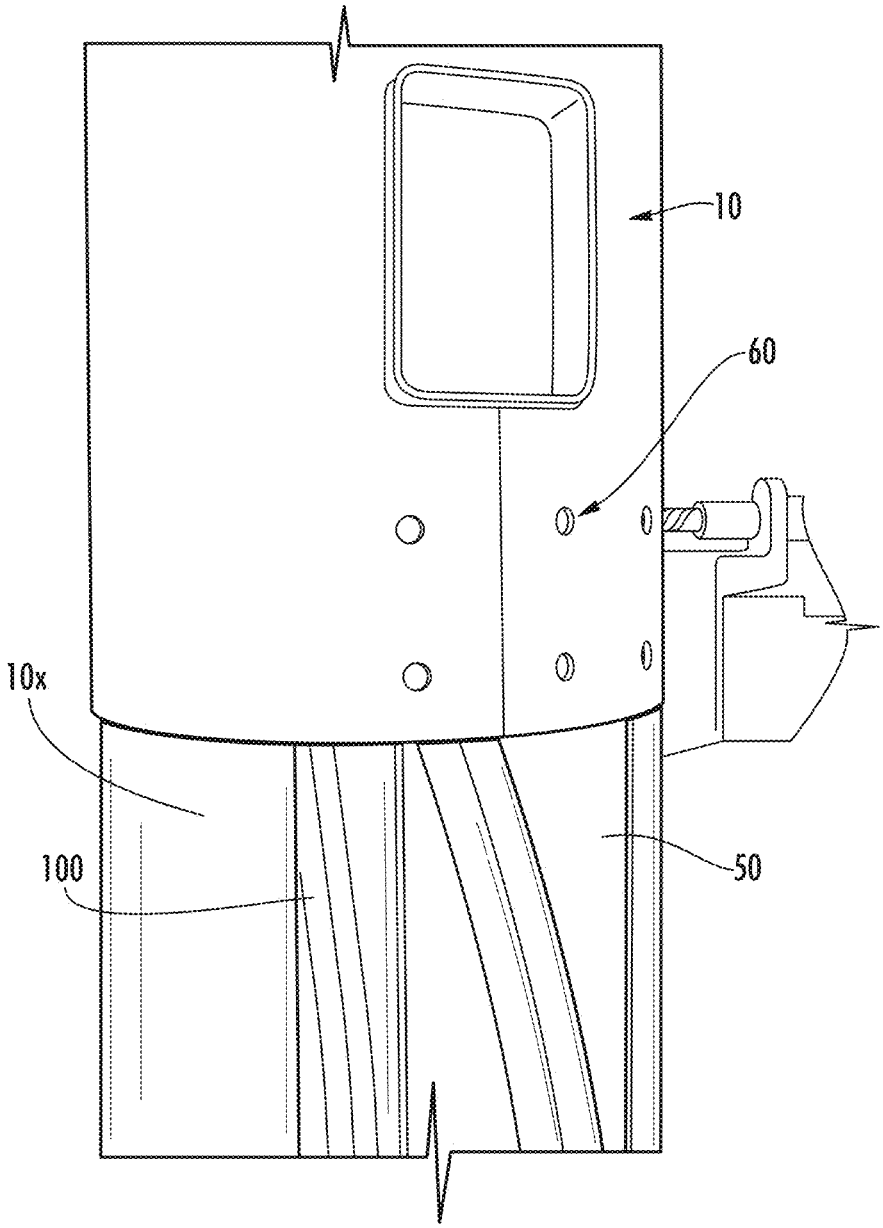
Figure 6:
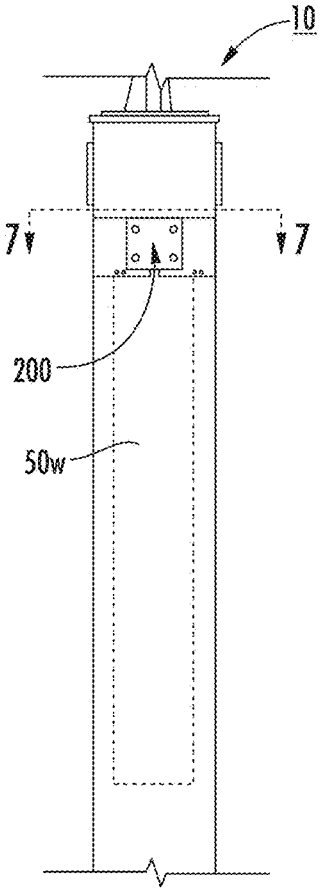
FIG. 6 is a front view of a portion of the antenna pole of FIG. 1 illustrating a bracket assembly attached to an existing erect pole to accommodate a new antenna canister according to embodiments of the present invention.
Figure 7:
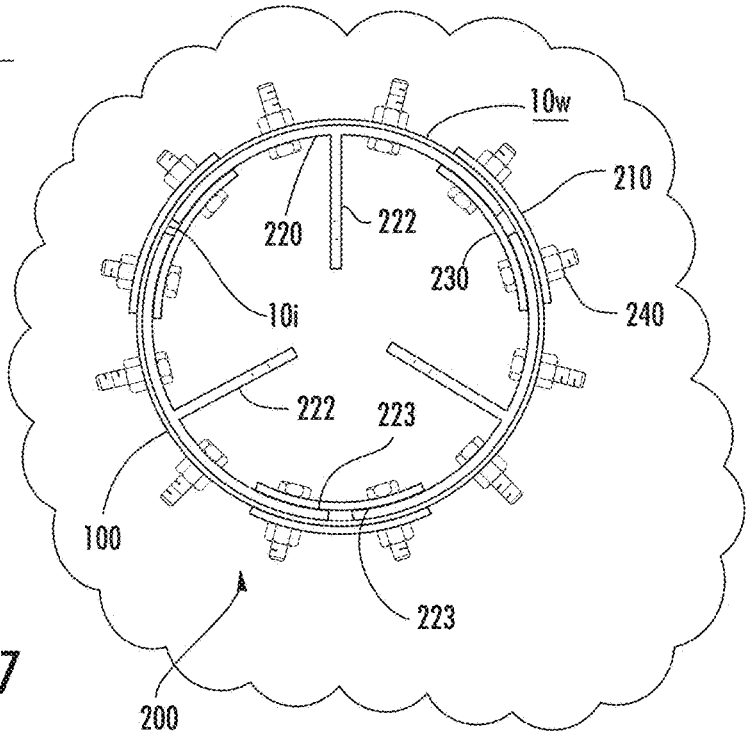
FIG. 7 is a cross-section of the bracket assembly on the pole taken along line 7-7 in FIG. 6.
Figure 9:
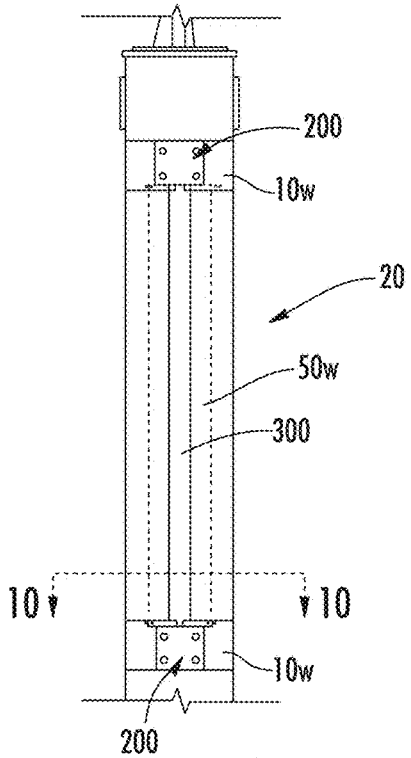
FIG. 9 is a front view of the portion of the antenna pole shown in FIG. 8 illustrating a lower bracket assembly attached to the pole and the vertical member according to embodiments of the present invention.
Figure 16:
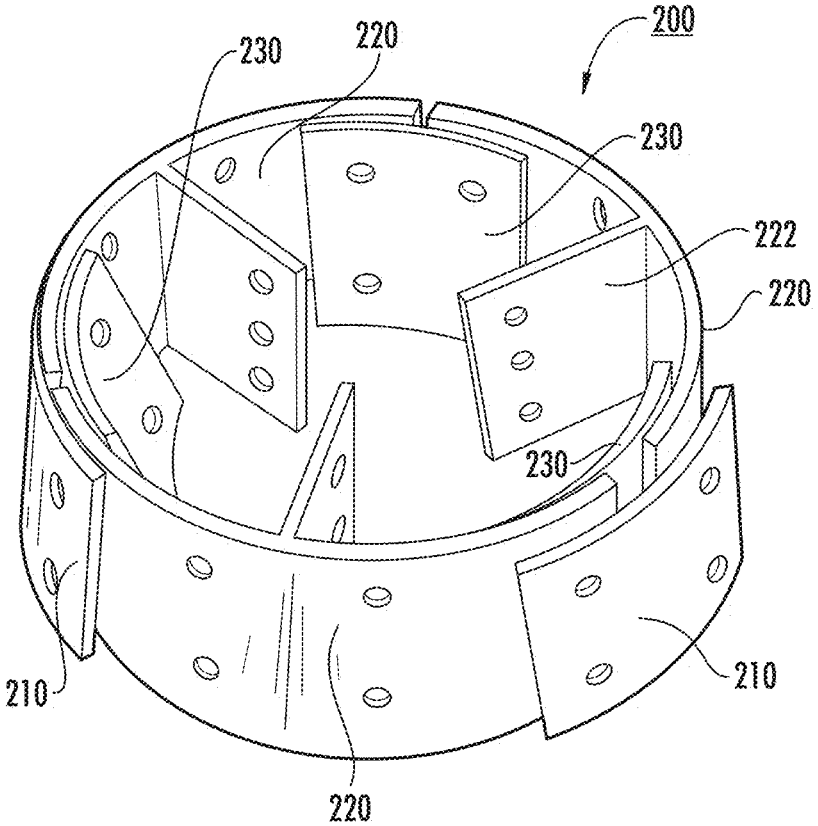
FIG. 16 is a top perspective view of an exemplary bracket assembly prior to installation according to embodiments of the present invention.

FIG. 5D also illustrates the pole 10 with three windows 50 and that a bolt hole pattern 60 has been inserted into the wall 10*w* of the pole at a location proximate to and above the windows 50. A similar bolt hole pattern 60 can be formed into the wall 10*w* at a location that is proximate to but below the window 50 (FIG. 9). FIG. 5E illustrates a template 160 that can be used to help form the bolt hole pattern 60 into the pole wall 10*w* to facilitate the proper pattern with a bracket assembly 200 (FIGS. 6,7, 16). The template 160 has a bolt hole pattern that corresponds to apertures in the bracket assembly 200. One or more templates 160 can be made in situ by installers or may be provided in a kit with other hardware useful for the installation/retrofit. The template can be formed from a substantially conformable material such as cardboard, or polymer. The template may have an adhesive backing to be able to adhere to the outer wall of the pole to assist in marking/making target bolt hole patterns. FIG. 5F illustrates the formation of the bolt hole pattern 60 on the erect pole 10.

FIG. 6 illustrates that a bracket assembly 200 can be attached to the pole wall at a location above the window 50. FIG. 7 illustrates an exemplary bracket assembly 200. As shown, the bracket assembly 200 includes at least one outer bracket member 210 and at least one inner bracket member 220. The outer bracket member 210 resides against the outer surface 10*o* of the pole wall 10*w* while the inner bracket member 220 resides against the inner surface 10*i* of the wall 10*w*. The inner and outer bracket members 210, 220 can be attached together using bolts 240 extending through the wall 10*w*. The inner bracket member 220 includes at least one inwardly extending arm 222. This arm 222 will engage a vertical member to hold a vertical member 300 in the core of the pole 10 (see, e.g., FIGS. 8-10). In the embodiment shown, each inner bracket 220 includes a single arm 222, but one or more may include a plurality of arms or pairs of arms and the like.

In the embodiment shown, the bracket assembly 200 includes a plurality of outer bracket members 210, and a plurality of inner bracket members 220 that cooperate to hold the vertical member 300 and structurally support a portion of the pole 10. Each inner bracket member 220 can include at least one arm 222. However, some of the inner bracket members 220 may not have an arm 222 and/or may have different attachment configurations.

It is also contemplated that other bracket assembly configurations may be used to attach the vertical member to the pole. In addition, the brackets can be bolted to the pole and each other as shown or may be otherwise affixed to the pole wall and/or each other. Indeed, it may be possible to weld some or all of the brackets and/or attachment members that hold the vertical pole to the pole.

Optionally, as also shown in FIG. 7, the bracket assembly 200 can also include a third bracket member 230 that resides in the core of the pole 10 facing the inner bracket member 220 with the arm 222. The third bracket member 230 can, attach to the wall 10*w* and the inner and outer bracket members 220, 210 such that the outer bracket member 210 and the third bracket member 230 sandwich edge portions 223 of adjacent ones of the inner bracket members 220. The inner bracket member(s) 220 can be attached to the wall 10*w* without the outer bracket member 210 at medial locations of the inner bracket member 220 (such as the location facing away from the arm 222 which can be configured to reside substantially in an arc center of the respective inner bracket member). The arm 222 can extend inwardly a distance that is less than half the width of the core 10*c* but more than a quarter of the width of the core 10*c* at the location thereof.

Figure 10A:
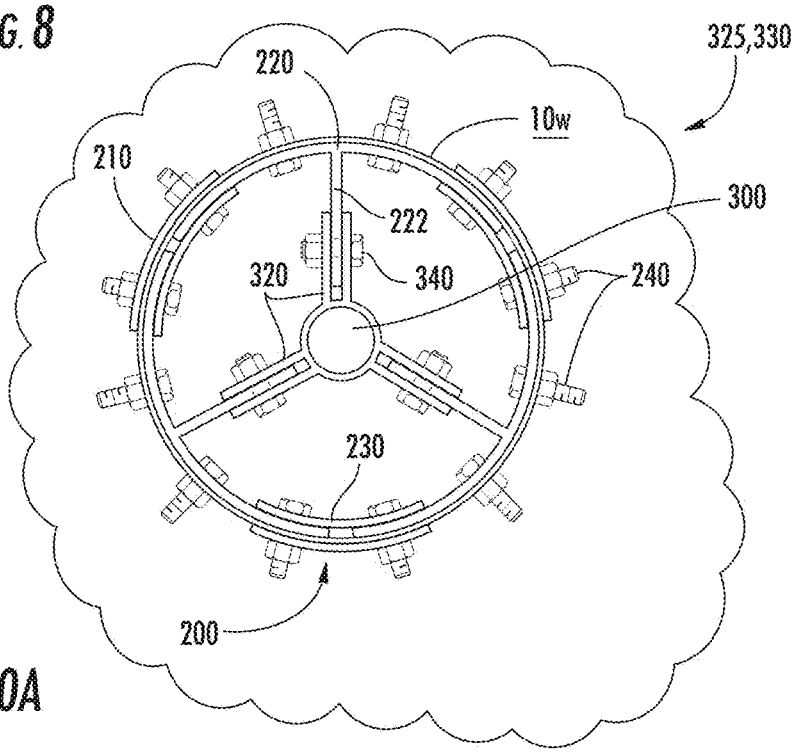
FIG. 10A is a cross-section of the pole, vertical member and bracket taken along line 10-10 of FIG. 9.
Figure 10B:
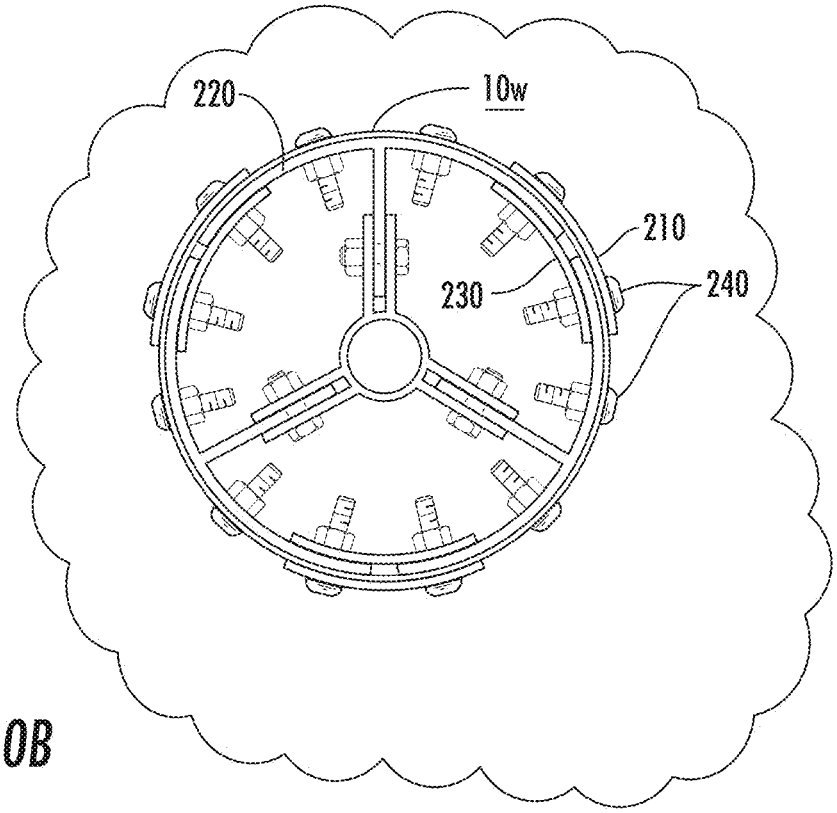
FIG. 10B is a cross-section of the pole, vertical member and bracket taken along line 10-10 of FIG. 9 with an alternate bolt configuration according to embodiments of the present invention.
Figure 25:
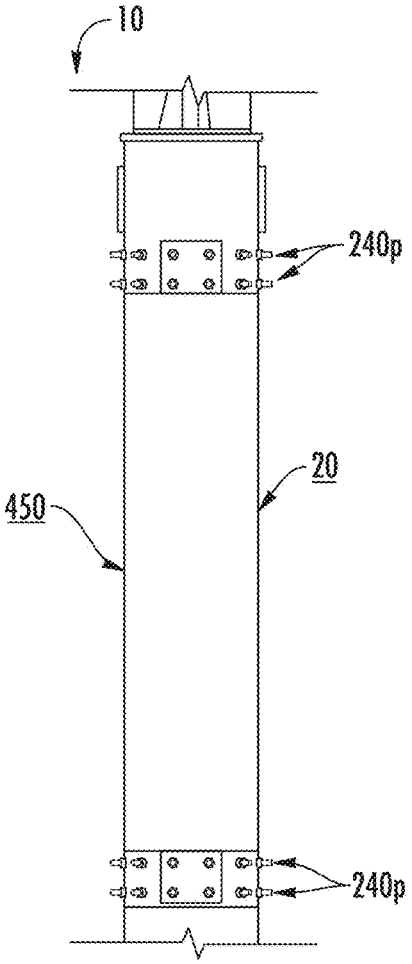
FIG. 25 is a front view of a modified antenna tower according to embodiments of the present invention.
Figure 26:
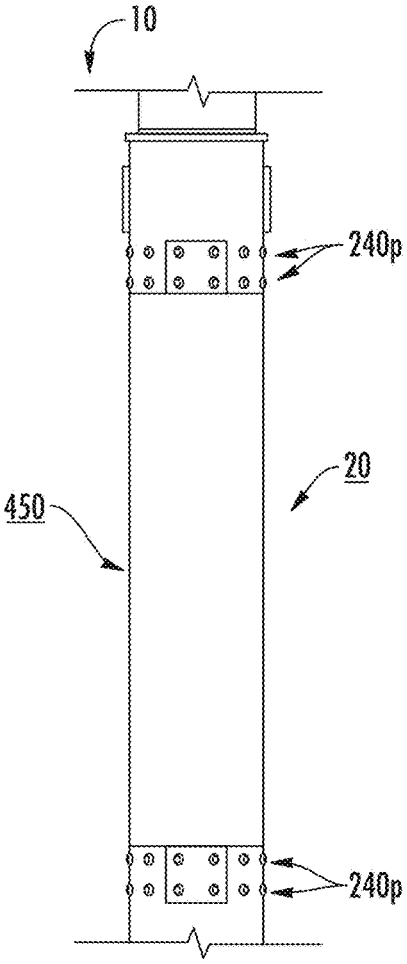
FIG. 26 is a front view of a modified antenna tower according to embodiments of the present invention.

The bolt heads of the high-strength bolts 240 are shown as residing in the core 10; but may be oriented otherwise. FIGS. 10A and 25 illustrates that the bolts 240 are assembled so that the bolt heads are on the inside of the wall and FIGS. 10B and 26 illustrate the bolts 240 can be assembled so that the bolt heads are on the outside of the wall 10*w*. The resulting (exemplary) bolt patterns 240*p* provided by these orientations with an exemplary internal canister 20 and encasement sheath 450 are shown in FIGS. 25 and 26 respectively. Combinations of these orientations may also be used. In addition, flat or round head other bolt head configurations may be used. In addition, the external brackets 210 can have countersinks to allow for flush or recessed mounting of the bolts for a more "transparent" cosmetic/aesthetic appearance with the other portions of the pole 10. In addition or alternatively, the brackets 210, 220 or 230 may have easily aligned and easy to mount features (e.g., slots that allow adjustment and hardware with quick connect fittings) and may not require the use of bolts. For example, the bracket assembly 200 can use bayonet fittings, pin fittings, clamps or other mounting hardware.

Figure 8:
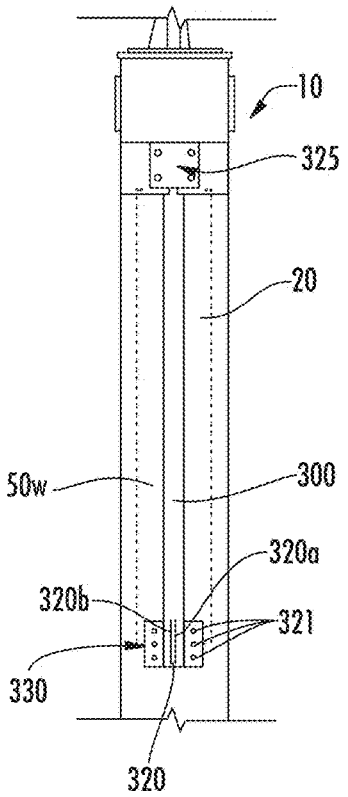
FIG. 8 is a front view of the portion of the antenna pole shown in FIG. 6 illustrating a vertical member attached to the bracket assembly according to embodiments of the present invention.

FIGS. 8-9 illustrate an elongate vertical member 300 held in the core of the pole 10 via upper and lower bracket assemblies 200. The lower bracket assembly 200 can have the same configuration as the upper bracket assembly 200 discussed above. As shown in FIG. 8, the vertical member 300 includes opposing upper and lower end portions 325, 330 that reside above the outer bounds of the window 50 and attach to respective upper and lower bracket assemblies 200. Although FIGS. 8 and 9 show the upper bracket assembly 200*u* placed first and the vertical member 300 attached to the upper bracket assembly first, the order can be reversed and the lower bracket assembly 200*l* can be attached first and/or the vertical member 300 attached to the lower bracket assembly first.

Figure 24:
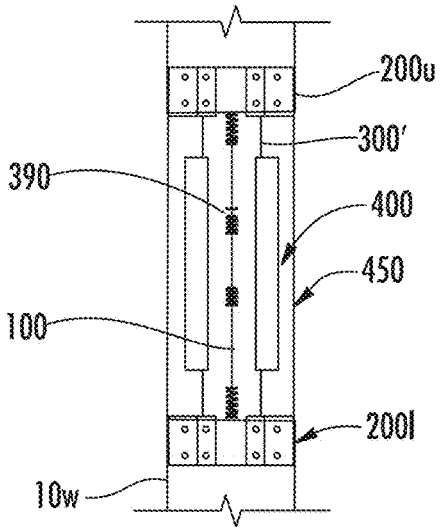
FIG. 24 is a front view of a portion of an antenna pole with the vertical rod assembly of FIG. 23 according to embodiments of the present invention.

The vertical member 300 can be tubular with a length (typically between about 5-15 feet) that is sufficient to hold an antenna(s) 400 (FIG. 24) thereon and have sufficient load bearing structural strength that meets engineering standards (e.g., wind and other environmental factors). The vertical member 300 can have a hollow core may be cylindrical or have other shapes. The vertical member 300 may comprise steel or other structurally suitable materials.

Still referring to FIG. 8, the vertical member upper and lower portions 325, 330 can include a plurality of spaced apart outwardly extending arms 320. Each arm 320 can include a plurality of vertically spaced apart apertures 321 that when aligned match with apertures in the inner bracket members arms 222 and bolts 240 (FIG. 10), or other members can be used to attach the arms together 320, 222. Again, the arms 320 can be attached to the inner mounting bracket 220 in other ways.

In the embodiment shown in FIGS. 8 and 10, the plurality of spaced apart arms 325 are formed as pairs of closely spaced apart arms 320*a*, 320*b* with a space therebetween that is sized and configured to slidably but snugly receive the arms 222 of the inner bracket member 220 as shown in FIGS. 10A, 10B.

Figure 11:
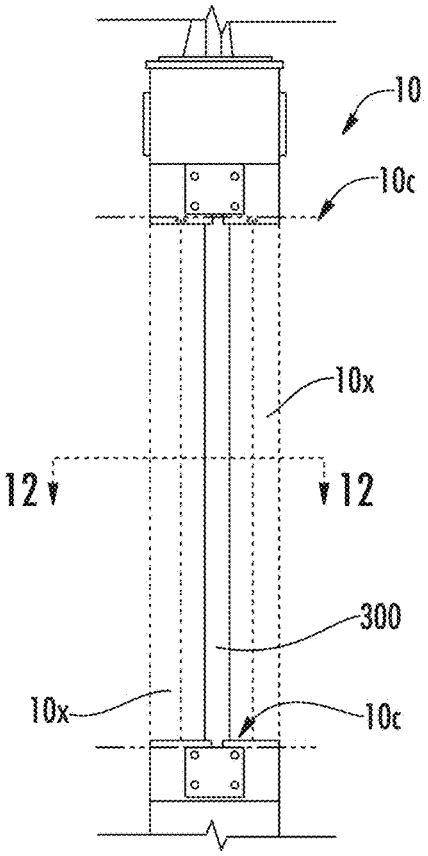
FIG. 11 is a front view of the portion of the antenna pole shown in FIG. 9 illustrating exemplary cut lines of a wall of the pole according to embodiments of the present invention.
Figure 12:
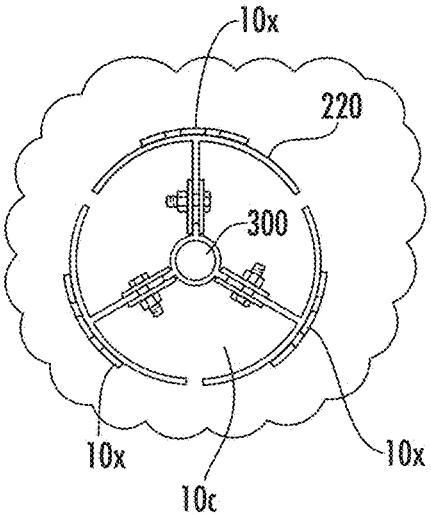
FIG. 12 is a cross-section of the antenna pole taken along line 12-12 of FIG. 11.

FIGS. 11 and 12 illustrate that after the upper and lower portions 325, 330 of the vertical member are attached to the pole 10, the intact segments 10*x* of the pole proximate the window(s) 50 can be removed. The region to be removed 10*x* is illustrated by broken lines in FIG. 12. However, in some embodiments, the intact segments 10*x* may remain and the shroud or antenna canister cover 450 (FIG. 13) placed thereon or thereover, and the antenna 400 can be inserted in the window 50 and attached to the member 300.

Figure 13:
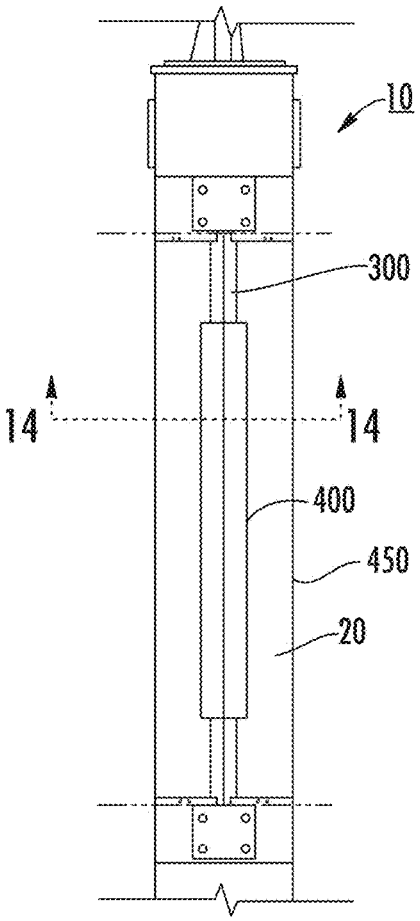
FIG. 13 is a front view of the antenna pole shown in FIG. 9 after resection of the pole wall and with an exemplary antenna and canister cover according to embodiments of the present invention.
Figure 14:
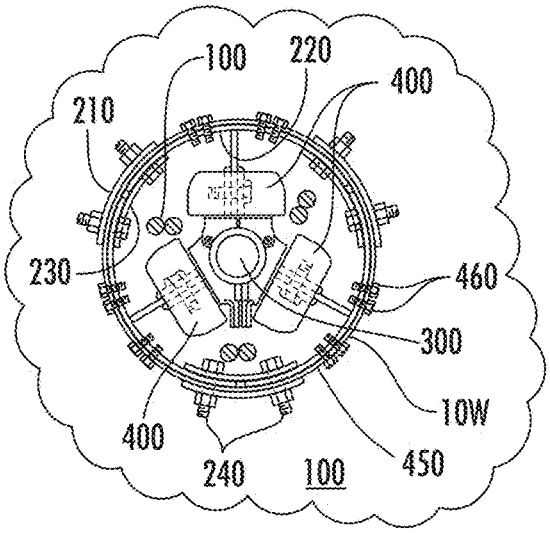
FIG. 14 is a cross-section of the pole with the new antenna canister taken along line 14-14 of FIG. 13.

FIGS. 13 and 14 illustrate that an antenna 400 is attached to the vertical member 300 residing in the pole 10 and a shroud or cover 450 placed about the canister 20 on the pole 10. Smaller bolts 460 (e.g., smaller than the high strength bolts used to attach the bracket assembly and/or vertical member 300) can be used to attach the cover to the pole 10. However, other fastening mechanisms, adhesives and the like may be, used. The bolts 240 and/or bracket 210 can reside above the cover or shroud 450 and may be partially externally visible but may be recessed as noted above or covered with an aesthetic coating, painting, wrapping or other substrate. The antenna 400 can have a length that is less than the length of the vertical member 300; typically the antenna is between about 50-90% of the length of the vertical member 300.

Figure 15:
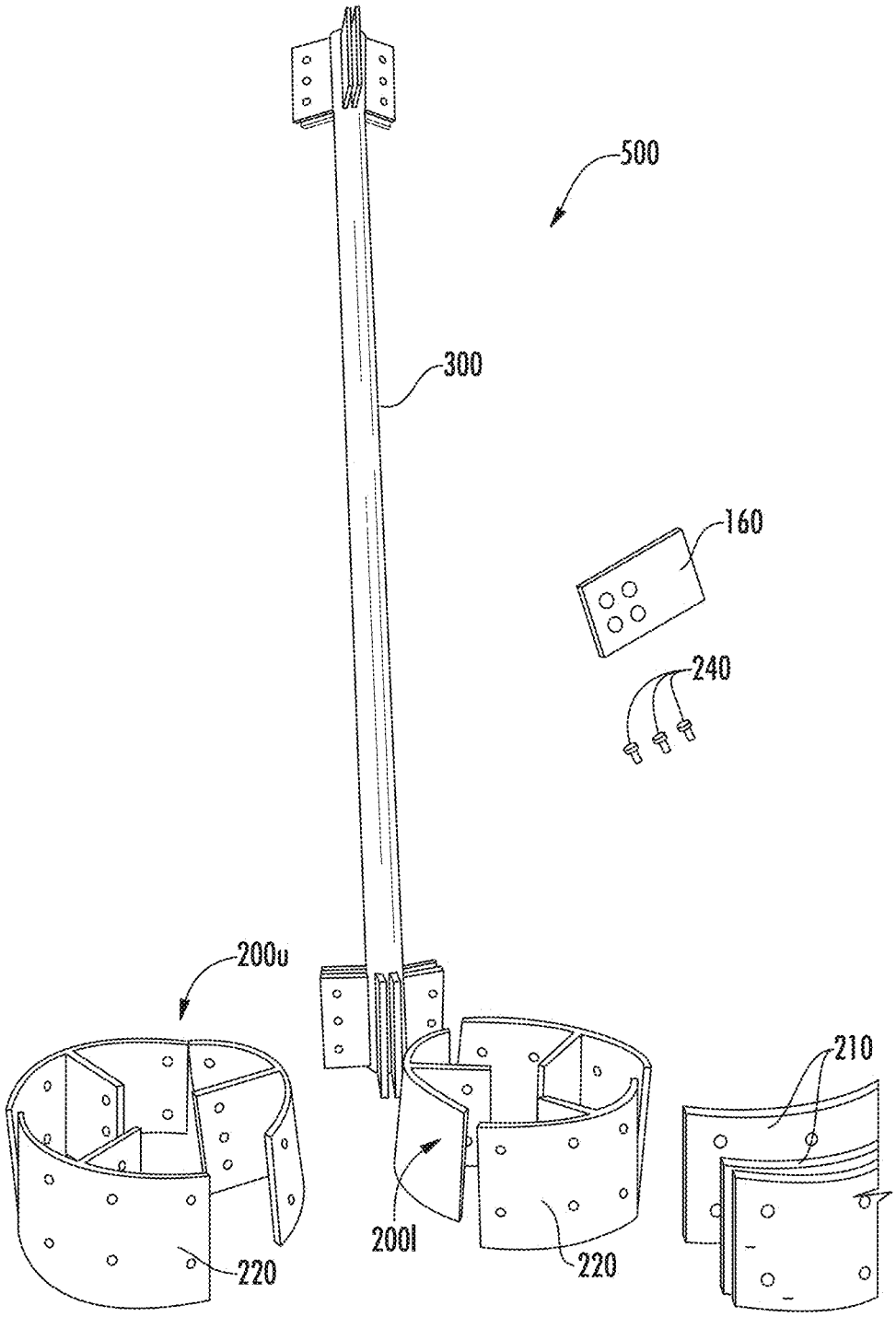
FIG. 15 is a front perspective view of exemplary vertical rod and bracket assemblies suitable for modifying an erect tower according to embodiments of the present invention.

FIG. 15 is a front perspective view of components that can be included in a kit 500 for modifying or retrofitting a concealed antenna pole 10 according to embodiments of the present invention. As shown, the kit 500 can include the vertical member 300, the upper and lower bracket assemblies 200*u*, 200*l* and bolts 240 (where used). The upper and lower bracket assemblies can include inner bracket member 220 and outer bracket member 210.

Figure 17:
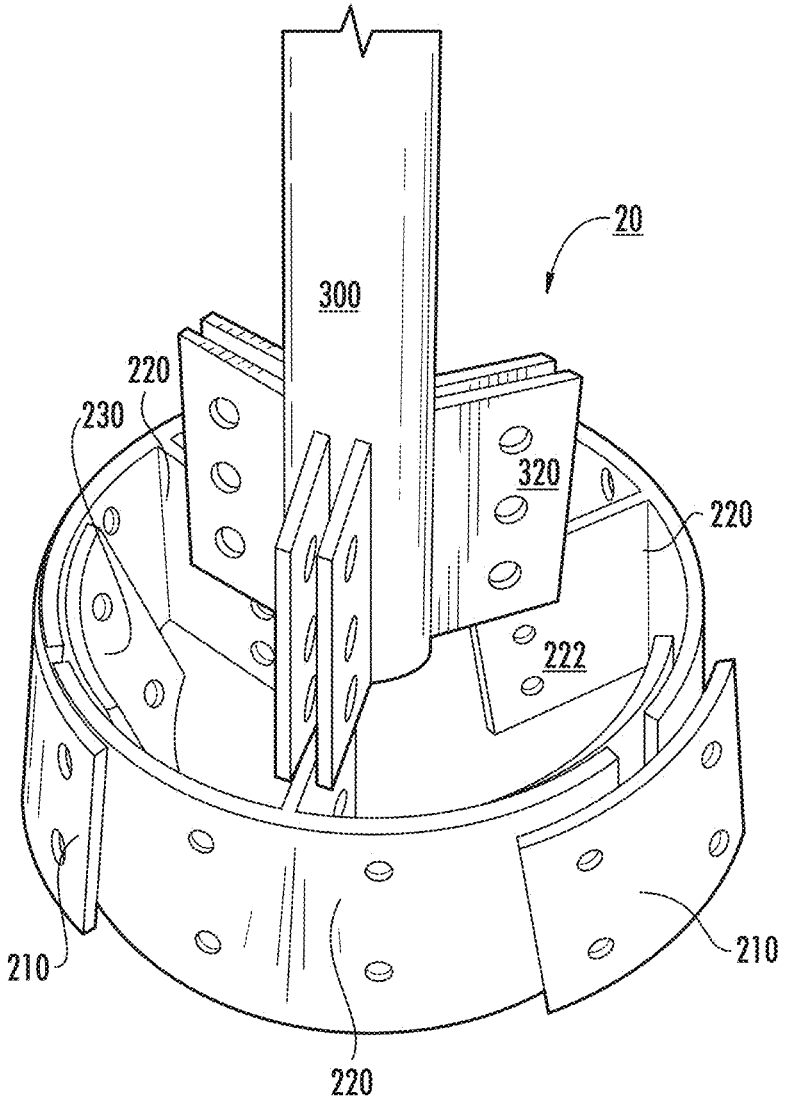
FIG. 17 is a partial top perspective view of the bracket assembly of FIG. 16 with a vertical member that is configured to attach thereto (shown pre-installation) according to embodiments of the present invention.
Figure 18:
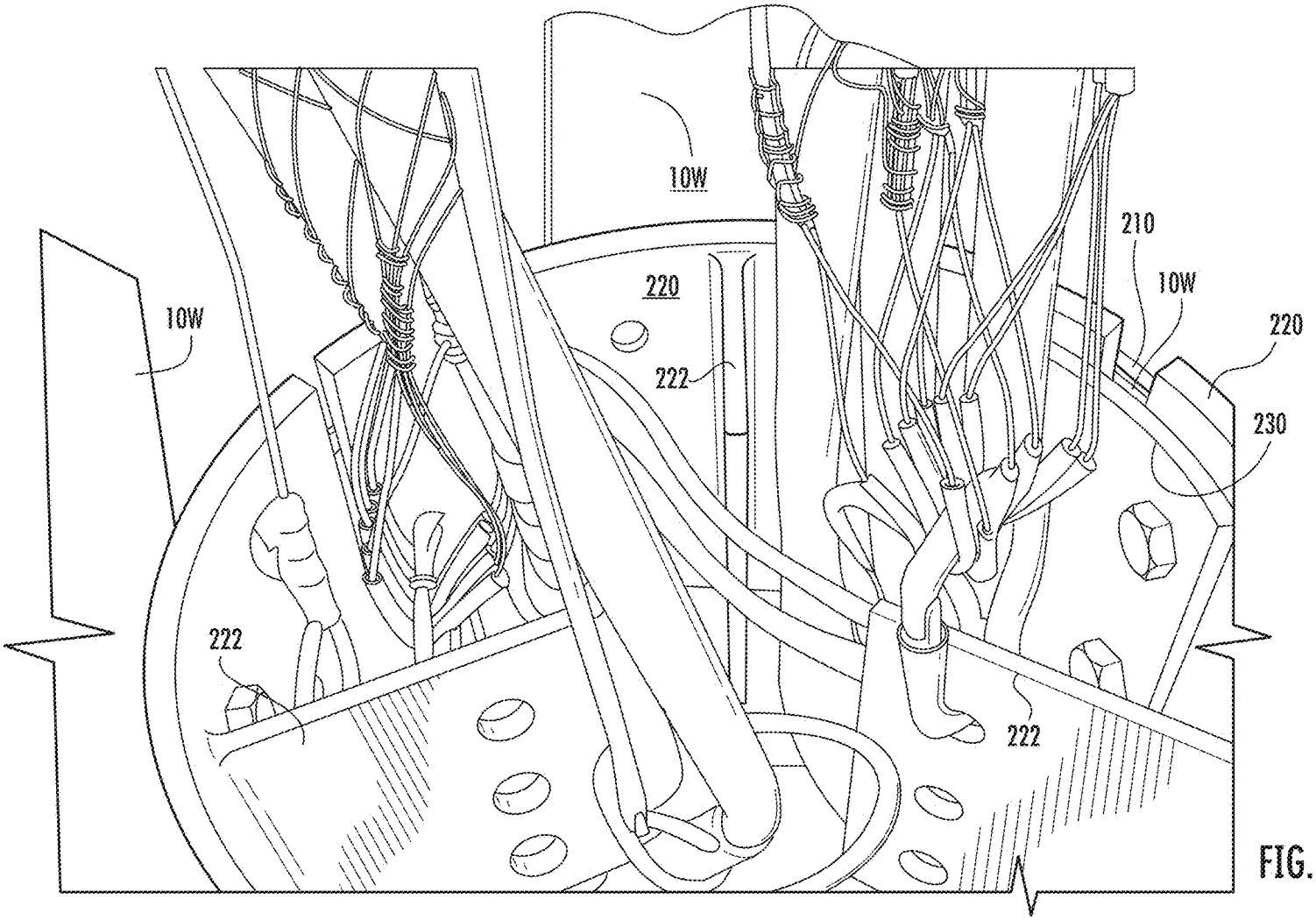
FIG. 18 is a top perspective view of a bracket assembly in position on a pole according to embodiments of the present invention.

FIG. 16 illustrates the bracket assembly 200 with the pieces 210, 220 and 230 aligned pre-installation. FIG. 17 illustrates the vertical member lower portion positioned over the bracket assembly 200 pre-installation. FIG. 18 illustrates the bracket assembly attached to the pole wall, with the inner member arms 222 extending inwardly into the core of the pole 10 and existing cabling 100 extending in spaces created by the inner bracket member 220.

Figure 19:
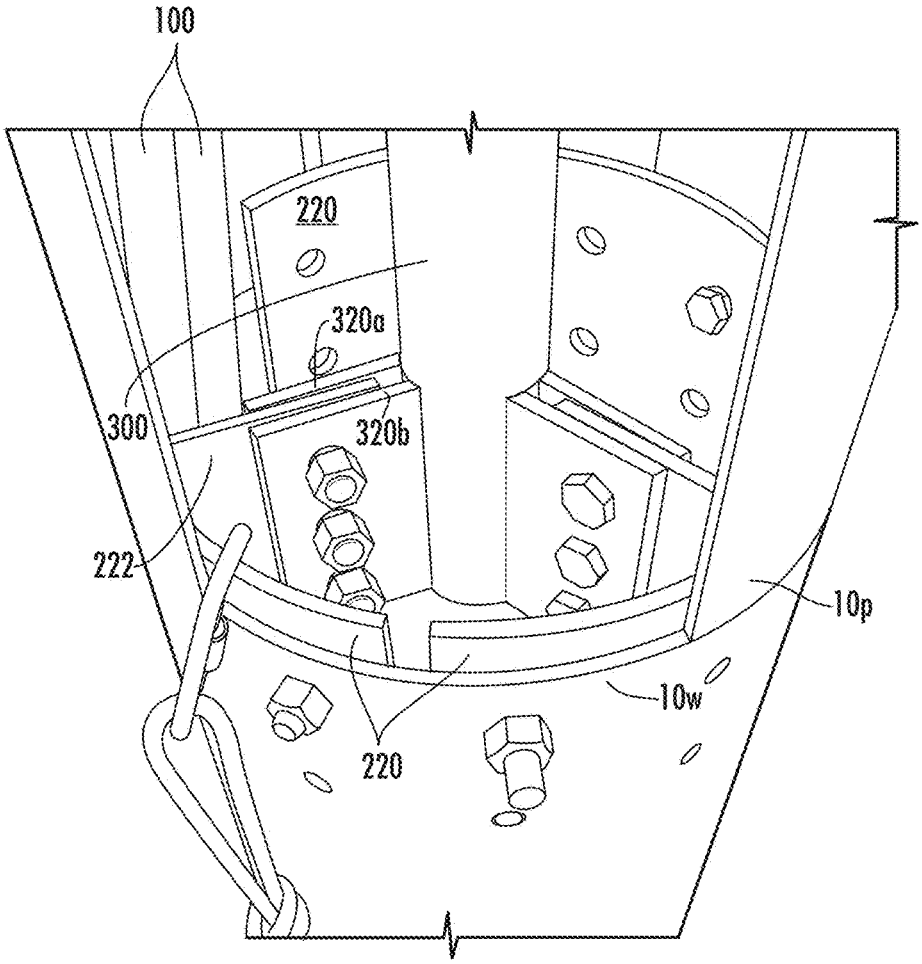
FIG. 19 is a top perspective view of a bracket assembly and vertical member in position on a pole according to embodiments of the present invention.
Figure 20A:
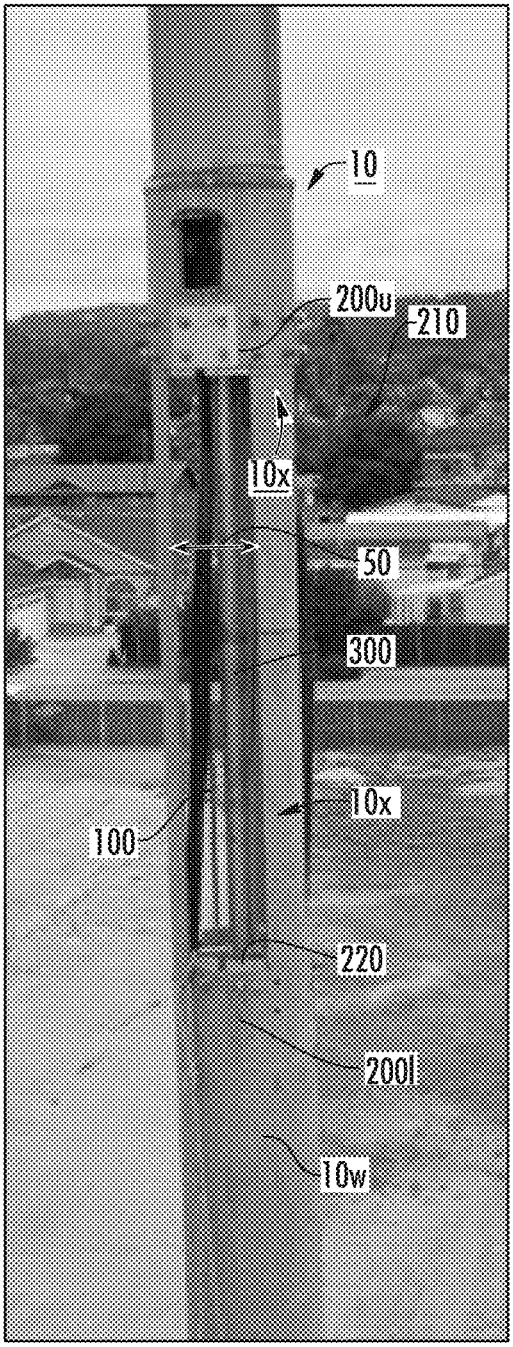
FIGS. 20A-20C are sequential digital images that illustrate that, after the vertical rod and bracket assemblies are attached to the pole, intact wall segments about the vertical rod can be removed according to embodiments of the present invention.

FIG. 19 illustrates the bracket assembly 200 using only the inner bracket member 220 attached to the pole wall 10*w* with the inwardly extending arm 222 attached to the vertical member arm pairs 320*a*, 320*b*. FIG. 20A illustrates the pole 10 with the upper bracket assembly 200*u* being different than the lower 200*l* (the upper bracket assembly 200*u* having the external bracket member 210 and the lower not having this member).

Figure 20B:
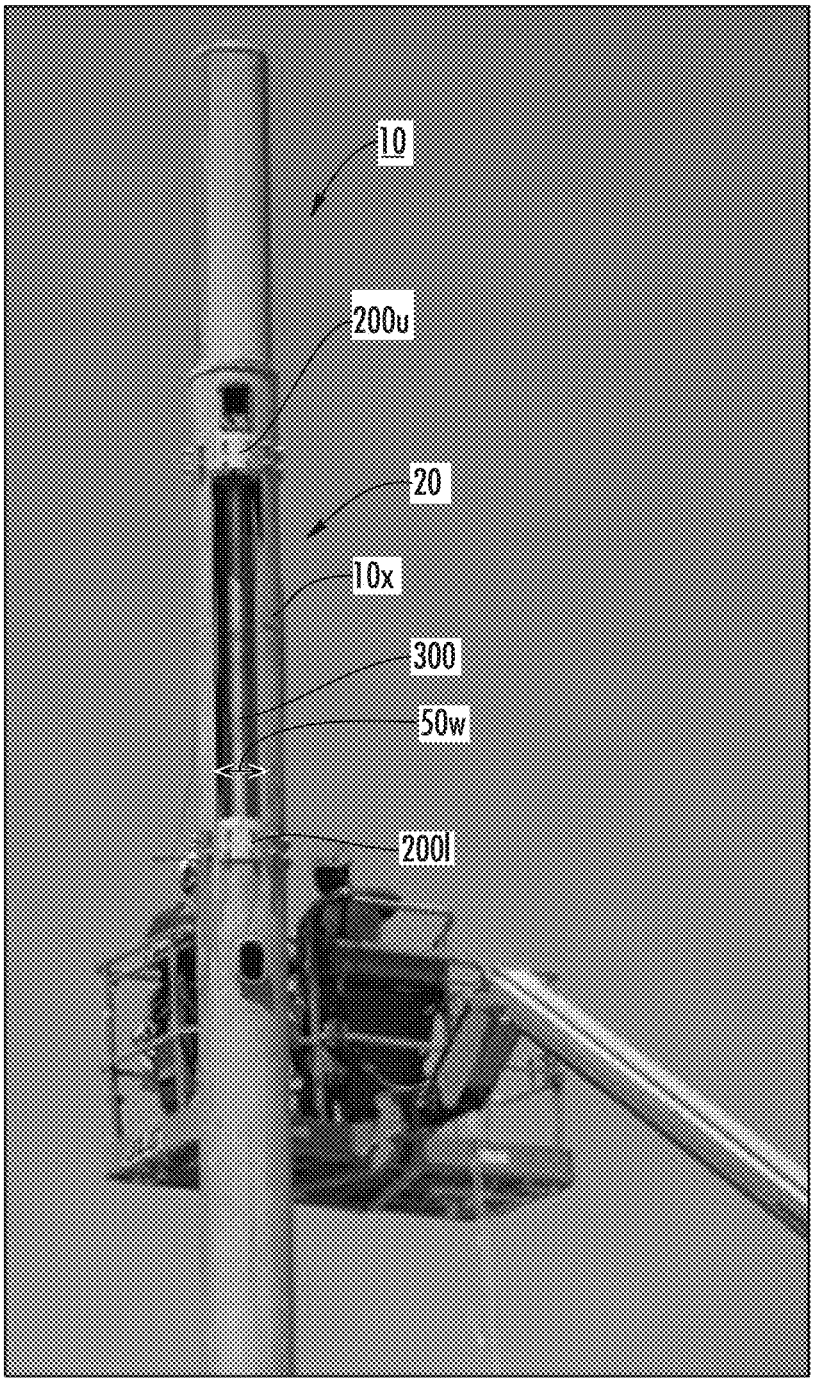
Figure 20C:
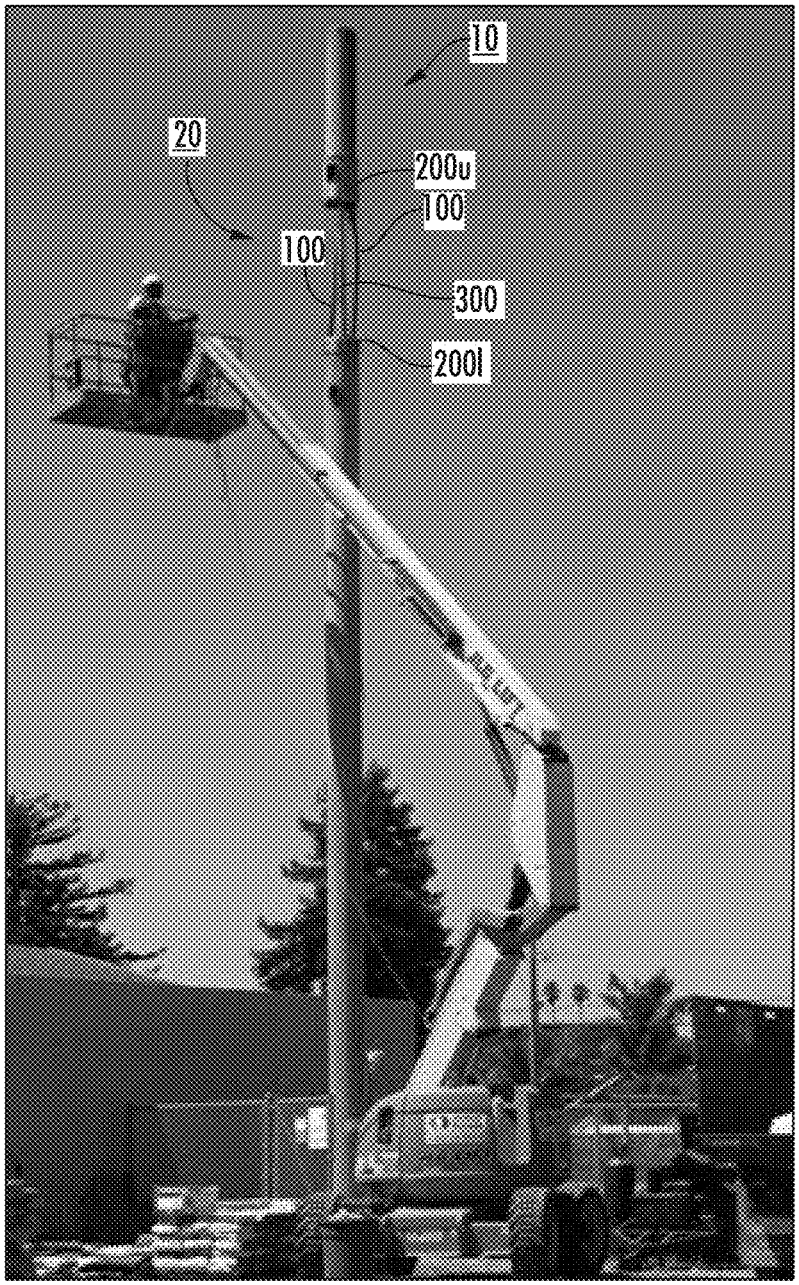

FIG. 20B illustrates that the vertical member 300 can be attached to the pole 10 with both the upper and lower bracket assemblies 200*u*, 200*l* being substantially the same (e.g., using all three brackets 210, 220, 230) as discussed above. Once the vertical member 300 is structurally attached to the upper and lower portions of the pole 10, the intact segments 10*x* can be removed as shown in FIG. 20C.

Figure 20D:
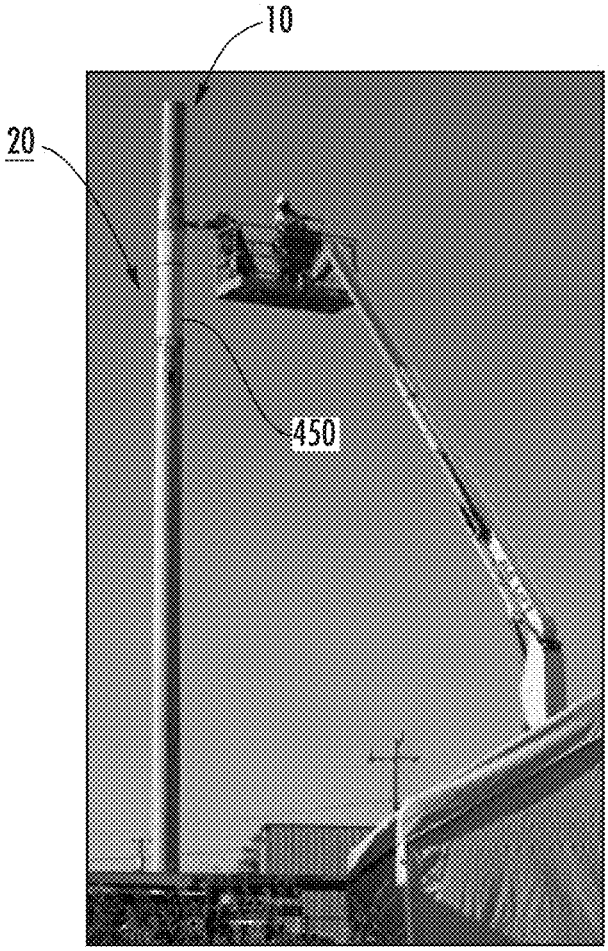
FIG. 20D is a digital image of a concealed antenna pole that illustrates that an antenna canister cover or shroud can be placed over the in situ installed antenna canister according to embodiments of the present invention.

FIG. 20D shows that a cover or shroud 450 can be attached to the "new" canister 20 on the erect pole (before or after an antenna 400 is attached to the vertical member 300).

Although not shown, in some embodiments it may be desirable to use a crane to help to support an upper portion of the pole during the installation process, particularly where the canister 20 is installed at a lower portion of a tall tower.

Figure 21A:
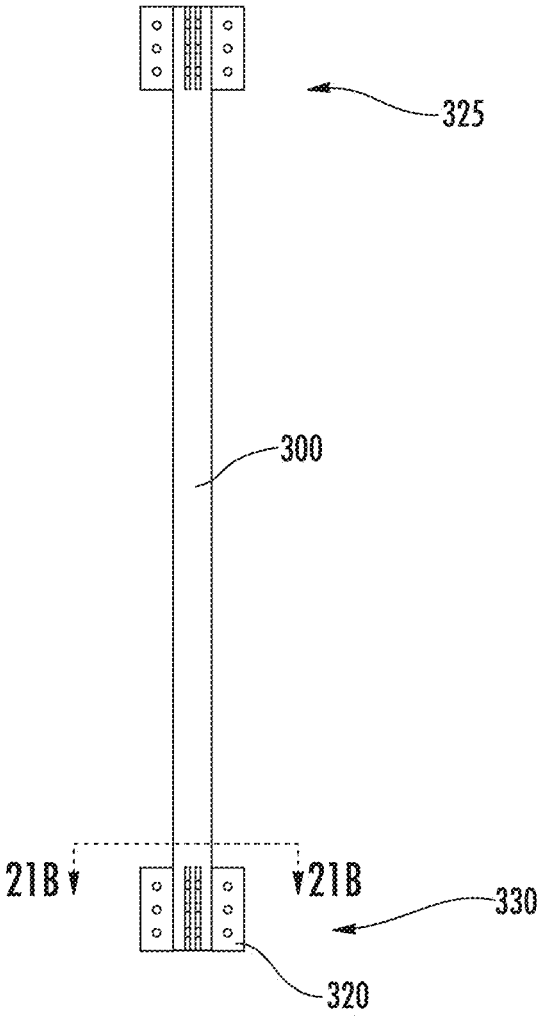
FIG. 21A is a front view of an exemplary vertical member according to embodiments of the present invention.
Figure 21B:
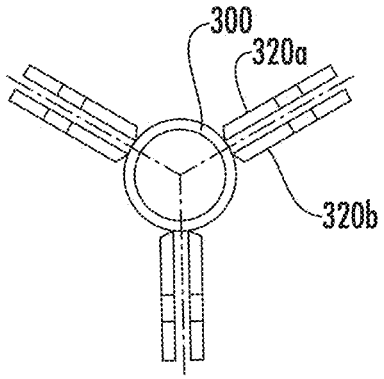
FIG. 21B is a cross-section of the vertical member of FIG. 21A taken along line 21B-21B.
Figure 22A:
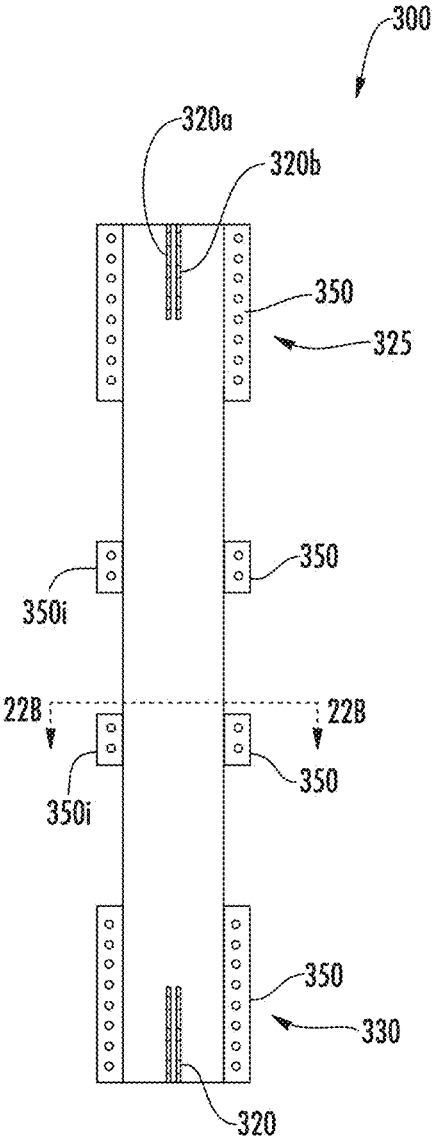
FIG. 22A is a front view of another exemplary vertical member according to embodiments of the present invention.
Figure 22B:
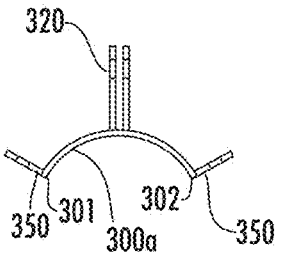
FIG. 22B is a cross-section of the vertical member taken along line 22B-22B of FIG. 22A.
Figure 23:
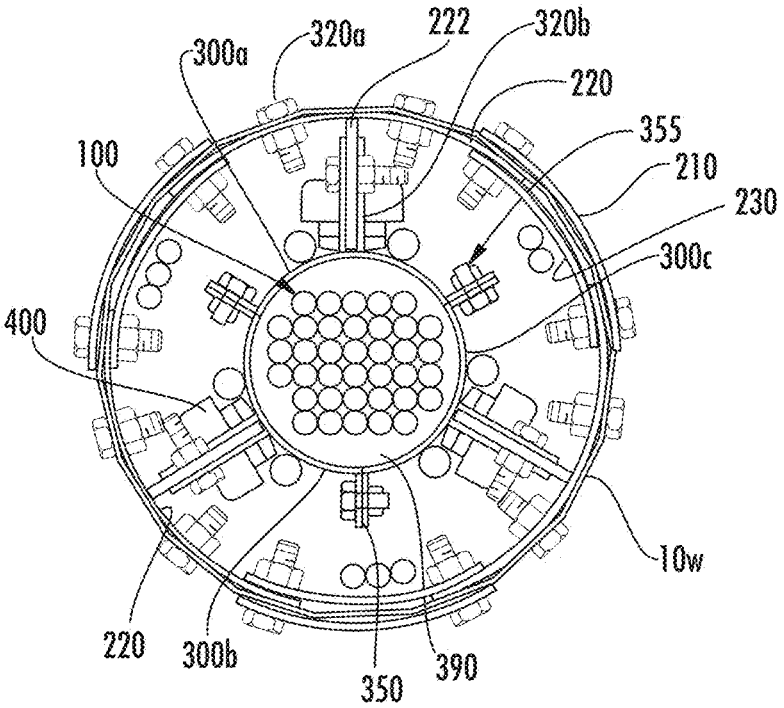
FIG. 23 is a top cross-sectional view of an assembly using the vertical member shown in FIG. 22A in an exemplary operative (in-use position) configuration according to embodiments of the present invention.

FIGS. 21A and 21B illustrate the vertical member 300 (e.g., "rod" or "spool") shown and described above with respect to FIGS. 8 and 10. FIGS. 22A and 22B illustrate an alternate embodiment of the vertical member 300'. In this embodiment, the vertical member 300' comprises a plurality of longitudinally extending components that attach together as shown in FIG. 23 to define a core or cavity 390 that can surround existing cabling in a pole 10 and/or cabling from an antenna canister residing thereabove. As shown in FIG. 23, the member 300' can include three matable components 300*a*, 300*b*, 300*c* that attach together. However, in other embodiments, two such components or more than three may be used. Each component 300*a*, 300*b* (and 300*c*, where used) can include axially extending tabs 350 that reside on outer edges 301, 302 that can attach to tabs of a neighboring component 300*b*, 300*c*. Each longitudinally extending piece 300*a*, 300*b* (and 300*c*, where used) can abut or be spaced with gaps therebetween.

As shown in FIG. 22B, each longitudinally extending component 300*a* of the vertical member 300' can be arcuate or semi-circular and hold at least one (radially) outwardly extending arm 320 (shown as having pairs of closely spaced arms 320*a*, 320*b*). However, the members 300*a* can have other shapes and define other core or cavity shapes when assembled such as, for example, a polygonal shape, an oval shape and the like.

The tabs 350 on opposing end portions 325, 330 of the member 300 may have a greater length than tabs 350*i* extending therebetween. In some embodiments, the intermediate tabs 350*i* may be omitted. The tabs 350 can include a plurality of vertically spaced apart (typically aligned) apertures 351. Bolts 355 (FIG. 23) or other attachment mechanisms can be used to attach the tabs/members 300*a*, 300*b*, 300*c*.

The vertical member 300' can be used for custom fabrication of antenna canisters on poles pre-erection or for retrofit of existing poles as described above. The vertical member 300 and/or 300' can have a continuous closed wall or the walls may have slots or apertures.

For installation procedures on an erect pole, the installing process can attach the components 300*a*, 300*b* (and 300*c*) one at a time to the pole 10 and/or each other during the installing step so that one or more cables 100 from an existing canister(s) above the antenna canister 20 of the installing step can be gathered and/or bundled inside the cavity 390 formed by the multi-piece vertical member 300' during the installing step.

Figure 27:
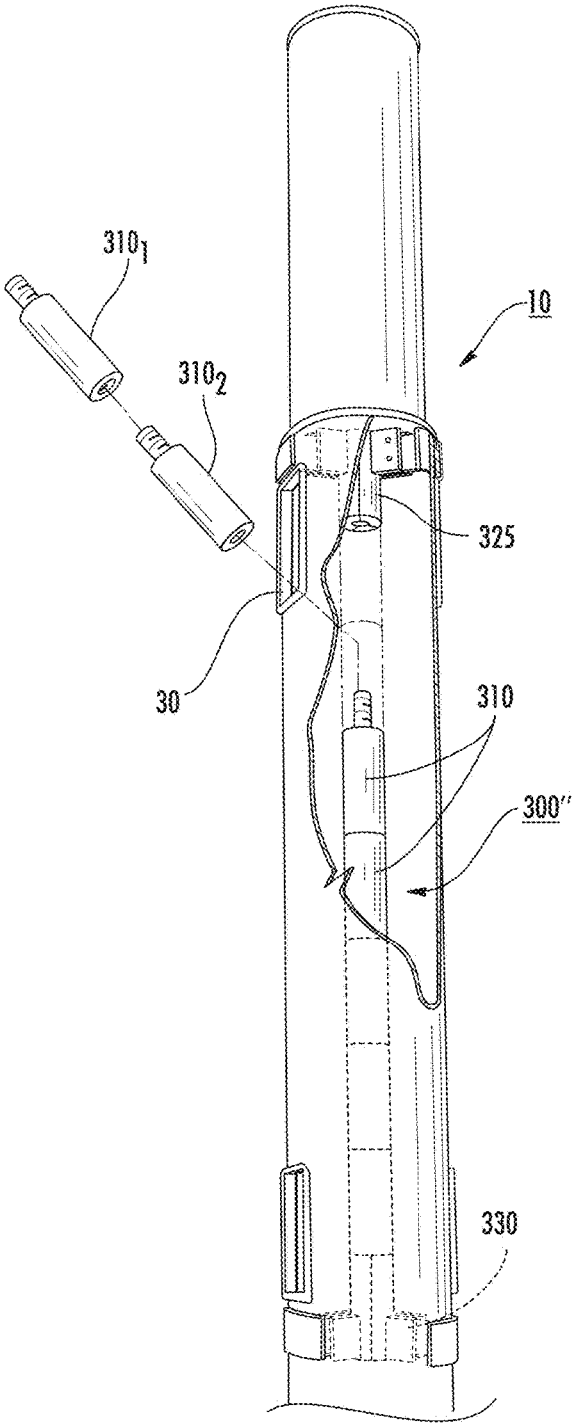
FIG. 27 is a front perspective view of a portion of antenna pole illustrating that the vertical rod can be provided in sections and assembled in situ according to other embodiments of the present invention.

FIG. 27 illustrates an alternate embodiment from the method shown in FIGS. 5A-5C and another embodiment of the vertical member 300" (e.g., spool or rod). As shown, the vertical member 300" can be provided in a series of attachable sections 310 that can be assembled in situ after or during insertion of the sections 310 using one or more hand holes 30. As shown, there is at least one hand hole 30 proximate the upper mounting bracket location 200*u* and at least one hand hole 30 location proximate the lower mounting bracket location 200*l*. There may be two or more (circumferentially) spaced-apart hand holes 30 at each or one of the upper and/or lower locations.

The hand holes 30 may be used in conventional size or may be enlarged with an extension to facilitate the insertion of the inner brackets, e.g., 220 (and 230 where used) and/or vertical member sections 310, 325, 330. In this embodiment, hand holes 30 can be positioned both proximate the top and bottom of the target section 20. The length of each section 310 can be the same or may vary. The top and bottom mounting bracket assemblies 200*u*, 200*l* can be installed with the wall of the pole 10*w* being substantially intact. The vertical member 300" can be installed so that at least one of the upper or lower portion 325, 330 is attached to the respective bracket assembly 200*u*, 200*l*, then other sections 310 can be assembled, typically either top-down or bottom-up. In this embodiment, as shown in FIG. 28, the tower/pole wall 10*w* targeted for the canister 20 can be cut at one time (even as one piece) after the bracket assemblies 200*u*, 200*l* and sectioned vertical member 300" are in position or installed.

Figure 28:
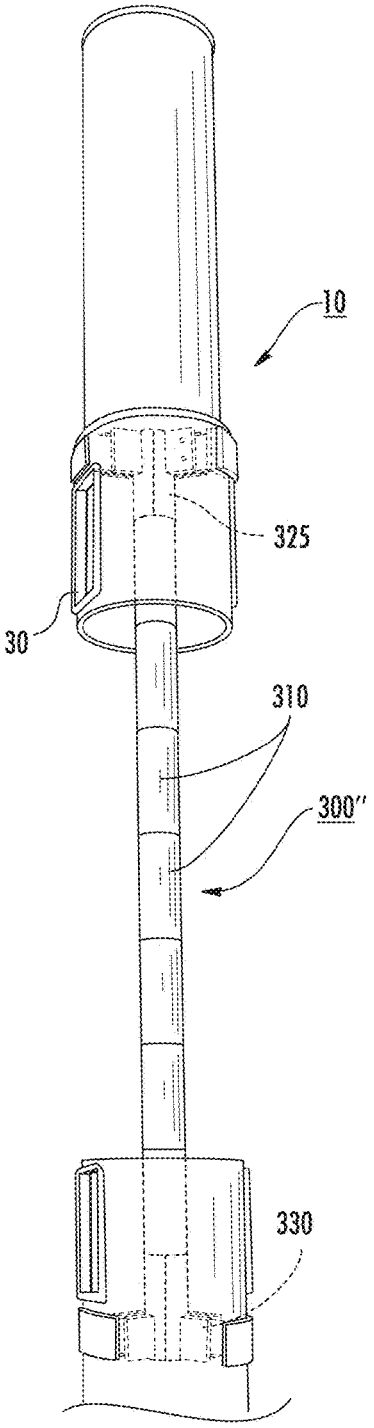
FIG. 28 is a front perspective view of the portion of antenna pole shown in FIG. 27 illustrating that after the vertical rod is in position, the pole wall surrounding the rod can be removed according to other embodiments of the present invention.

FIGS. 27 and 28 illustrates that the adjacent sections $\mathbf{310}_1$, $\mathbf{310}_2$ can be threadably attached with one adjacent member having a male threaded portion that engages the corresponding female threaded portion of a neighboring member. However, bayonet, friction fit or other attachment configurations may be used. The male threaded portions may all face up or down or be interleaved in various connection configurations. The multi-piece vertical member 300" can be provided in various sizes and attachment configurations that provide the desired mechanical structural loading capacity and/or other requirements.

Figure 29:
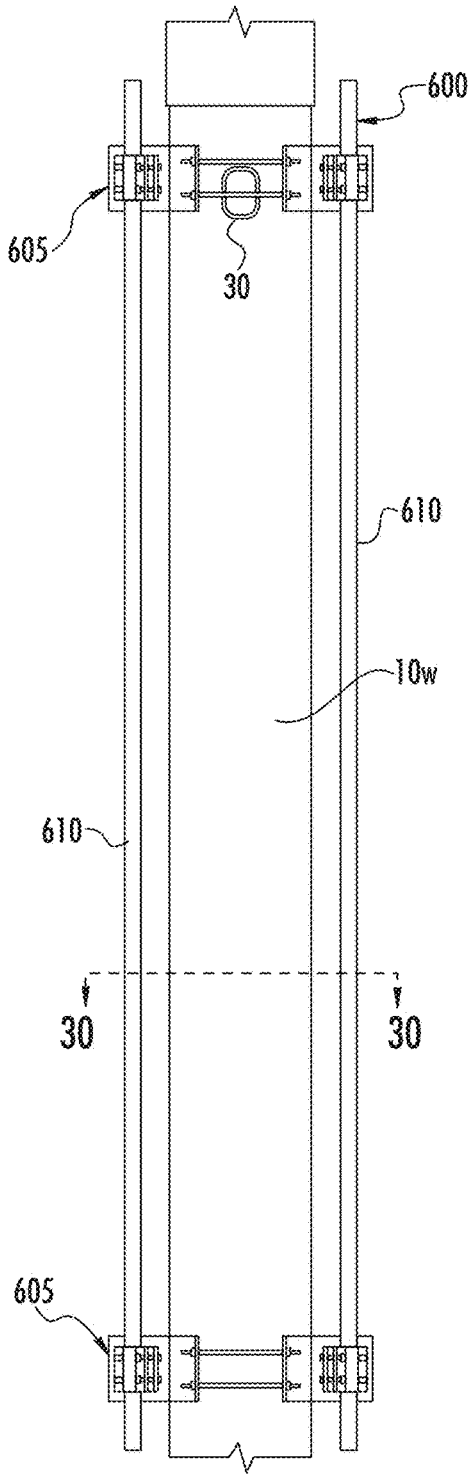
FIG. 29 is a partial front view of a concealed antenna tower with a temporary brace according to embodiments of the present invention.
Figure 30:
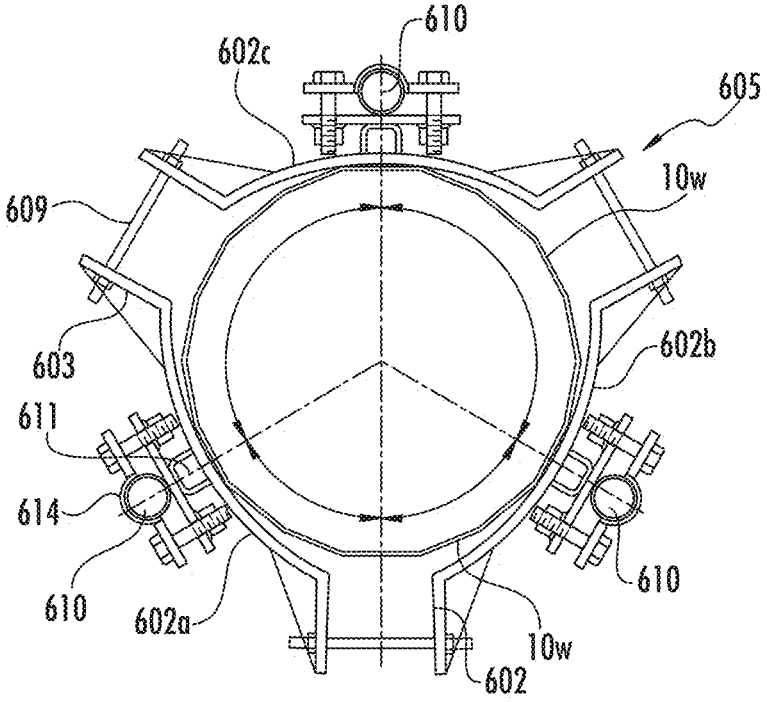
FIG. 30 is a section view thereof taken along lines 30-30 in FIG. 29.
Figure 31:
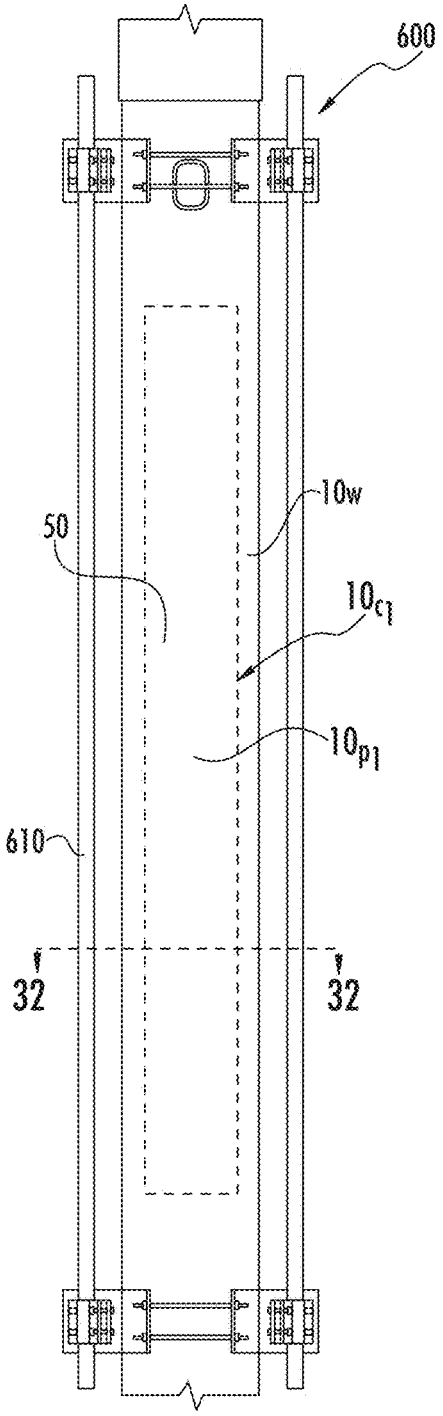
FIG. 31 is a partial front view of the tower and brace shown in FIG. 29 with a partial demolition as indicated by the broken lines according to embodiments of the present invention.
Figure 32:
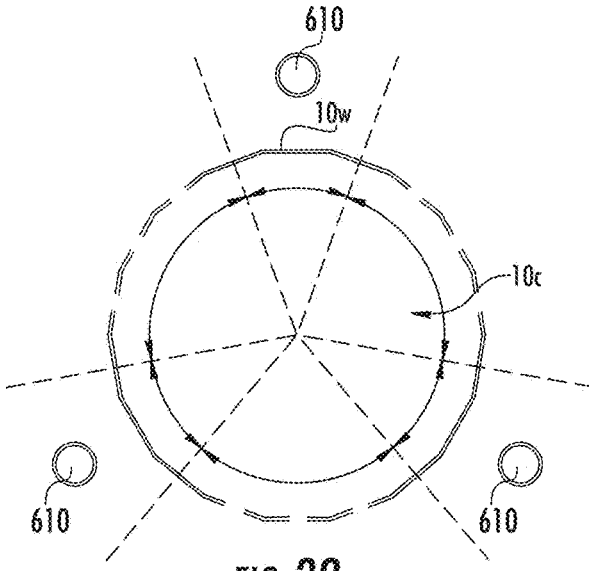
FIG. 32 is a section view thereof taken along lines 32-32 in FIG. 31.
Figure 33:
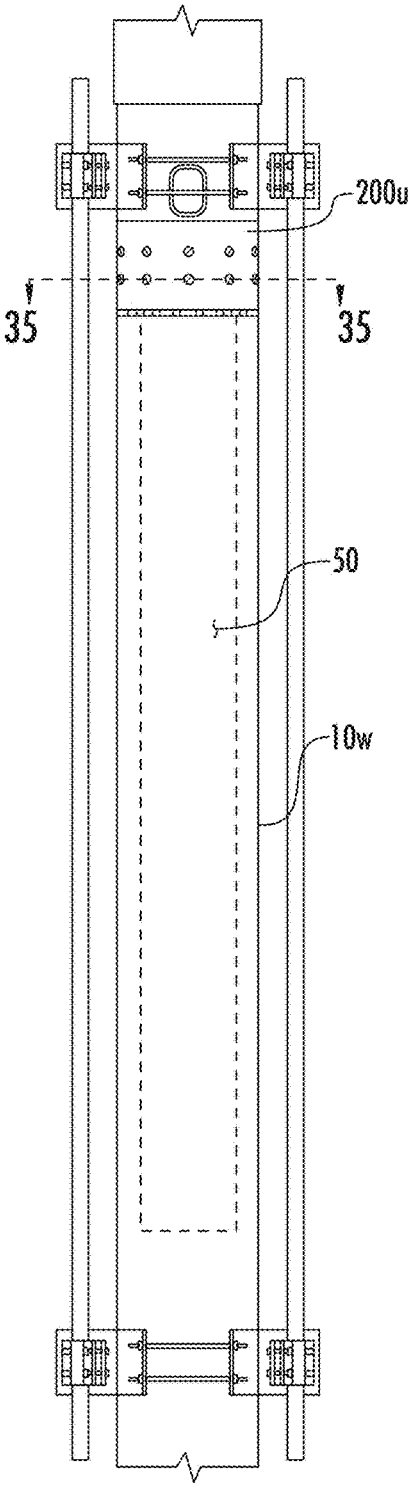
FIG. 33 is a partial front view of the tower and brace shown in FIG. 31 with a top bracket assembly attached according to embodiments of the present invention.
Figure 34:
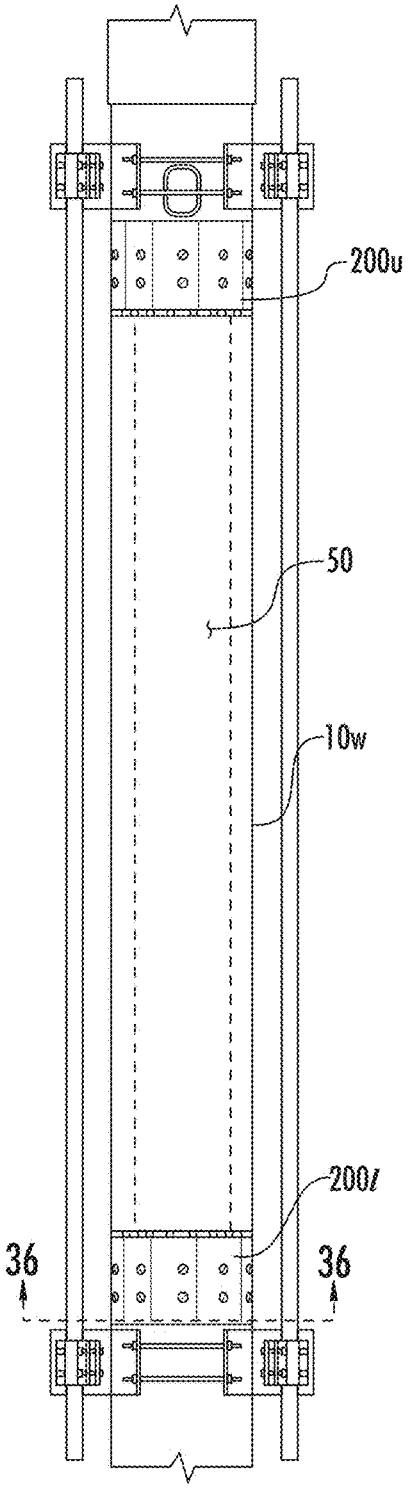
FIG. 34 is a partial front view of the tower and brace shown in FIG. 32 with a bottom bracket assembly attached according to embodiments of the present invention.
Figure 35:
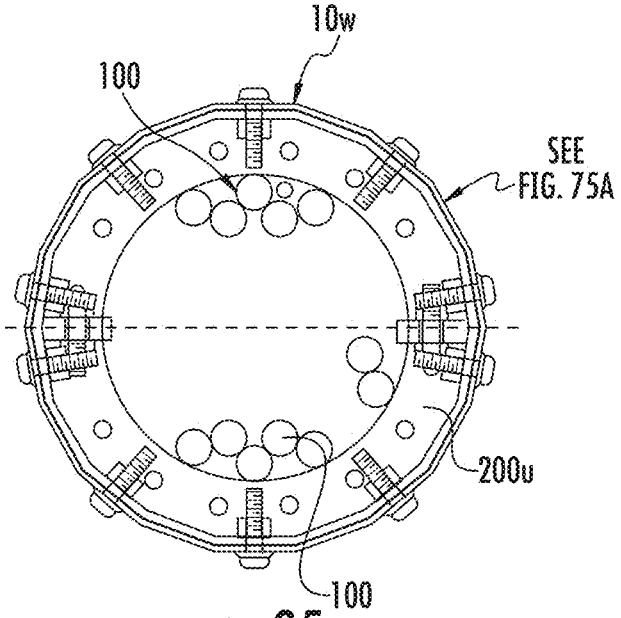
FIG. 35 is a section view taken along lines 35-35 in FIG. 33.
Figure 36:
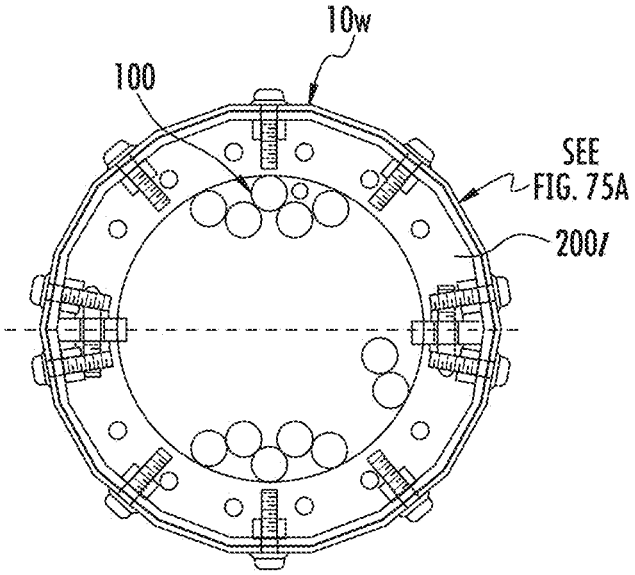
FIG. 36 is a section view taken long lines 36-36 in FIG. 34.
Figure 37:
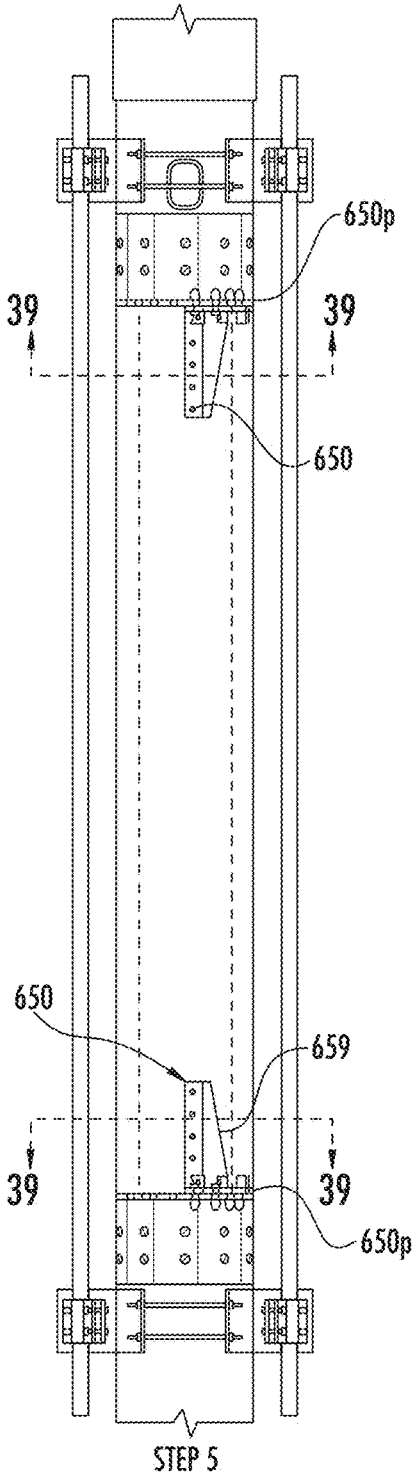
FIG. 37 is a partial front view of the tower and brace shown in FIG. 34 with outer vertical stiffeners attached according to embodiments of the present invention.
Figure 38:
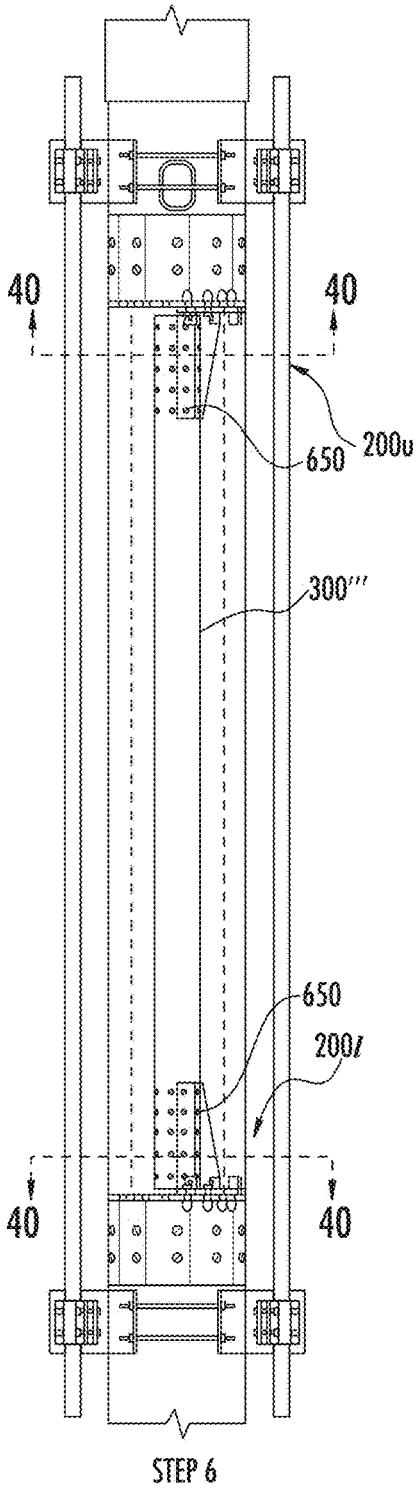
FIG. 38 is a partial front view of the tower and brace shown in FIG. 37 with the vertical member being installed according to embodiments of the present invention.
Figure 39:
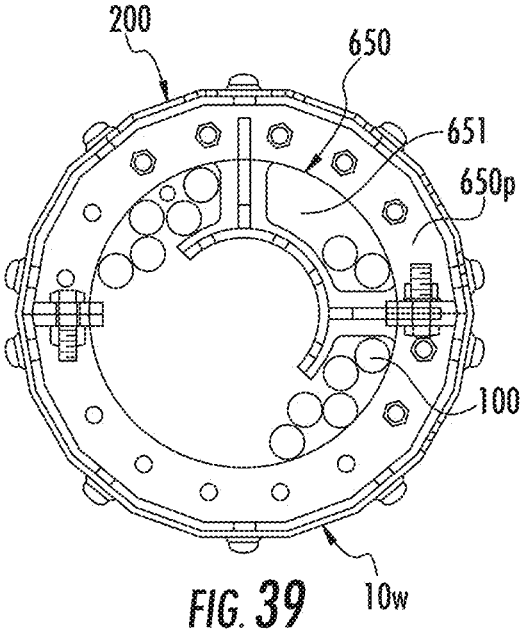
FIG. 39 is a section view taken along lines 39-39 in FIG. 37.
Figure 40:
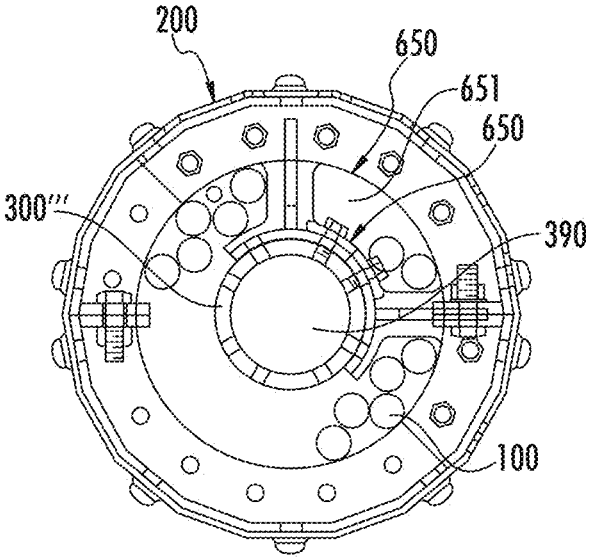
FIG. 40 is a section view taken along lines 40-40 in FIG. 38.
Figure 41:
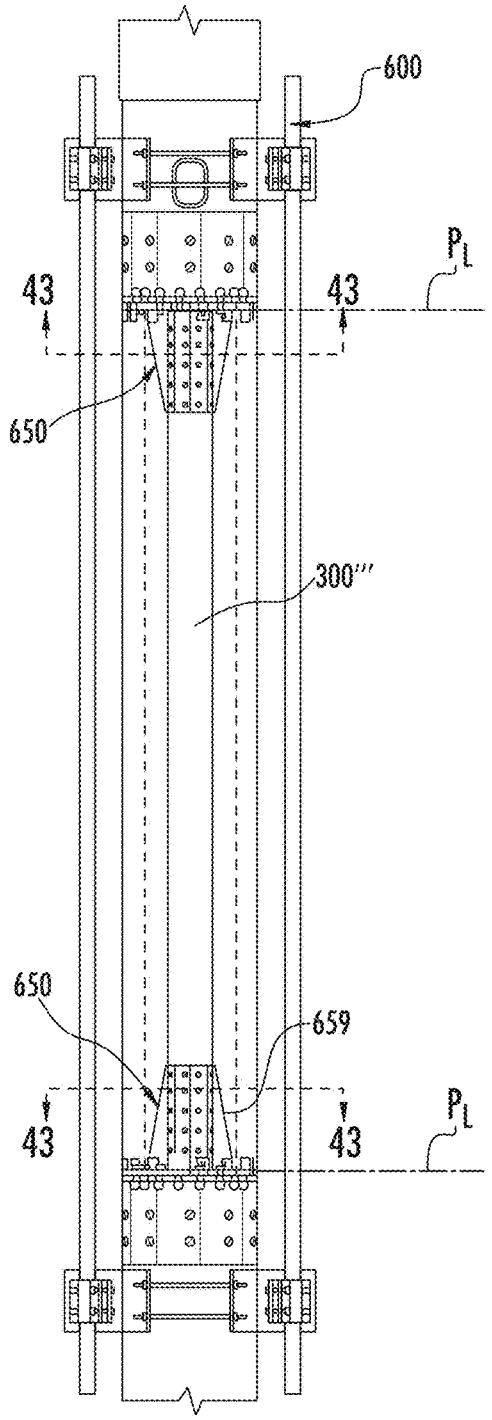
FIG. 41 is a partial front view of the tower and brace shown in FIG. 38 with the outer vertical sleeve support assembly installed according to embodiments of the present invention.
Figure 42:
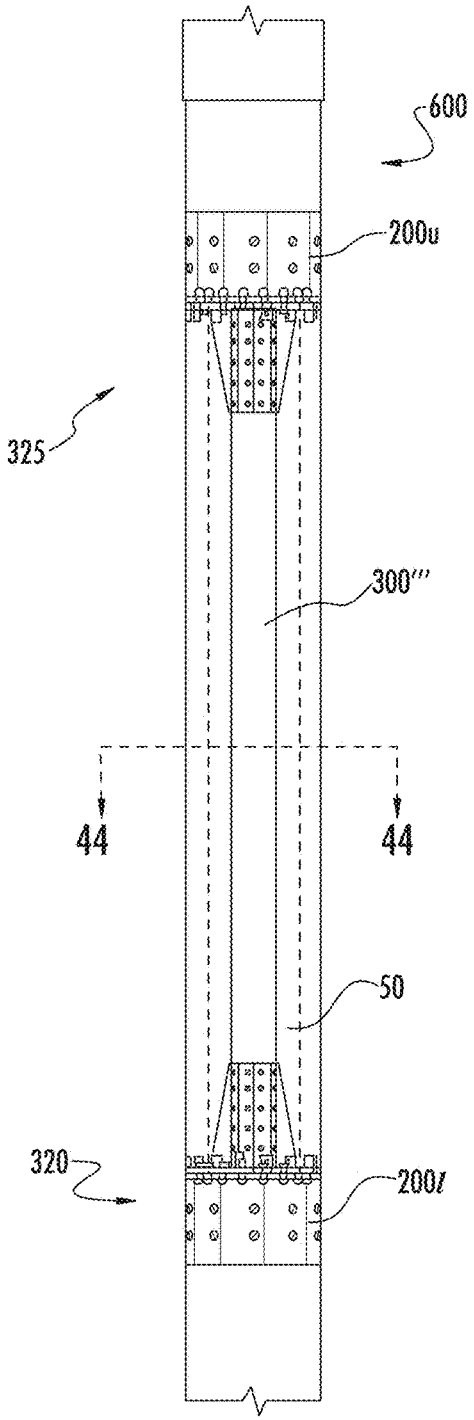
FIG. 42 a partial front view of the tower shown in FIG. 41 with the temporary support brace removed according to embodiments of the present invention.
Figure 43:
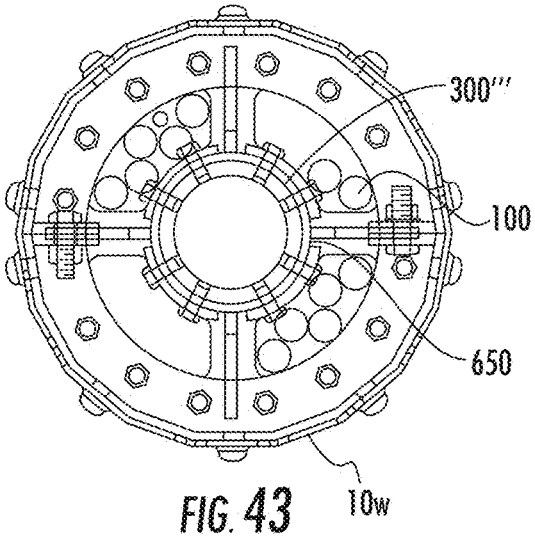
FIG. 43 is a section view taken along lines 43-43 in FIG. 41.
Figure 44:
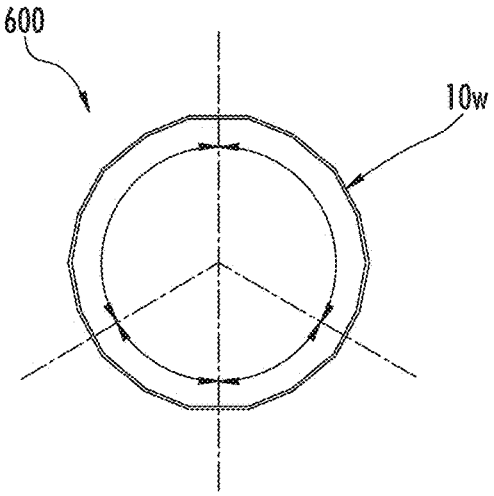
FIG. 44 is a section view taken along lines 44-44 in FIG. 42.
Figure 45:
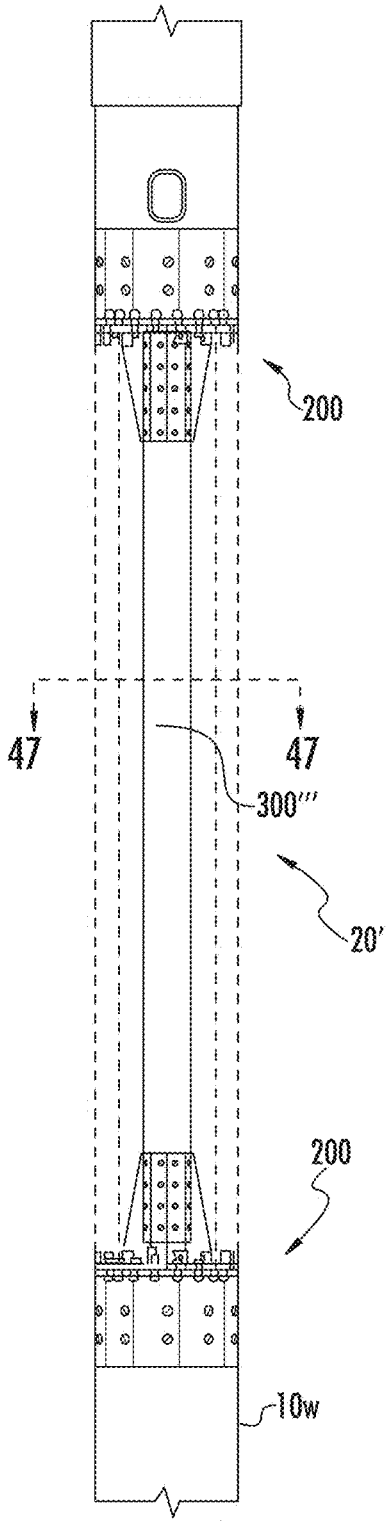
FIG. 45 is a partial front view of the tower shown in FIG. 44 with the final demolition of existing tower wall removed about the vertical member according to embodiments of the present invention.
Figure 46:
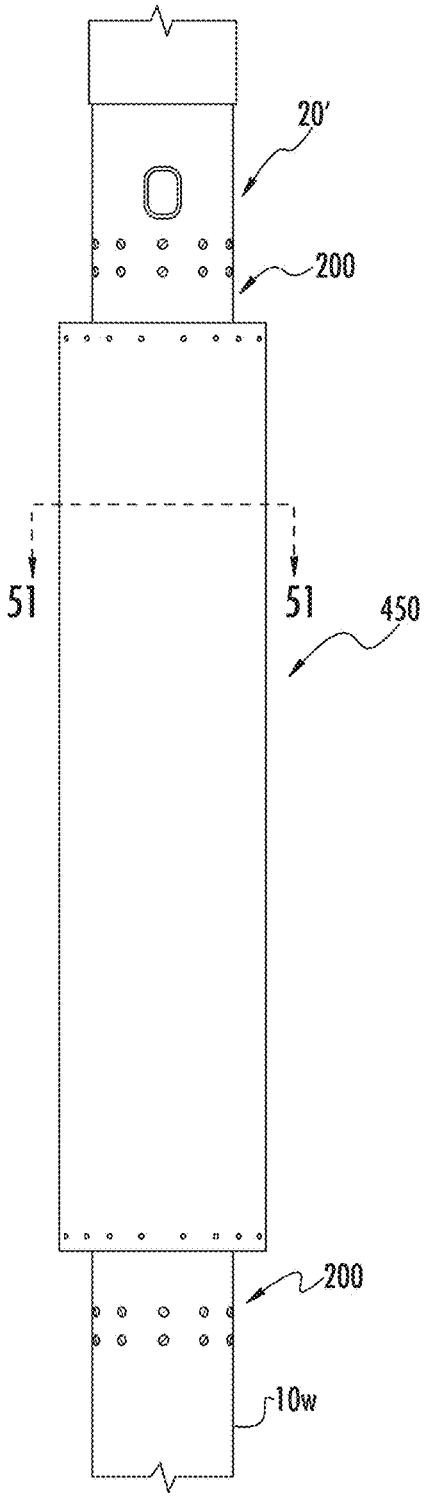
FIG. 46 is a partial front view of the tower shown in FIG. 45 with a canister cover installed about the vertical member according to embodiments of the present invention.
Figure 47:
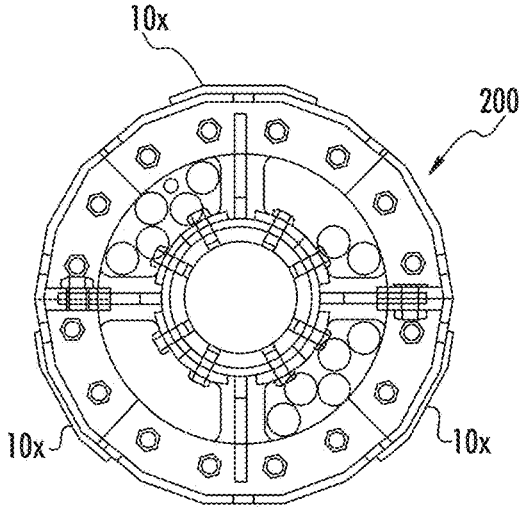
FIG. 47 is a section view taken along lines 47-47 in FIG. 45.
Figure 48:
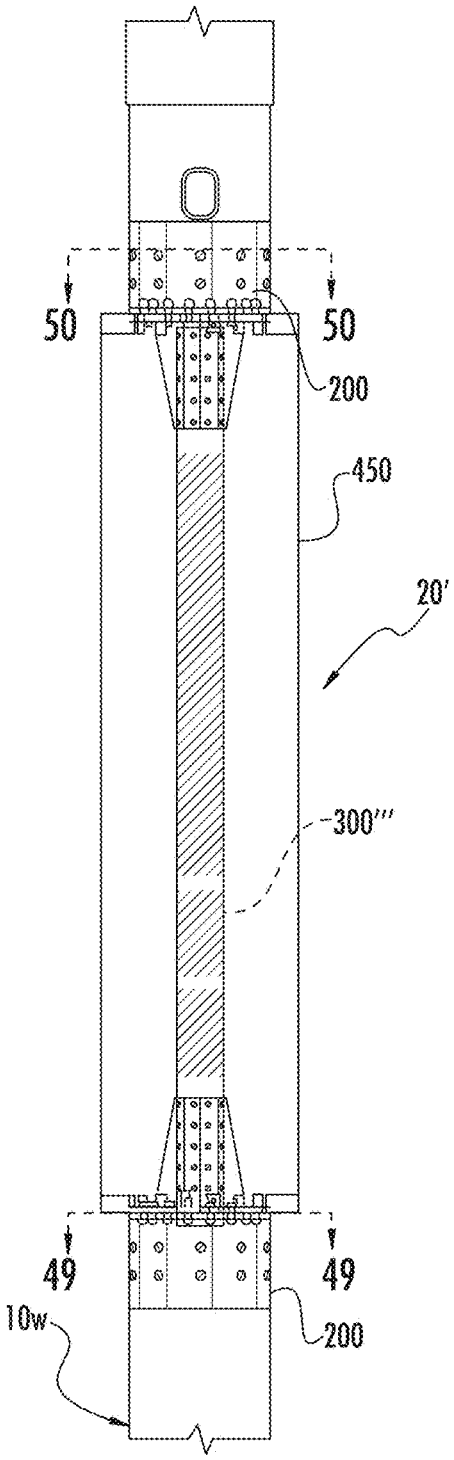
FIG. 48 is a partial elevation view of the tower shown in FIG. 46 with an exemplary antenna layout according to embodiments of the present invention.
Figure 52:
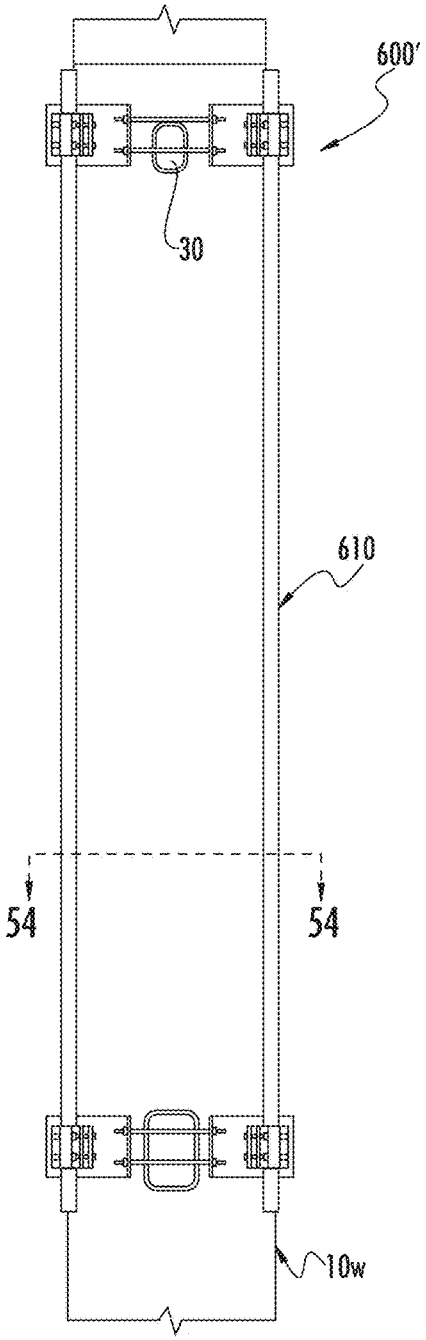
FIG. 52 is a partial front view of a concealed antenna tower with a temporary brace according to yet other embodiments of the present invention.
Figure 53:
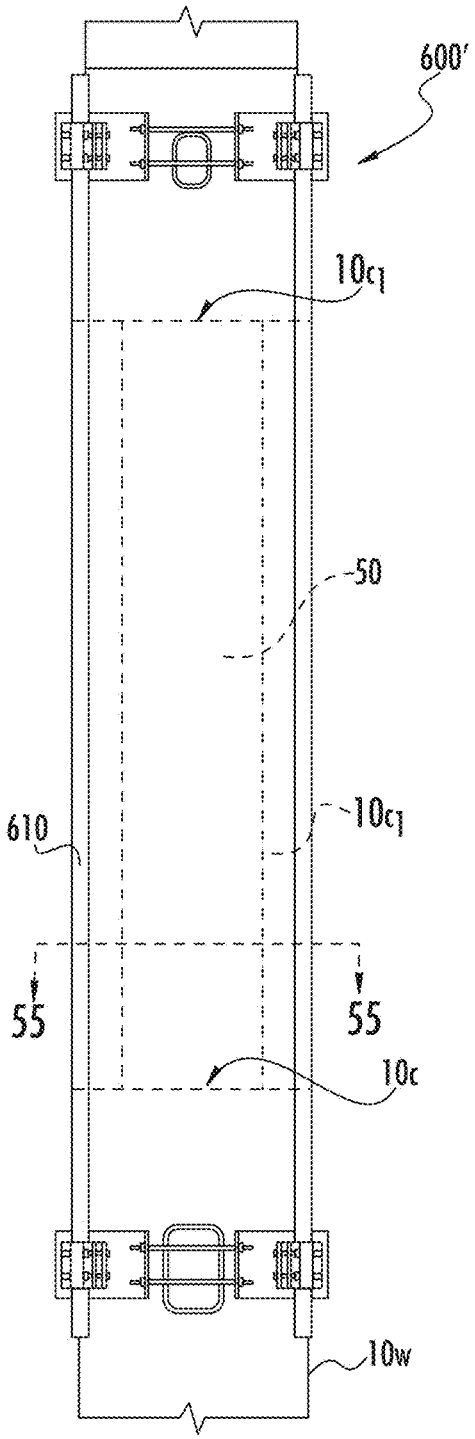
FIG. 53 is a partial front view of the tower and brace shown in FIG. 52 with a partial demolition as indicated by the broken lines according to embodiments of the present invention.
Figure 54:
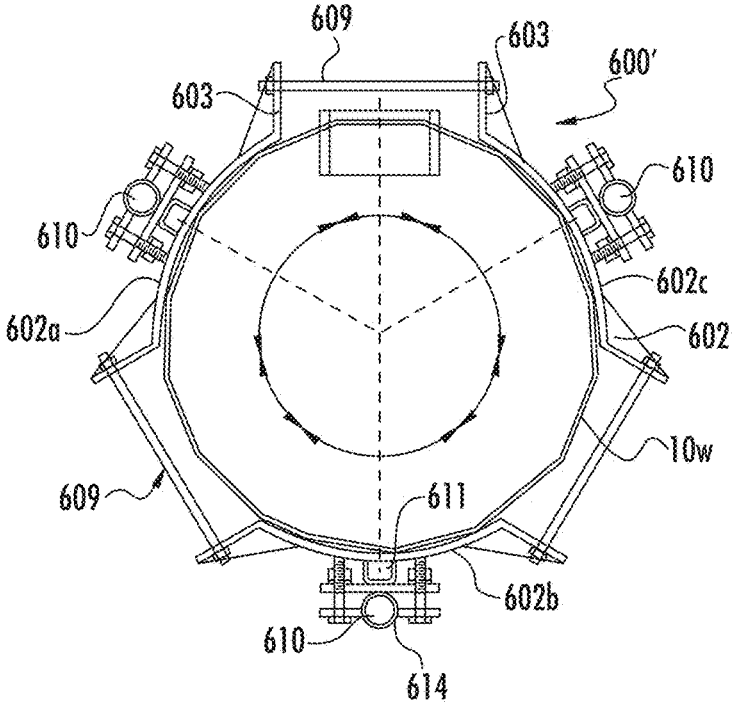
FIG. 54 is a section view thereof taken along lines 54-54 in FIG. 52.
Figure 55:
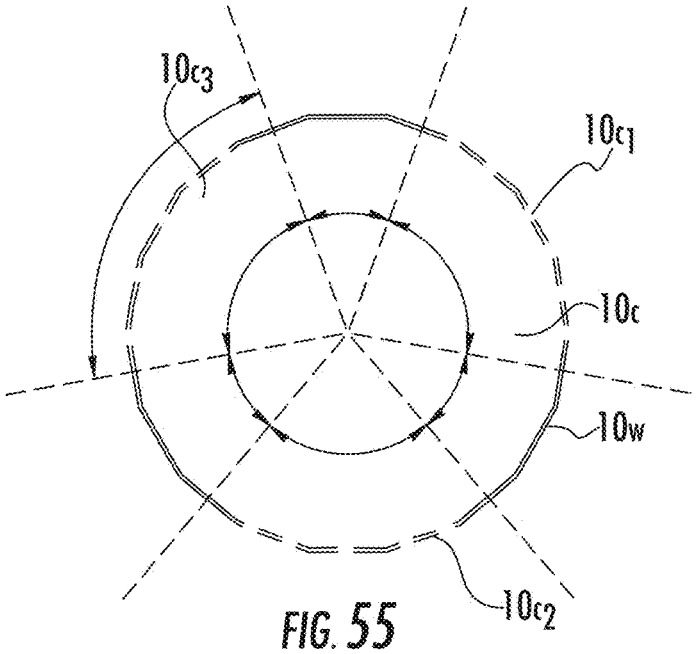
FIG. 55 is a section view taken along lines 55-55 in FIG. 53.
Figure 56:
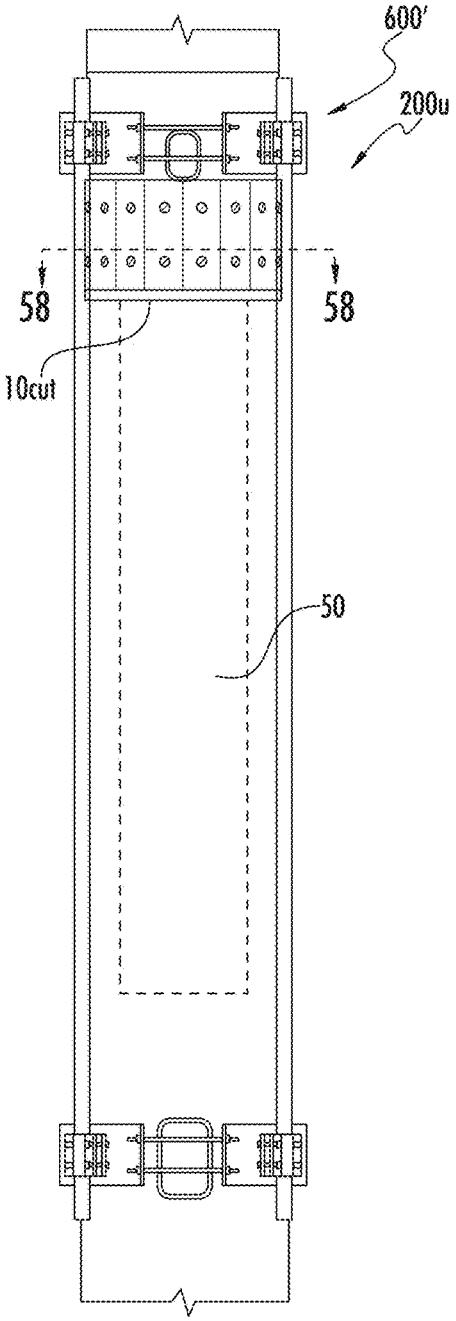
FIG. 56 is a partial front view of the tower and brace shown in FIG. 53 with a top bracket assembly attached according to embodiments of the present invention.
Figure 57:
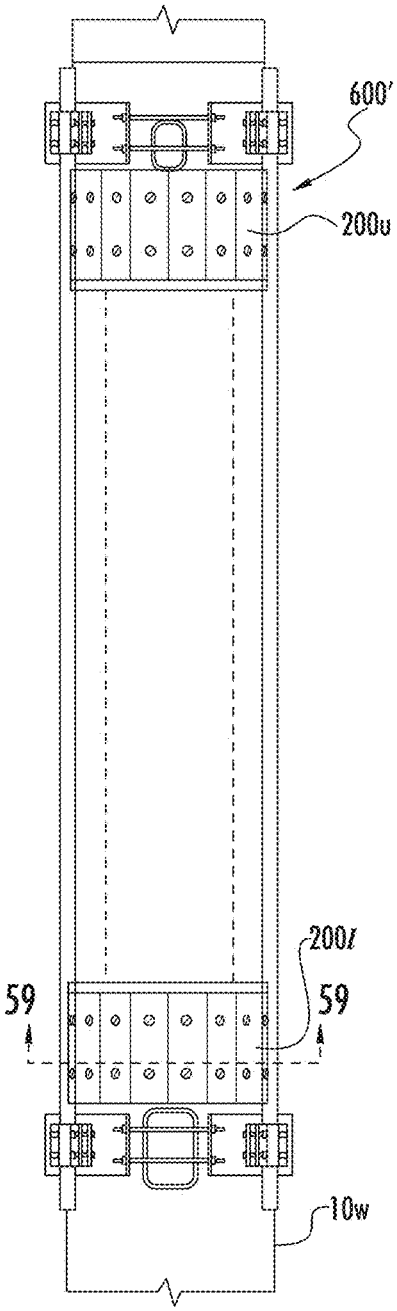
FIG. 57 is a partial front view of the tower and brace shown in FIG. 56 with a bottom bracket assembly attached according to embodiments of the present invention.
Figure 58:
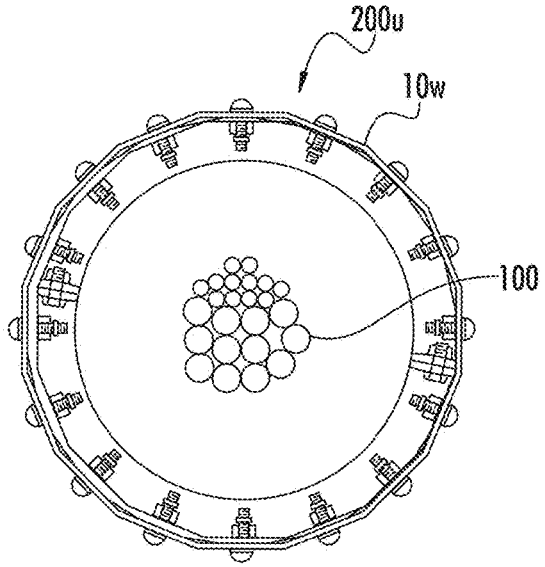
FIG. 58 is a section view taken along lines 58-58 in FIG. 56.
Figure 59:
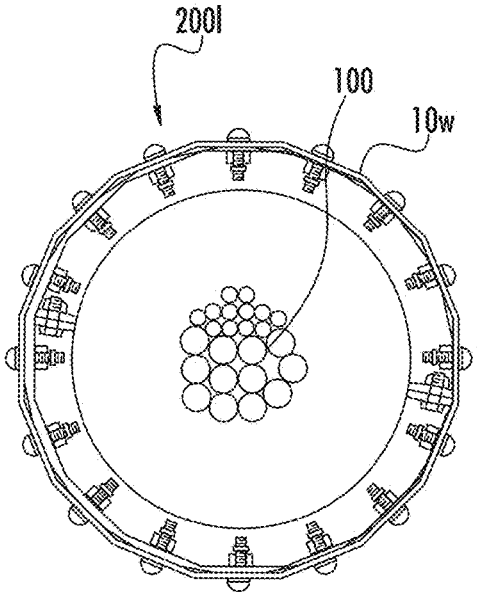
FIG. 59 is a section view taken along lines 59-59 in FIG. 57.
Figure 60:
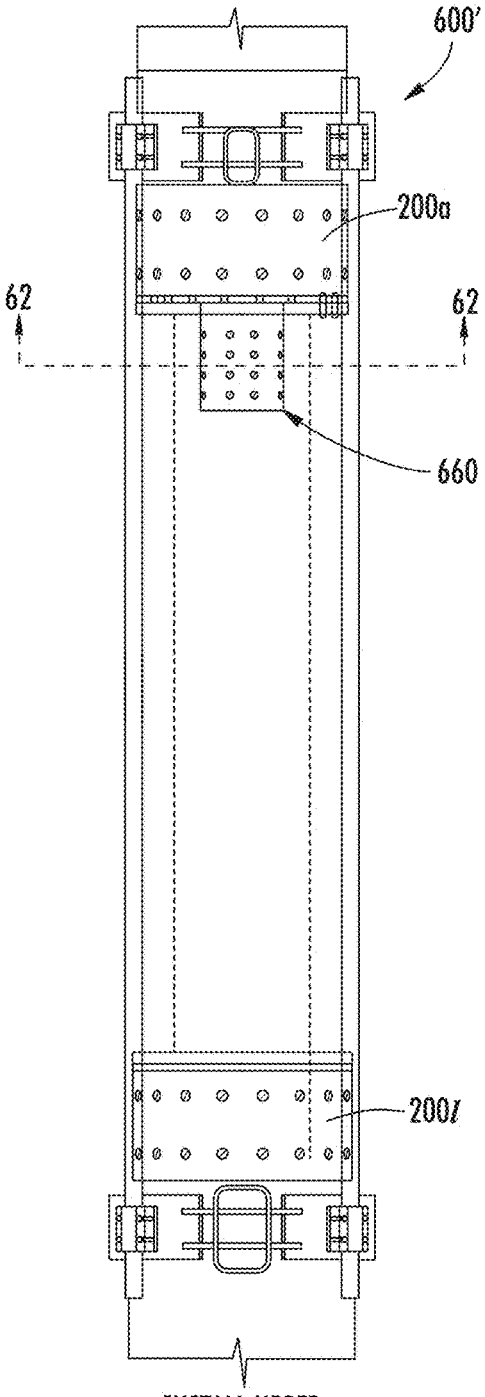
FIG. 60 is a partial front view of the tower and brace shown in FIG. 57 with a top inner sleeve attached according to embodiments of the present invention.
Figure 61:
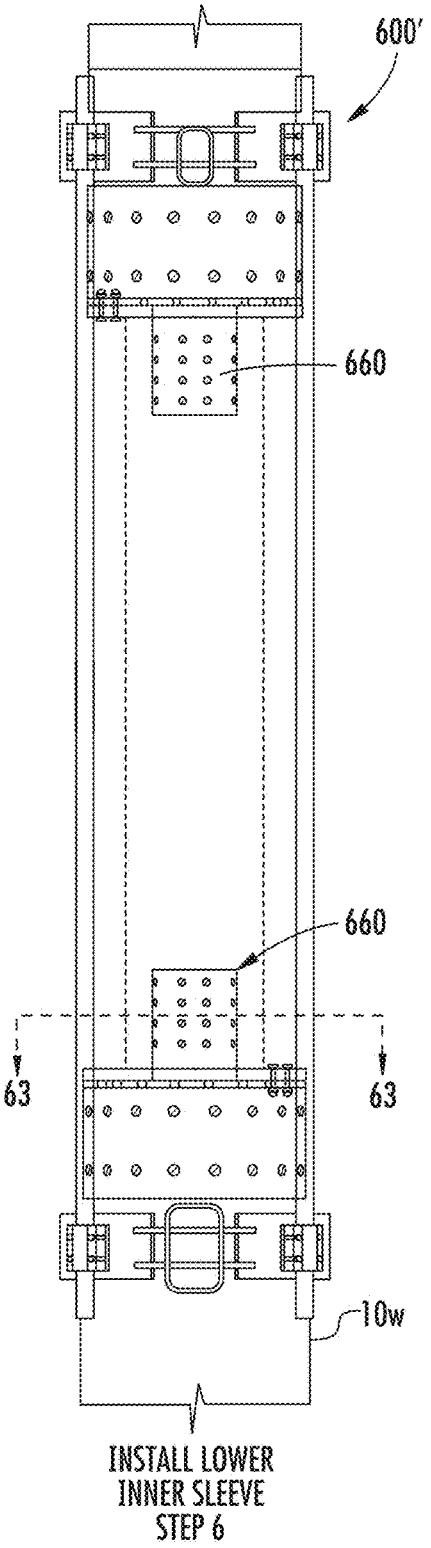
FIG. 61 is a partial front view of the tower and brace shown in FIG. 60 with a bottom inner sleeve attached according to embodiments of the present invention.
Figure 62:
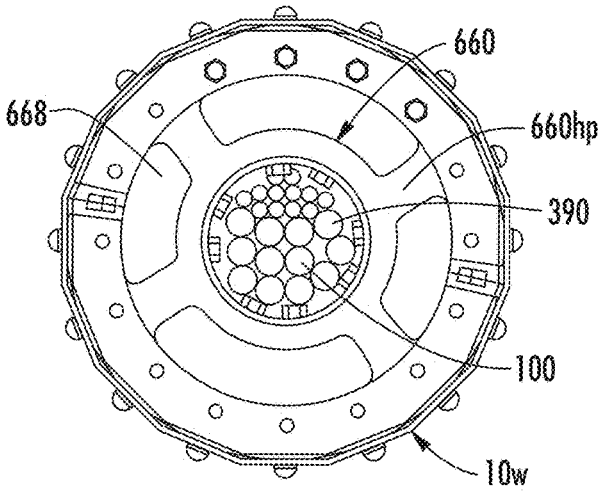
FIG. 62 is a section view taken along lines 62-62 in FIG. 60.
Figure 63:
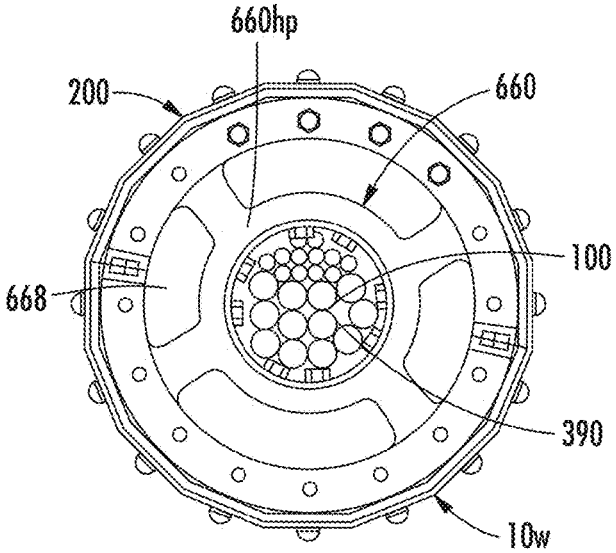
FIG. 63 is a section view taken along lines 63-63 in FIG. 61.
Figure 69:
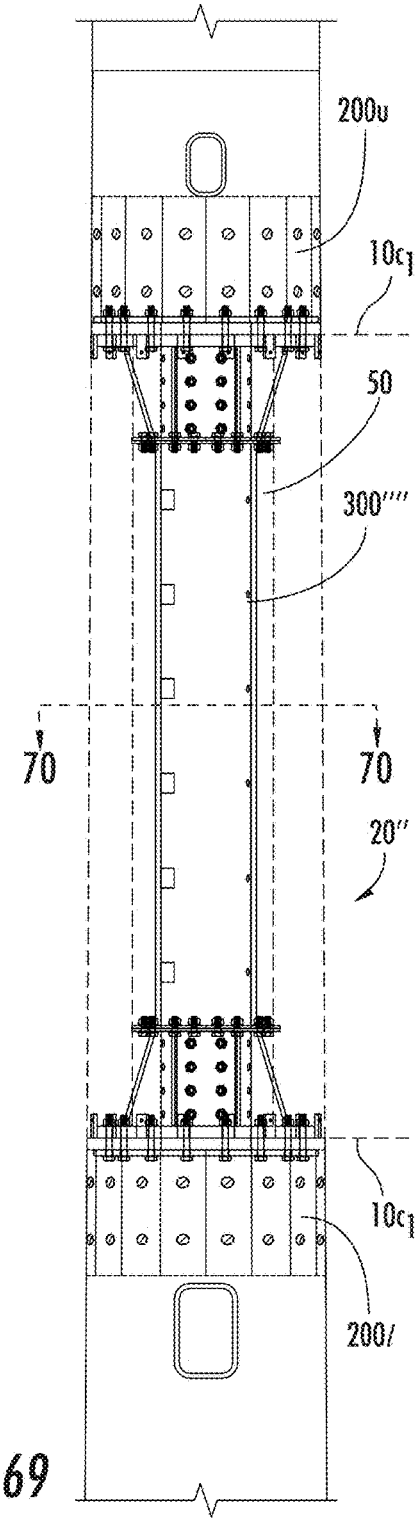
FIG. 69 is a partial front view of the tower shown in FIG. 65 with the final demolition of existing tower wall removed about the vertical member according to embodiments of the present invention.
Figure 70:
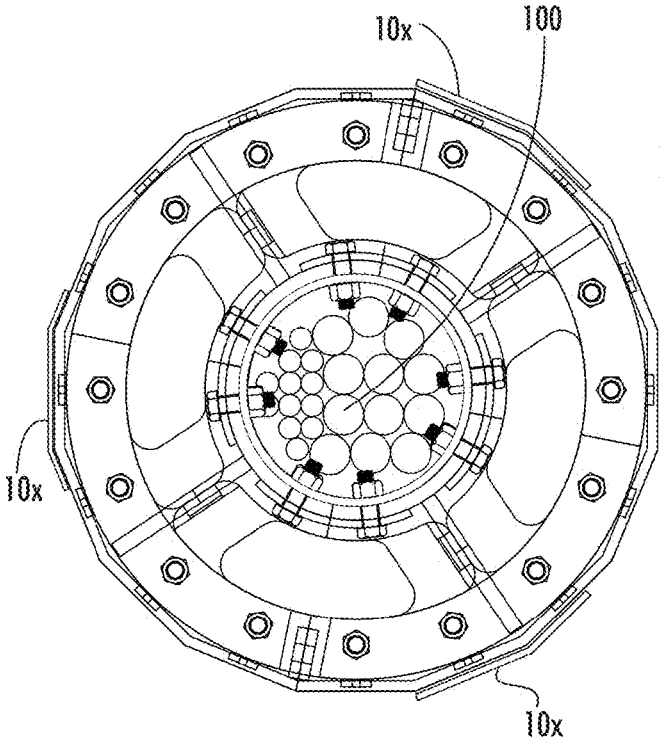
FIG. 70 is a section view taken along lines 70-70 in FIG. 69.
Figure 71:
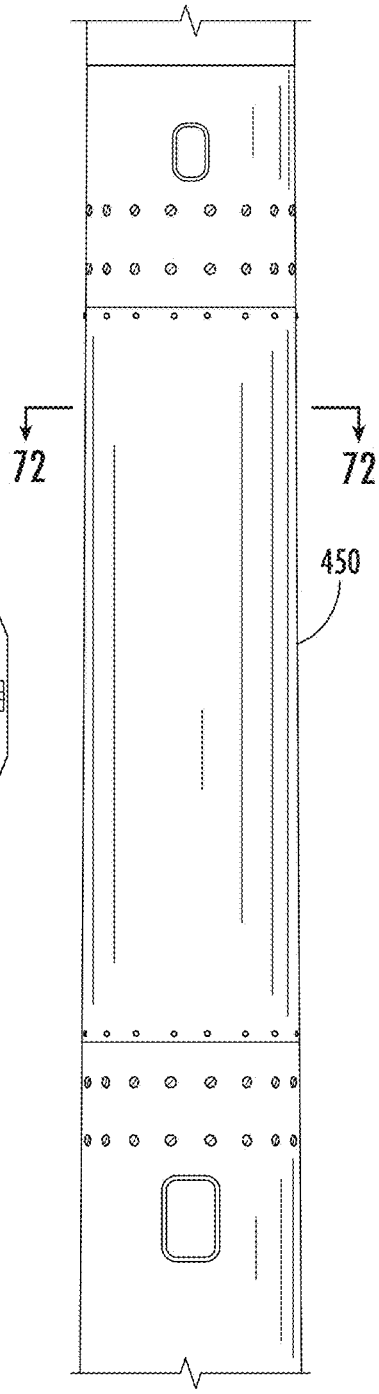
FIG. 71 is a partial front view of the tower shown in FIG. 69 with a canister cover installed about the vertical member according to embodiments of the present invention.
Figure 72:
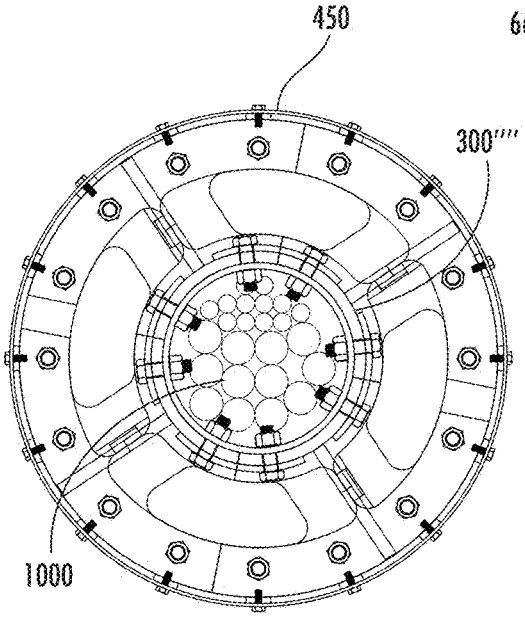
FIG. 72 is a section view taken along lines 72-72 in FIG. 71.
Figure 73:
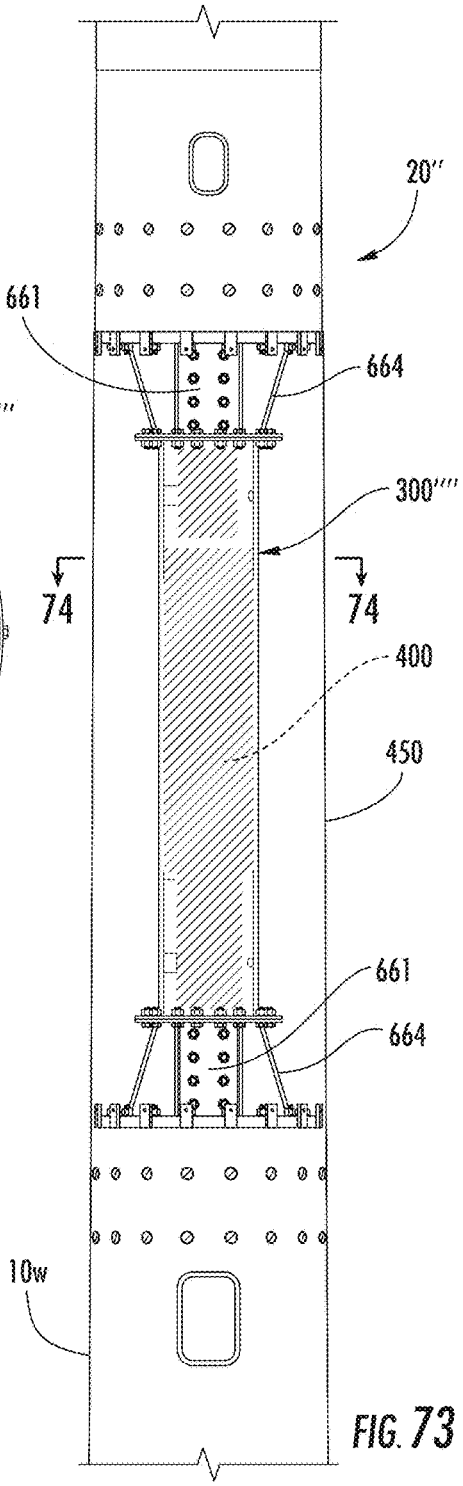
FIG. 73 is a partial elevation view of the tower shown in FIG. 71 with an exemplary antenna layout according to embodiments of the present invention.
Figure 74:
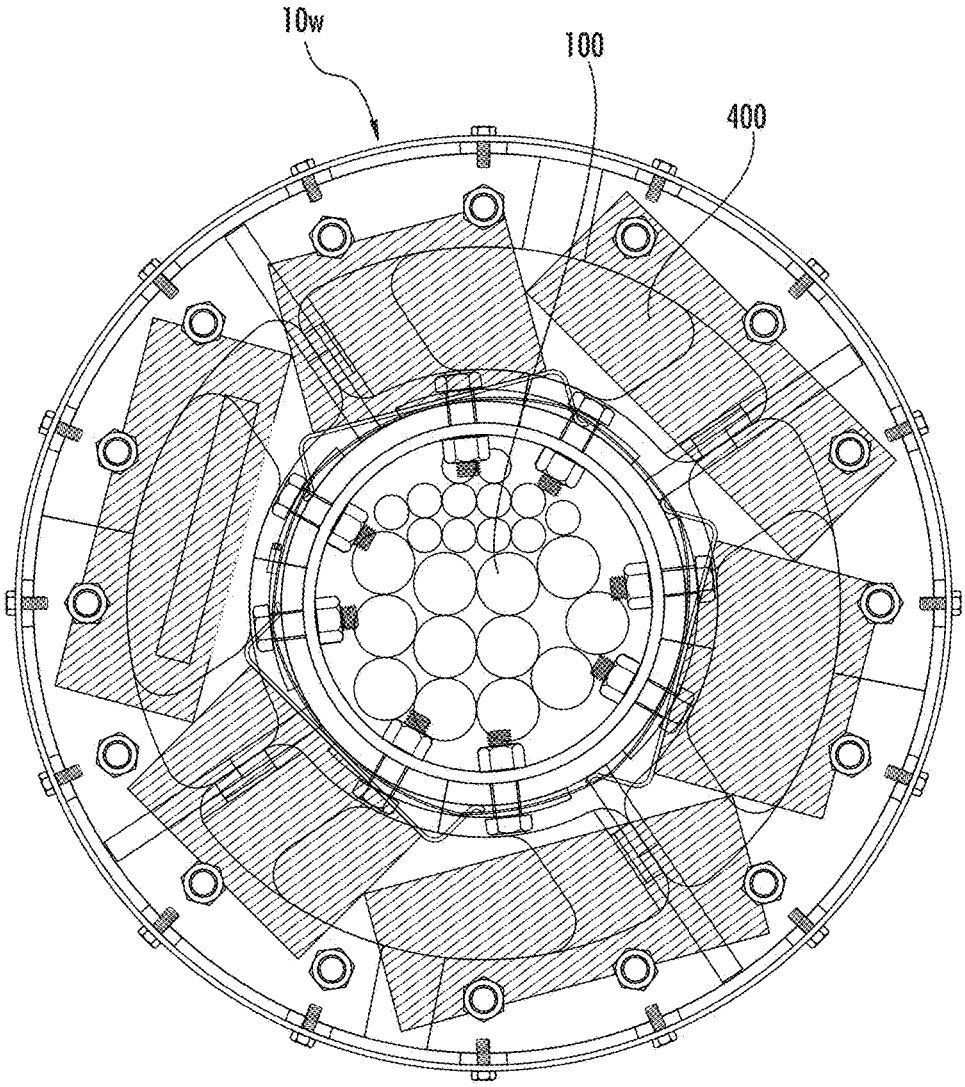
FIG. 74 is a section view taken along lines 74-74 in FIG. 73.

FIGS. 29-51 and 52-74 illustrate additional embodiments of methods, devices and assemblies for modifying erect towers 10 with antenna canisters 20', 20" (FIGS. 45, 69). As shown, for example, in FIGS. 29 and 52, a temporary support assembly 600, 600' can be attached to the tower/pole 10 during a portion of the modification of the tower 10. The support assembly 600, 600' can provide rotational restraint. Additional bracing and support structure can be used with this temporary support assembly 600, 600'. The support assembly 600, 600' may be particularly suitable for heavy duty and medium duty units.

It is noted that although attachment members such as bolts are shown in the figures herein with a head oriented a certain direction, the bolt or attachment member can be oriented to face the other (e.g., outward rather than inward).

Some embodiments may be particularly suitable for light duty applications where there is a light internal cable, feed and/or transmission line congestion. The design for the vertical member 300 can be a relatively a small pipe or solid rod cross-section. The light duty units may be particularly suitable for towers with a single existing spool and/or a top-mounted canister assembly residing above a modified canister 20. The existing cable, feed and/or transmission lines can be located between the gussets on the spool and/or gaps in the bracket assemblies holding the vertical member 300 (FIG. 23).

Some embodiments may be used for medium duty towers. These medium duty configurations may be suitable where there is medium cable, feed and/or transmission line congestion. The vertical member 300''' can employ a pipe cross section. The embodiment shown in FIGS. 29-51 may be particularly suitable for medium duty units. The existing (e.g., feed) lines can be installed in the slotted holes of the bracket assemblies (see, e.g., FIGS. 39, 43, 49). Additional cabling (associated with the added antenna) can be held in the slotted/gaps as well.

Some embodiments may be used for heavy duty towers. The heavy duty configurations may be suitable where there is a heavy cable, feed and/or transmission line congestion. The vertical member 300'''' can employ a pipe design. FIG. 66 shows most, if not all, existing cabling can be held in the center core of the vertical member 300'''' and additional cabling (associated with the newly added antenna') can be added and held in gaps in brackets. The embodiment shown in FIGS. 52-74 may be particularly suitable for heavy duty units. For completeness it is noted that any of the embodiments can be used for particular applications and combinations of features, designs and components discussed or shown with respect to one embodiment may also be used with any other embodiment or design.

It is also noted that although the medium and heavy duty configurations are shown using a temporary support assembly 600, 600', these are merely optional features as it has been found that using a crane attached to an upper portion of the erect concealed antenna pole (with at least one intact relatively small vertical segment of the pole thereunder) can provide sufficient alignment and/or anti-twist support without requiring any such temporary brace or support assembly.

Turning now to FIGS. 29, 30, 52, and 54, the (optional) support assembly 600, 600' (where used) respectively includes at least one long brace 610, shown as three equally spaced apart long braces. However, fewer or more can be used and they need not be equally spaced apart nor of the same length or cross-sectional size. In some embodiments, the long brace 610 has a circular cross-sectional shape (e.g., a solid rod), but other shapes can be used, including, for example polygon shapes. The braces 610 can be releasably held to upper and lower mounting collars 605. The mounting collars 605 can have a multi-piece configuration, shown as having three curved members, 602*a*, 602*b*, 602*c* that mount against an outer wall of the pole shaft 10*w*. The collars 605 can include more or fewer members and/or the upper collar may have a different configuration than the lower collar. As shown, the curved members 602 can attach together via threaded members 609 which may be attached to outwardly projecting arms 603 of the curved members. However, other attachment configurations may be used. At least one of the curved members 602 can snugly hold a long brace 610. The curved member 602 can include a spacer 611 that projects inwardly to contact the wall 10*w* of the pole/tower. The spacer 611 may be aligned with the long brace 610 as shown, or offset (not shown). The long brace 610 may have a flat perimeter region that can be oriented (rotated) at assembly in the field to matably engage a correspondingly shaped portion of the respective holder 614.

As discussed previously, a hand hole (or tool entry) rim 30 can be formed into the pole/tower 10 at a location that is suitable. The temporary support 600, 600' can be placed on the tower 10 prior to cutting the wall 10*w* to form the window 50 or windows 50. FIGS. 29-46 and 52-71 illustrate an exemplary series of steps (shown as Steps 1-10) that can be used to modify the erect tower 10. Some of the steps may be carried out in different orders or combined and carried out together. Some steps may be omitted altogether. Generally stated, the methods can be carried out as described below.

Optional Step 1 Place the temporary support assembly 600, 600' on the erect tower 10. (Alternative step for medium and/or heavy duty towers is to use a crane (e.g., FIG. 20D) to provide anti-twist and alignment as needed leaving a small vertical segment in place until a spine is installed). Other embodiments require neither a brace nor a crane to form the openings and/or install the vertical member.

Step 2 Perform a partial demolition (to insert the cut lines 10$c_1$ and form a window 50).

Step 3 Install the top bracket assembly 200*u* to the tower.

Step 4 Install the bottom bracket assembly 200*l* to the tower.

The upper bracket assembly 200*u* can be attached to the tower wall so that the lower portion is substantially flush with the upper substantially horizontal cut line $P_1$ (FIG. 41) of the window 50. Similarly, the lower bracket assembly 200*l* can be attached to the tower wall to be substantially flush with the lower substantially horizontal cut line $P_1$ (FIG. 41) of the window 50.

Steps 5-7 Install a downwardly/upwardly extending bracket for the vertical member 300''', 300''' and attach the vertical member 300''', 300''''.

Figure 76A:
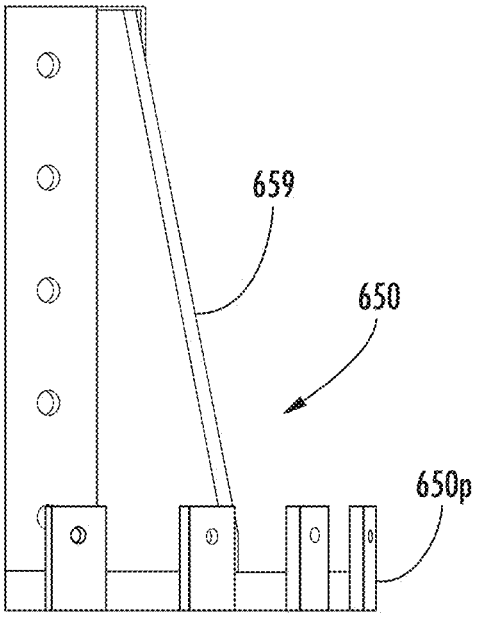
FIG. 76A is a front view of an outer support assembly according to embodiments of the present invention.
Figure 76B:
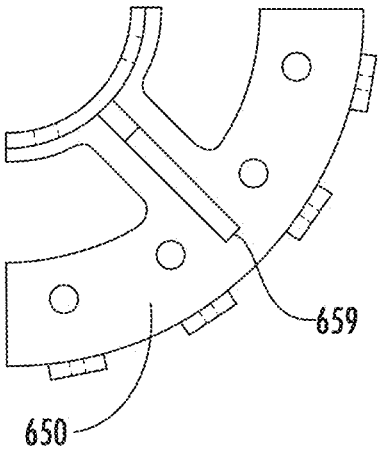
FIG. 76B is a top view of the outer support assembly shown in FIG. 76A.
Figure 76C:
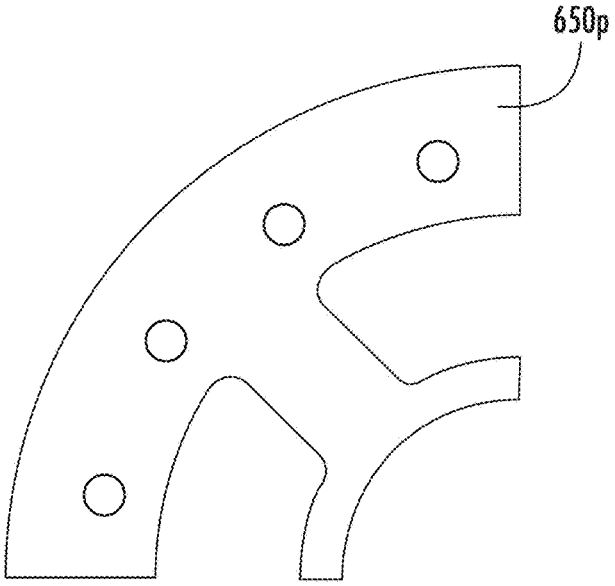
FIG. 76C is a top view of a plate of the support assembly shown in FIGS. 76A and 76B.
Figure 76D:
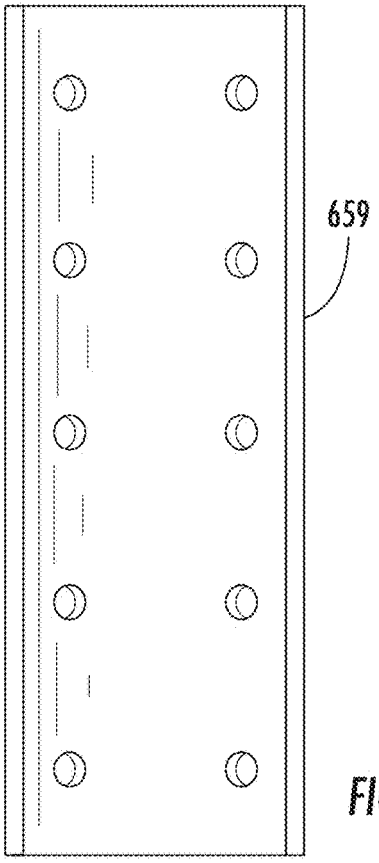
FIG. 76D is a front view of a curved vertical plate shown in FIGS. 76A and 76B.
Figure 76E:
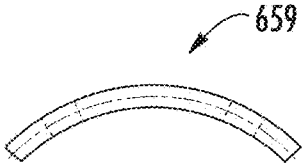
FIG. 76E is a top view of the curved plate shown in FIG. 76D.
Figure 77A:
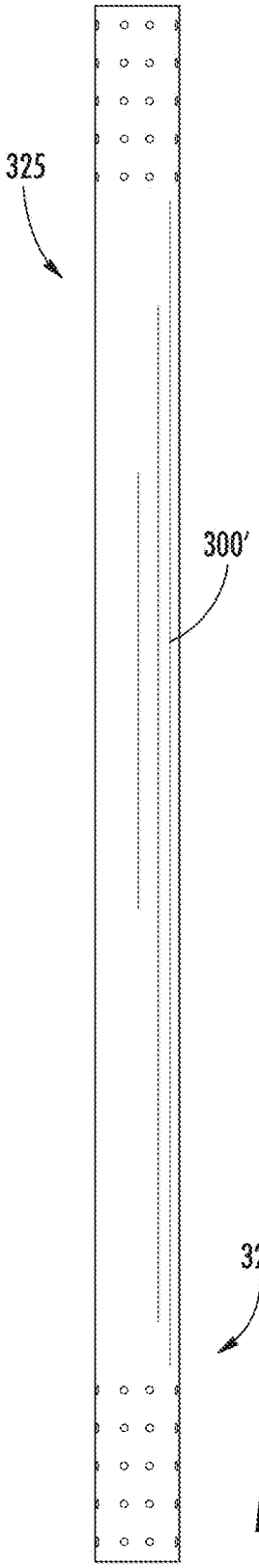
FIG. 77A is a front view of a vertical member according to embodiments of the present invention.
Figure 77B:
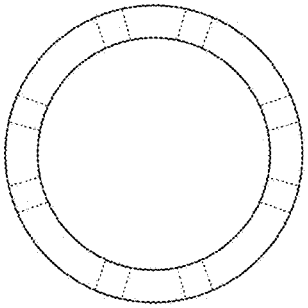
FIG. 77B is a top view of the vertical member shown in FIG. 77A.
Figure 78A:
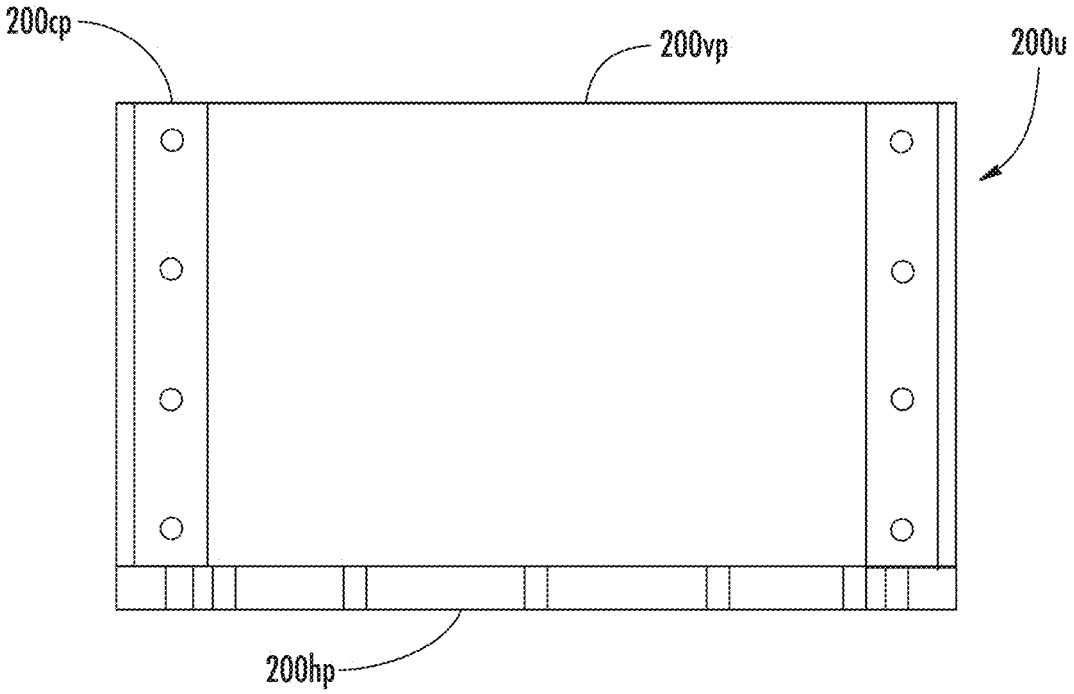
FIGS. 78A and 79A are front views of top and bottom bracket assemblies, respectively, similar to the bracket assembly illustrated in FIG. 75A but with different bolt patterns and/or spacings and size.
Figure 78B:
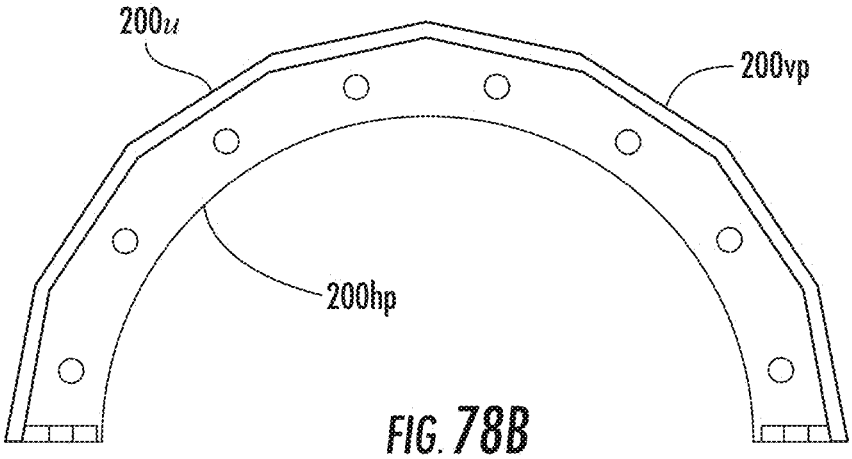
FIGS. 78B and 79B are top views of the respective bracket assemblies shown in FIGS. 78A and 79A.
Figure 78C:
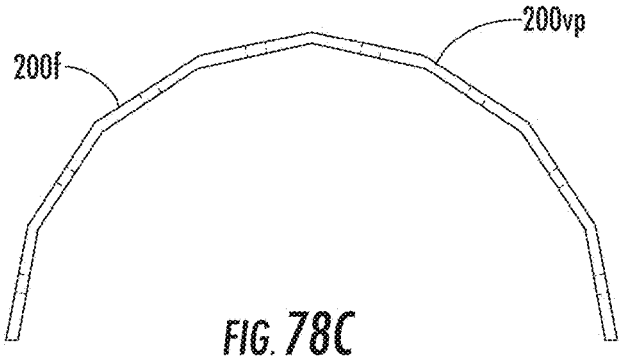
FIGS. 78C and 79C are top views of the curved vertical members shown in FIGS. 78A and 78B and 79A and 79B, respectively.
Figure 78D:
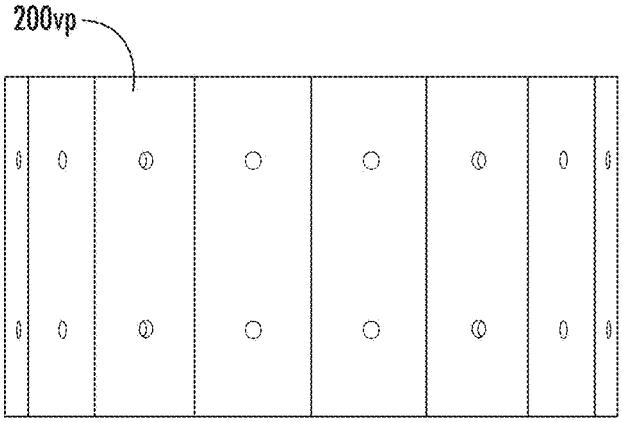
FIGS. 78D and 79D are front views of the members shown in FIGS. 78C and 79C, respectively.
Figure 78E:
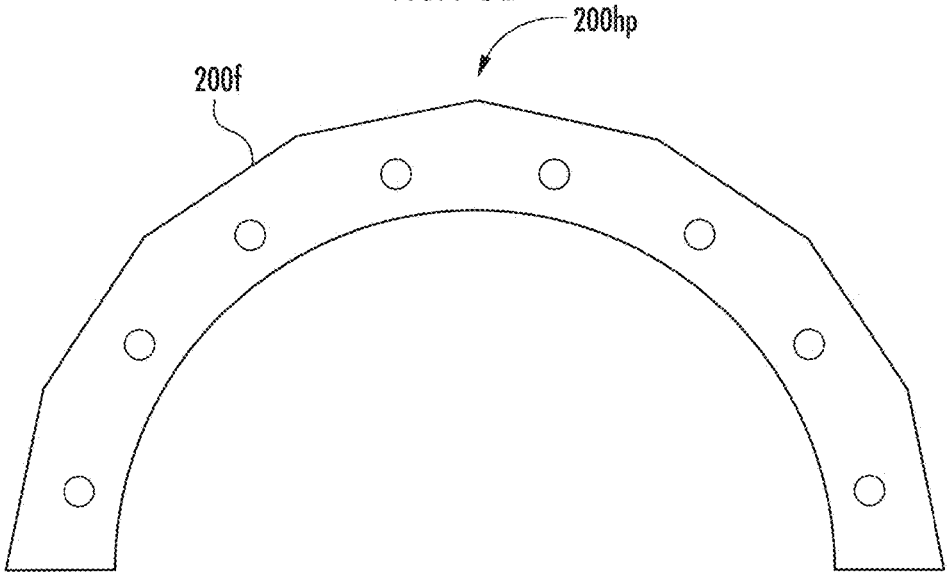
FIGS. 78E and 79E are top views of the horizontal plates shown in the assembly of FIGS. 78A and 79A, respectively.
Figure 79A:
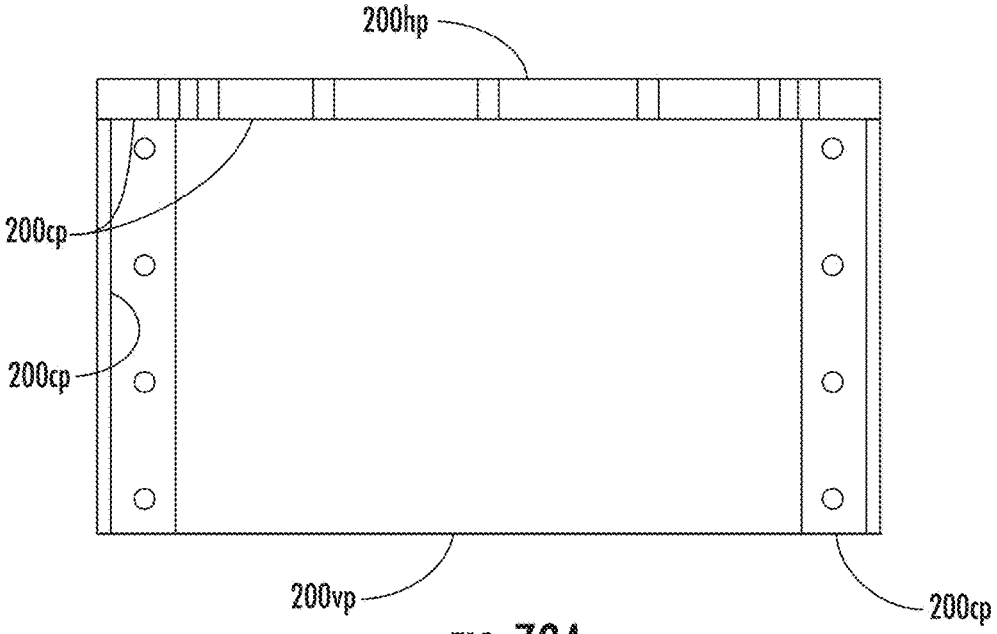
Figure 79B:
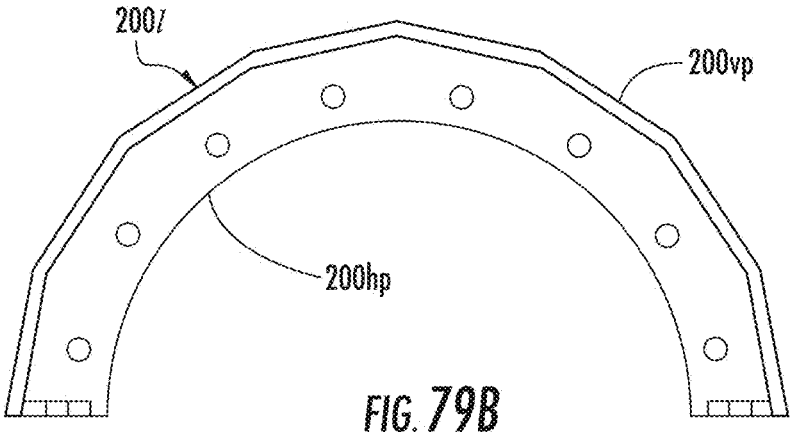
Figure 79C:
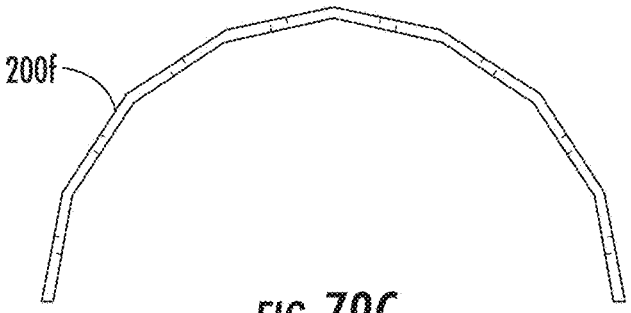
Figure 79D:
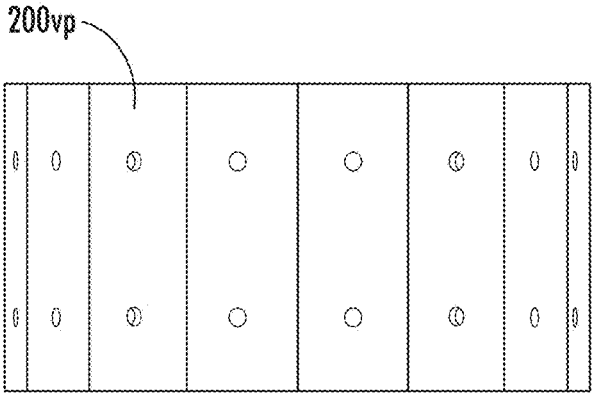
Figure 79E:
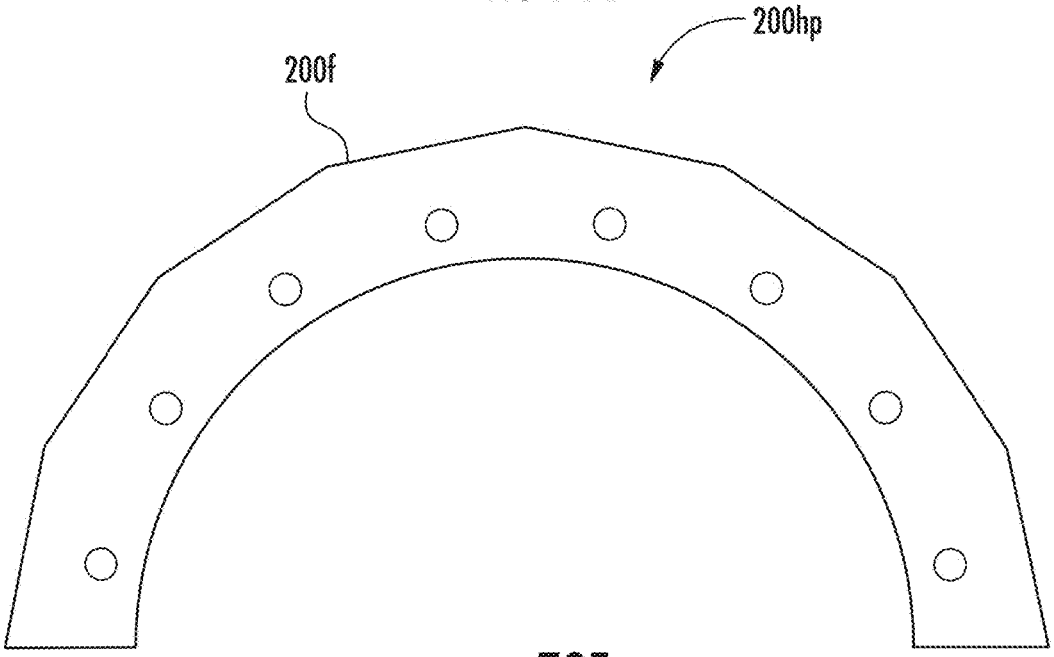

FIGS. 37-43 show vertically extending outer brackets 650 that extend from the respective bracket assemblies 200 and attach to an outer surface of the vertical member 300''' (also shown in FIG. 77A) to define slots 651 for cables 100. The vertical member 300''' can be a multi-piece member or a unitary (one piece) member (the latter as shown in FIGS. 77A, 77B). The inner cavity 390 of the member 300''' is not required to hold cables 100. The brackets 650 can be provided in a plurality of subassemblies (FIGS. 76A, 76B) and include upwardly/downwardly extending curved (inwardly) members 659 (FIGS. 76D, 76E) that attach to an outer wall of the vertical member 300''' and a horizontal plate 650*p* (FIG. 76C). Typically, the plate 650 is in a plurality of attachable pieces, e.g., four as shown, but fewer or more pieces can be used.

Figure 64:
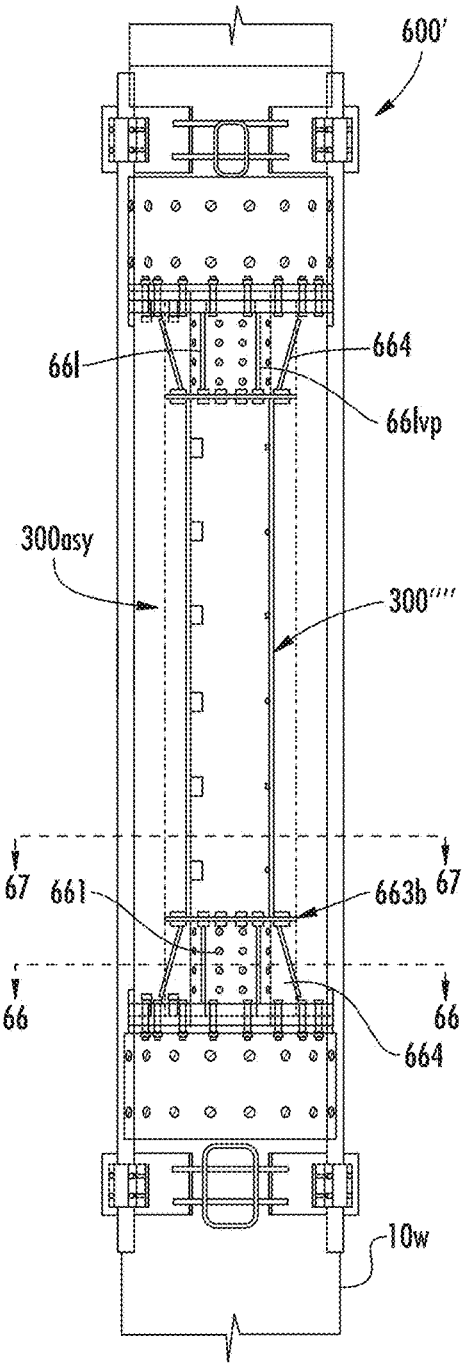
FIG. 64 illustrates a vertical member assembly attached to the inner sleeves shown in FIG. 61 according to embodiments of the present invention.
Figure 65:
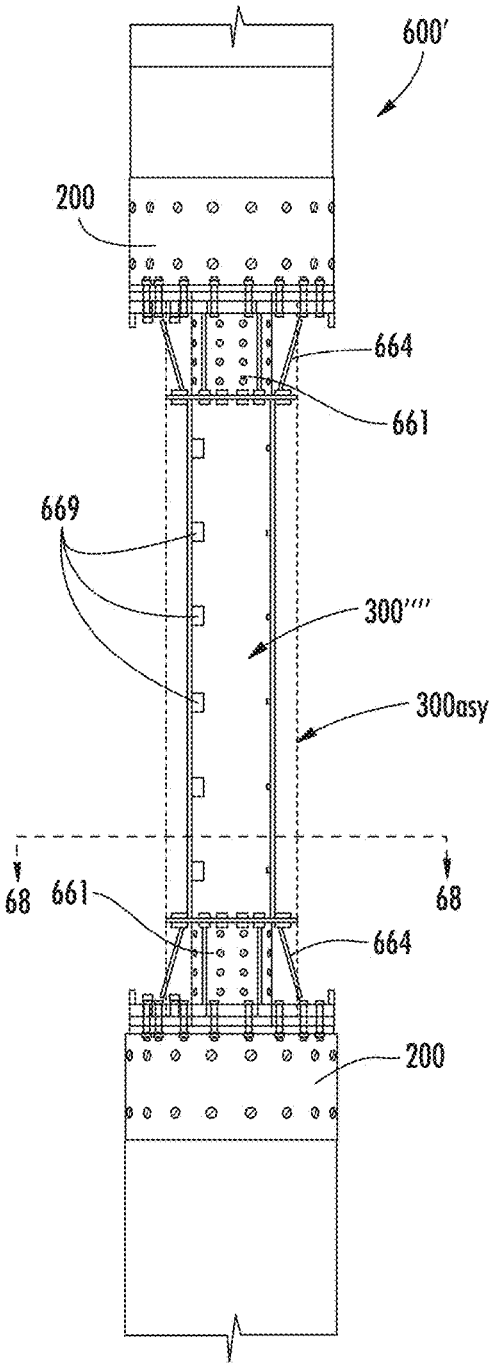
FIG. 65 is a partial front view of the tower shown in FIG. 64 with the temporary brace removed according to embodiments of the present invention.
Figure 66:
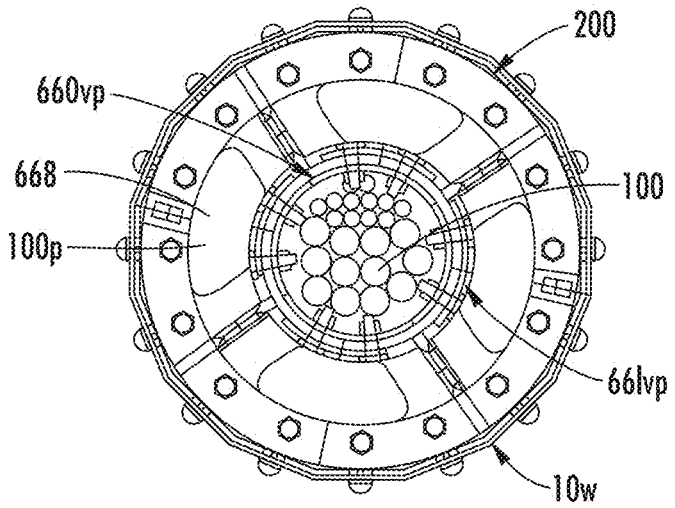
FIG. 66 is a section view taken along lines 66-66 in FIG. 64.
Figure 67:
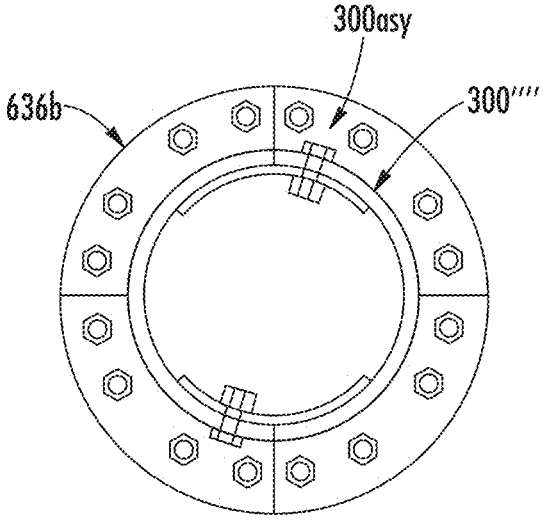
FIG. 67 is a section view taken along lines 67-67 in FIG. 64.
Figure 68:
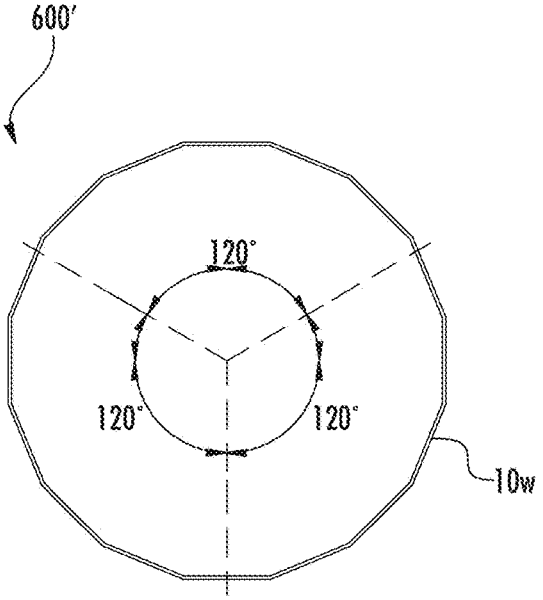
FIG. 68 is a section view taken along lines 68-68 in FIG. 65.

FIGS. 60-67 show vertically extending sleeves 660 that are arcuate and attach together. The sleeves 660 can form a tubular structure that resides between the vertical member 300'''' (which can be a multi-piece, typically a two piece member) and a respective bracket assembly 200. The sleeves 660 can form "through slots" 668 for additional cable while the center of the vertical member 390 houses some or all the existing cable 100. The sleeves 660 can include curved inner vertical plates 660*vp* that attach to the tower wall 10*w* via another bracket assembly 300*asy* as shown in FIGS. 64 and 65 (see also discussion below) and can be provided in pairs of matable curved plates as two attachable components that form the cavity 390. The sleeves 660 can cooperate with stiffener arms 664 that extend from an upper portion of a respective sleeve to a lower portion thereof.

Step 8 Remove the temporary support assembly (if used).

Step 9 Finish the demolition (final cutting of the tower wall around the vertical member 300''', 300'''').

Step 10 Install canister cover (FIGS. 46, 51 and 71, 72) to the tower about the vertical member 300''', 300''''.

Figure 49:
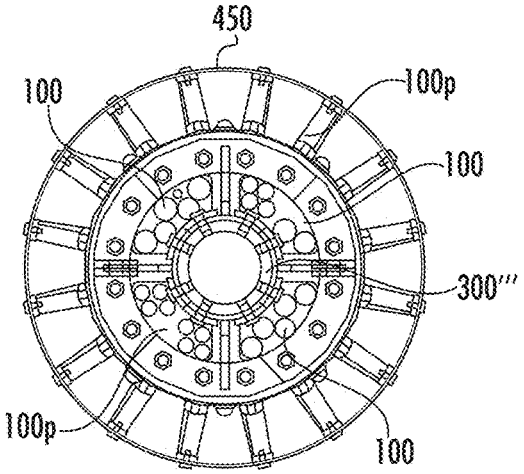
FIG. 49 is a section view taken along lines 49-49 of FIG. 48 illustrating an exemplary coaxial layout according to embodiments of the present invention.
Figure 50:
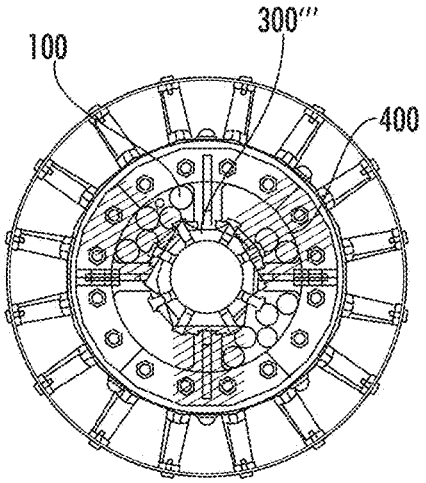
FIG. 50 is a section view taken along lines 50-50 of FIG. 48 illustrating an exemplary antenna layout plan according to embodiments of the present invention.
Figure 51:
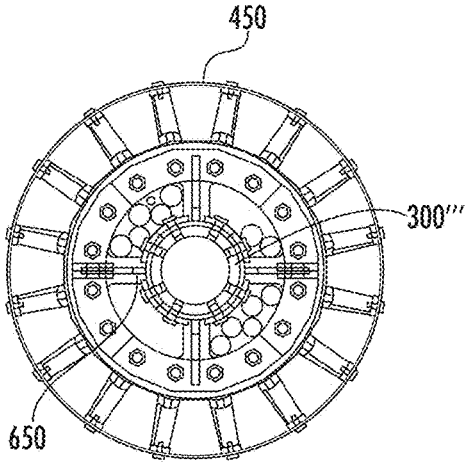
FIG. 51 is a section view taken along lines 51-51 of FIG. 46.

FIGS. 48-50, 73 and 74 illustrate examples of antenna layouts. The antenna 400 is typically assembled by others after the modification to the tower 10. In addition, the canister cover installation may be carried out after an antenna is mounted to the vertical member 300''', 300'''' to form the new canister 20' or may be carried out to attach to the vertical member/tower without an antenna as a "blank" for future upgrade/addition of an antenna. FIG. 49 illustrates an example of a coaxial cable arrangement with existing cables 100 and new (proposed) cables 100*p*. However, other arrangements may also be used.

Figure 75A:
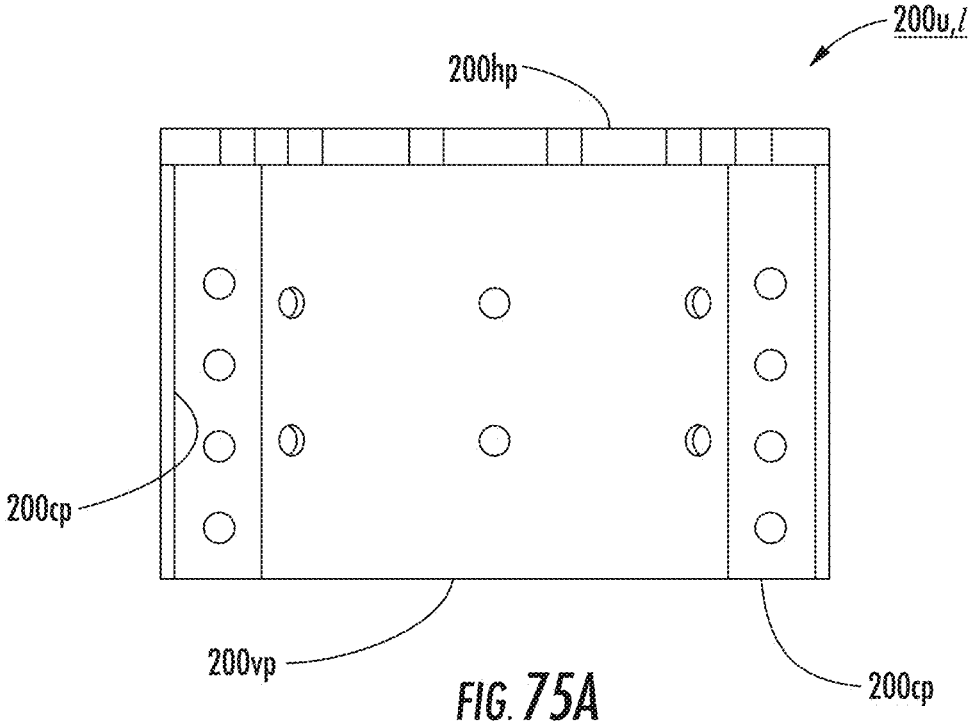
FIG. 75A is a front view of an exemplary bracket assembly according to embodiments of the present invention.
Figure 75B:
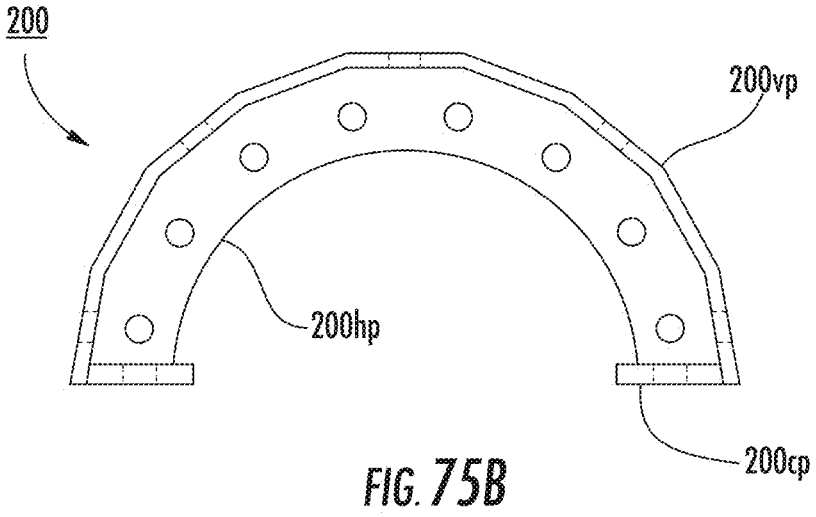
FIG. 75B is a top view of the bracket assembly shown in FIG. 75A.
Figure 75C:
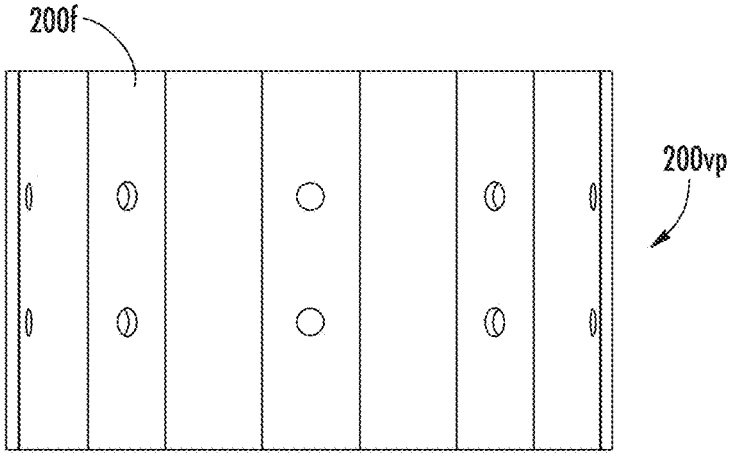
FIG. 75C is a front view of a curved vertical plate of the bracket assembly of FIGS. 75A and 75B.
Figure 75D:
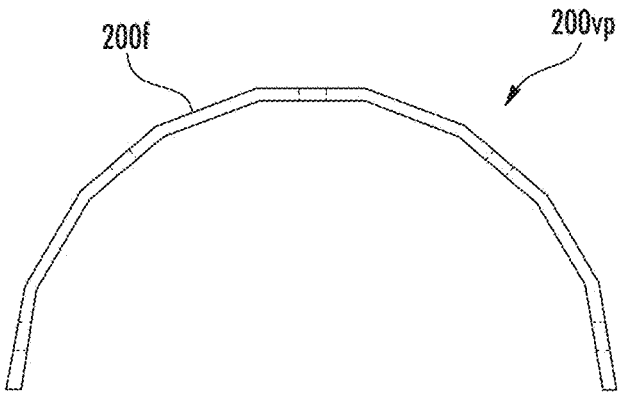
FIG. 75D is a top view of the vertical plate shown in FIG. 75C.
Figure 75E:
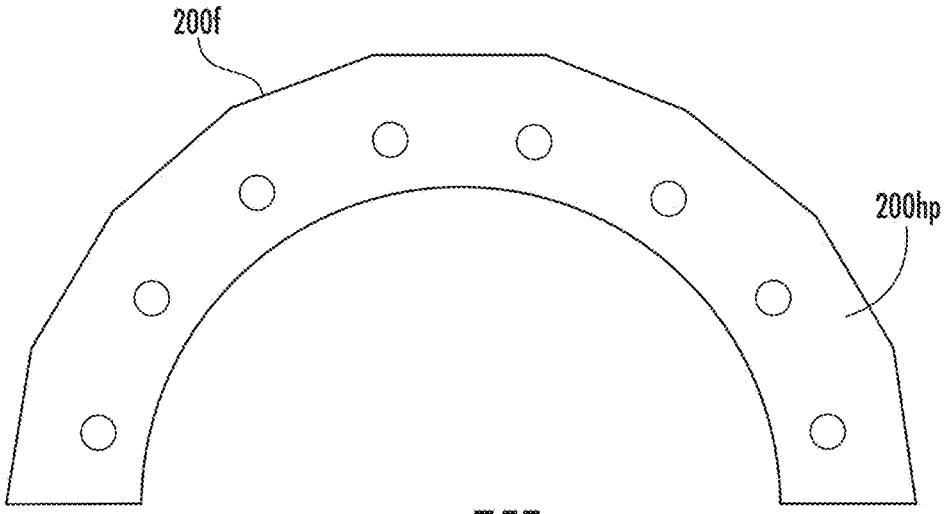
FIG. 75E is a top view of a horizontal plate of the bracket assembly shown in FIGS. 75A and 75B.

FIGS. 75A-75D illustrate an example of a bracket assembly 200 suitable for use in some embodiments such as the medium duty embodiment described above with respect to upper and lower bracket assemblies 200*u*, 200*l* in FIGS. 29-51. FIG. 75A illustrates a sub-assembly (two of these are used) that attaches to the tower outer wall 10*w* as shown in FIGS. 33-36. The sub-assembly includes a vertical plate 200*vp* attached to a horizontal plate 200*hp* via coupler 200*cp*. FIGS. 75B, 75C and 75D illustrate the semicircular shape of the vertical plate 200*vp* and FIGS. 75B and 75E illustrate the semi-circular shape of the horizontal plate 200*hp*. The vertical plate 200*vp* and horizontal plates 200*hp* can include outer flat facets 200*f*. Apertures on the vertical plate 200*vp* can be centered in the center of a respective flat facet 200*f*.

FIGS. 78A-78D and 79A-79D illustrate similar bracket assemblies 200*u*, 200*l*, respectively, with curved vertical plates 200*vp* and curved horizontal plates attached via couplers 200*cp*. However, the embodiments shown in FIGS. 78A-78D may be particularly suitable for heavy duty applications and can be larger (typically the vertical plate 200*vp* is about 30% or 4 inches longer and the outer diameter is about 30% greater) than the medium duty bracket assemblies. For example, the medium duty vertical plate 200*vp* can have a length of about 12 inches while the heavy duty vertical plate 200*vp* can have a length of about 16 inches. Other dimensions may be used.

Figure 80A:
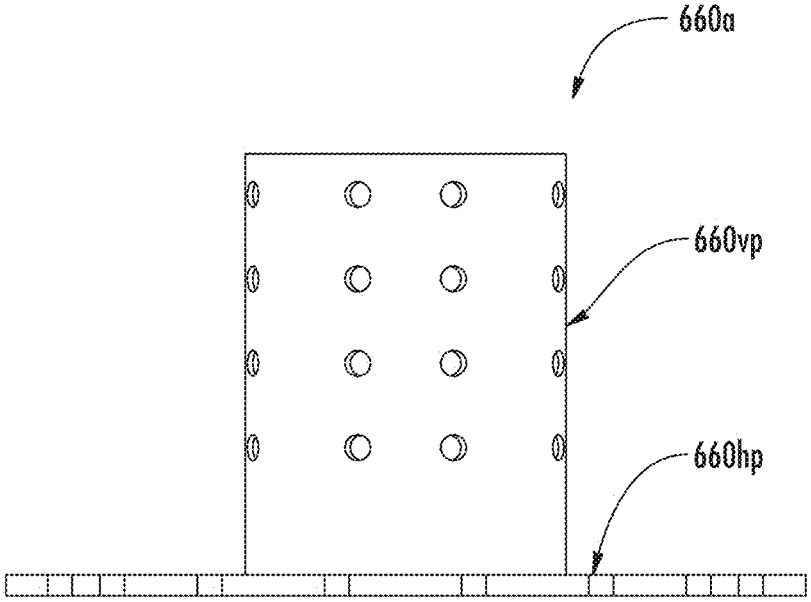
FIG. 80A is a front view of an inner vertical sleeve assembly according to embodiments of the present invention.
Figure 80B:
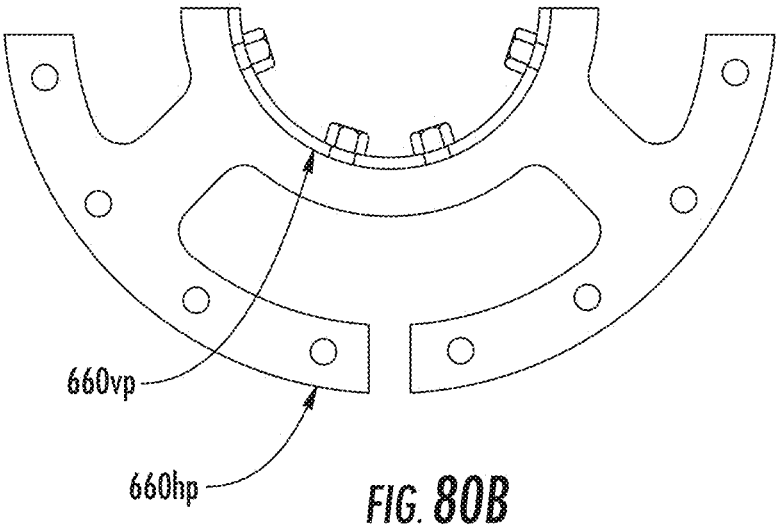
FIG. 80B is a top view thereof.
Figure 80C:
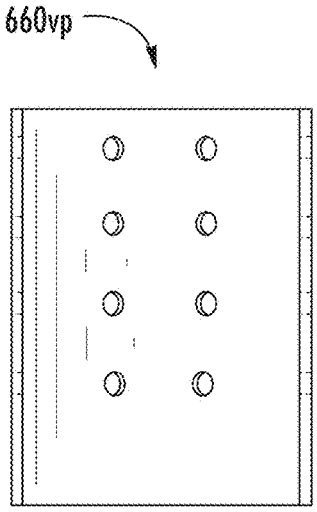
FIG. 80C is a front view of the vertical plate of the assembly shown in FIGS. 80A and 80B.
Figure 80D:
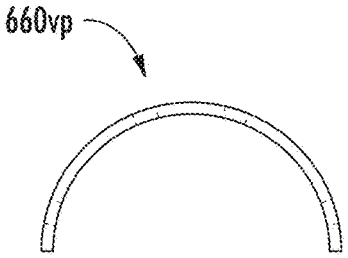
FIG. 80D is a top view of the vertical plate of the assembly shown in FIGS. 80A and 80B.
Figure 80E:
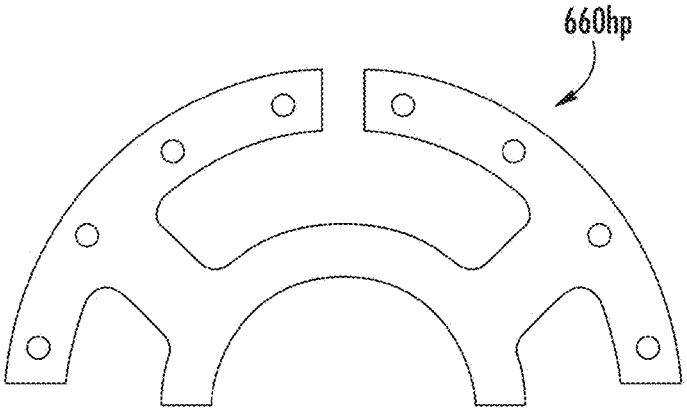
FIG. 80E is a top view of a horizontal plate shown in the sleeve assembly of FIG. 80A.
Figure 80F:
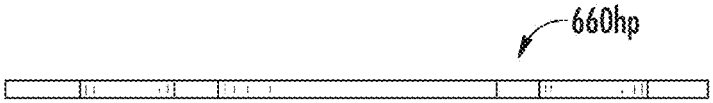
FIG. 80F is a front view of the plate shown in FIG. 80E.

FIGS. 80A-80F illustrate an inner vertical sleeve assembly 660*a*. As shown in FIGS. 80A and 80B, the sleeve assembly 660*a* includes an inner vertical sleeve 660 comprising two matable curved vertical plate's 660*vp* and a horizontal plate 660*hp*. The horizontal plate faces away from the vertical member 300"" and is affixed to the upper or lower bracket assembly 200*u*, 200*l*, respectively. FIGS. 80C and 80D illustrate the curved vertical plate 660*vp*. FIGS. 80E and 80F illustrate the attachable horizontal plate 660*hp*.

Figure 81A:
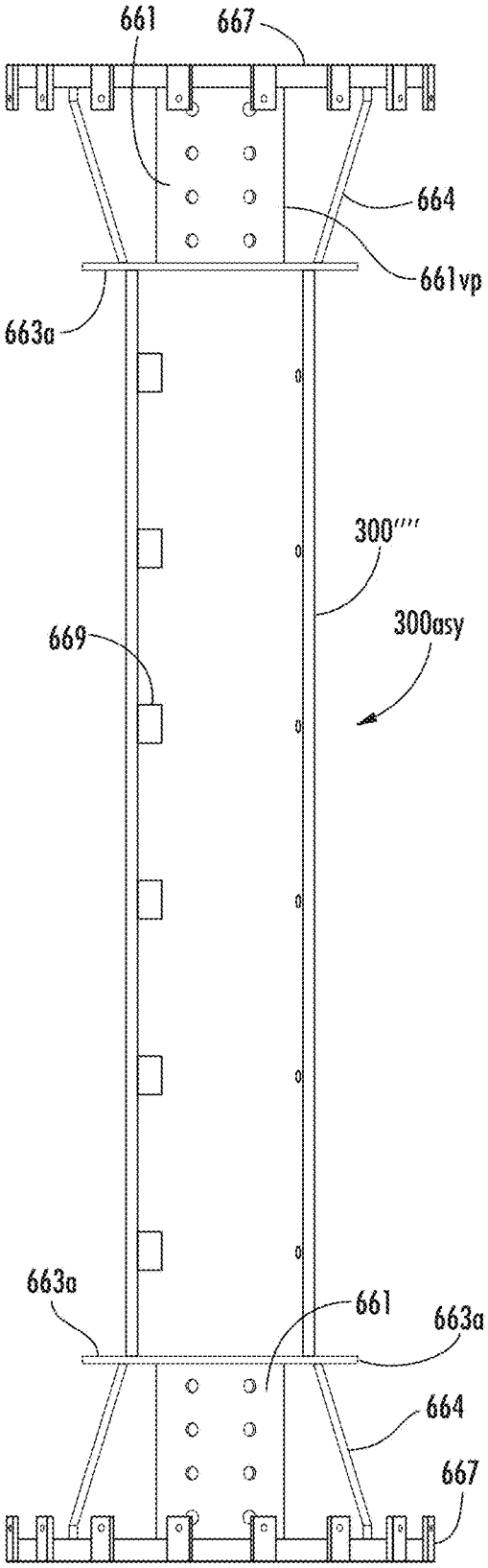
FIG. 81A is a front view of a canister assembly according to embodiments of the present invention.
Figure 81B:
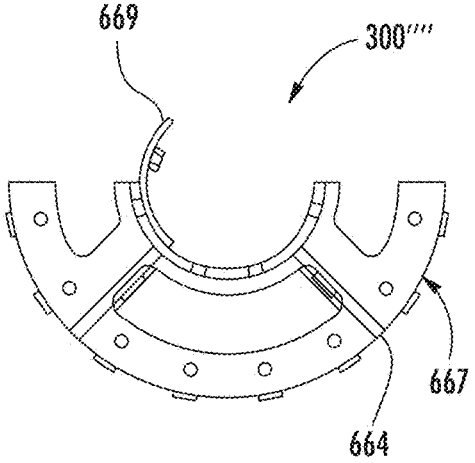
FIG. 81B is a top view of the assembly shown in FIG. 81A.
Figure 85A:
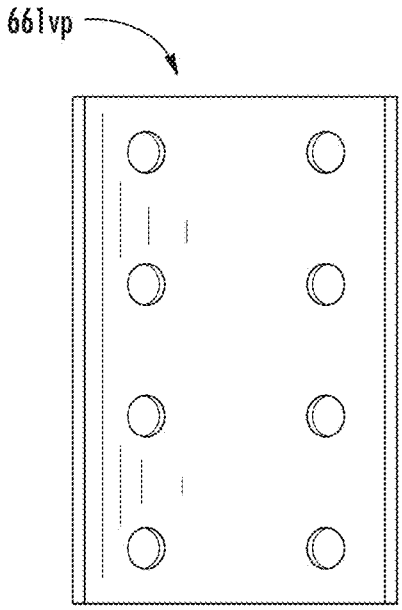
FIG. 85A is a front view of a curved outer sleeve vertical plate shown in the assembly of FIG. 81A.
Figure 85B:
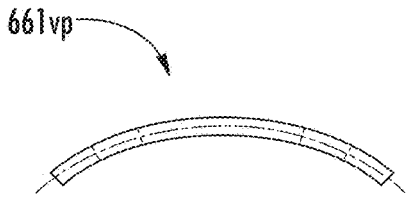
FIG. 85B is a top view of the outer vertical plate shown in FIG. 85A.
Figure 86A:
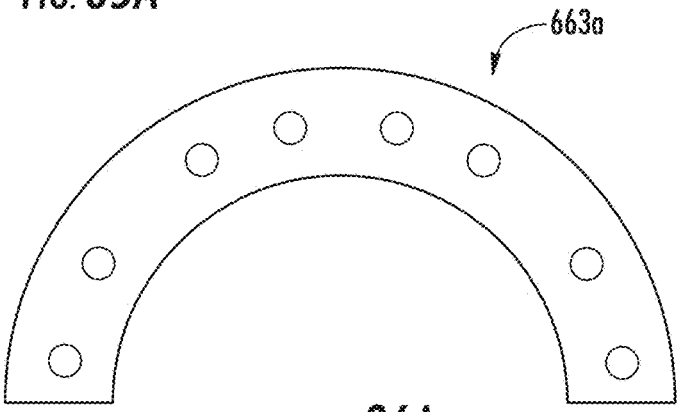
FIGS. 86A and 86B are top views of flange plates according to embodiments of the present invention.
Figure 86B:
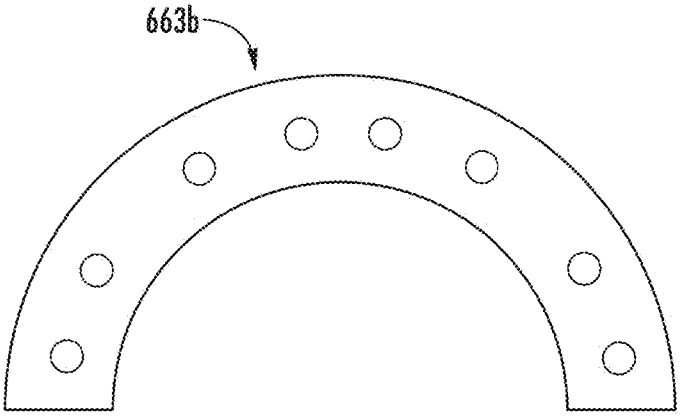

FIGS. 81A and 81B illustrate a spool assembly 300*asy* which is shown in the embodiments illustrated in FIGS. 60-74. The spool assembly 300*asy* includes an outer sleeve 661 formed of curved vertical plates 661*vp*. The outer vertical sleeve 661 (FIGS. 81A, 85A, 85B) encloses the inner vertical sleeve 660 when assembled (see, FIGS. 64, 65). The spool assembly 300*asy* also includes vertical member 300"", an upper and lower flange 667, the stiffeners 664 and intermediate flanges 663*a* that reside proximate an upper and lower edge of the vertical plates 661*vp*. As shown in FIG. 64 another flange 663*b* can be stacked onto the first flange 663*a* of the spool assembly 300*asy*. As shown in FIGS. 86A, 86B the hole pattern (angular spacing) may be similar but slightly different for these flanges 663*a*, 663*b*.

Figure 82A:
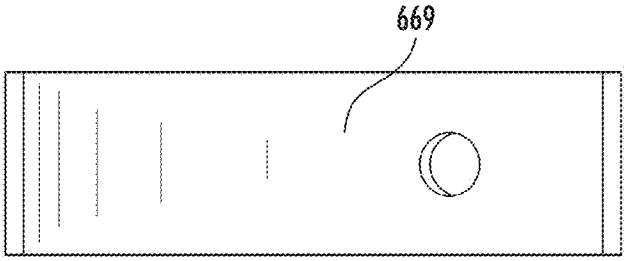
FIG. 82A is a front view of an inner gusset shown in FIG. 81A.
Figure 82B:
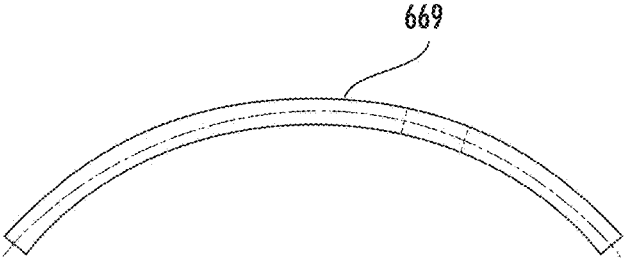
FIG. 82B is a top view of the inner gusset shown in FIG. 82A.
Figure 83A:
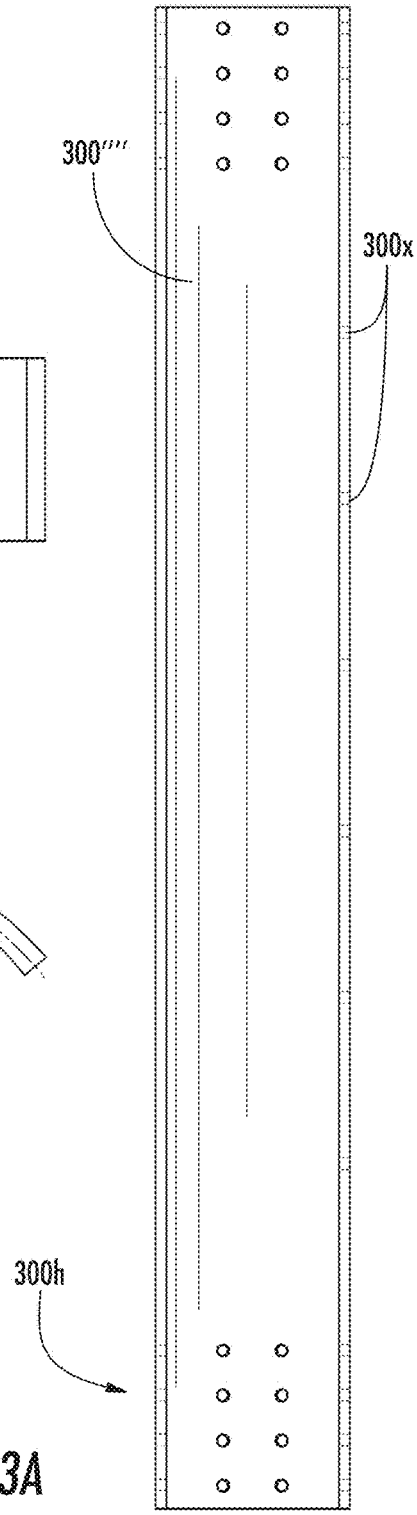
FIG. 83A is a front view of a vertical member shown in the assembly of FIG. 81A.
Figure 83B:
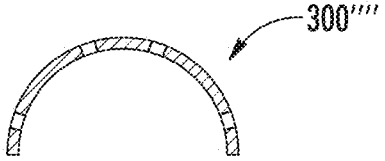
FIG. 83B is a top view of the vertical member shown in FIG. 83A.
Figure 84:
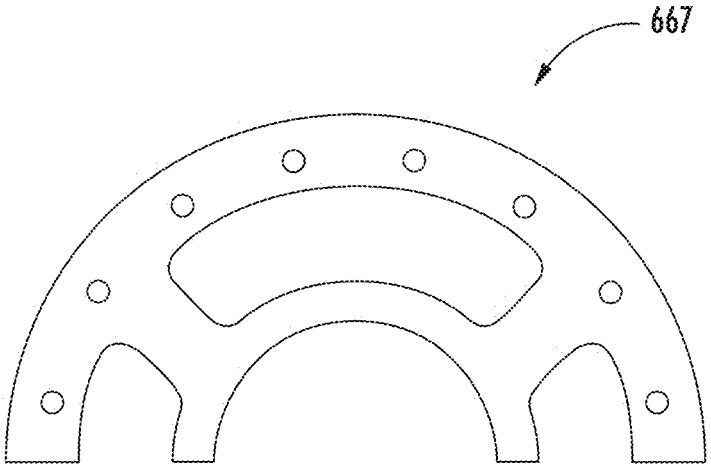
FIG. 84 is a top view of a flange plate shown in the assembly of FIGS. 81A and 81B.

The vertical member 300"" can include a number of vertically spaced apart inner gussets 669 as also shown in FIGS. 82A and 82B. FIGS. 83A, 83B illustrate that the vertical member 300"" can be formed by two arcuate elongate members and that upper and lower end portions can have an array of apertures 300*h* that align with apertures in inner and outer sleeves 660, 661. The vertical member 300"" can also include additional vertically spaced apart apertures 300*x* arranged over its length (typically in about 6-12 inch increments) for subsequent mounting of the antenna/shroud or cover. FIG. 84 illustrates an example of the primary flange 667 which can be a two-piece flange.

It is noted that mounting and/or bracket assemblies using vertical plates (e.g., curved inwardly toward a center line of the tower wall and/or outwardly toward an outer surface of the tower wall) that extend in a vertical orientation can be inclined relative to an axially extending centerline of the tower to accommodate tower taper (where the tower is tapered).

Figure 87:
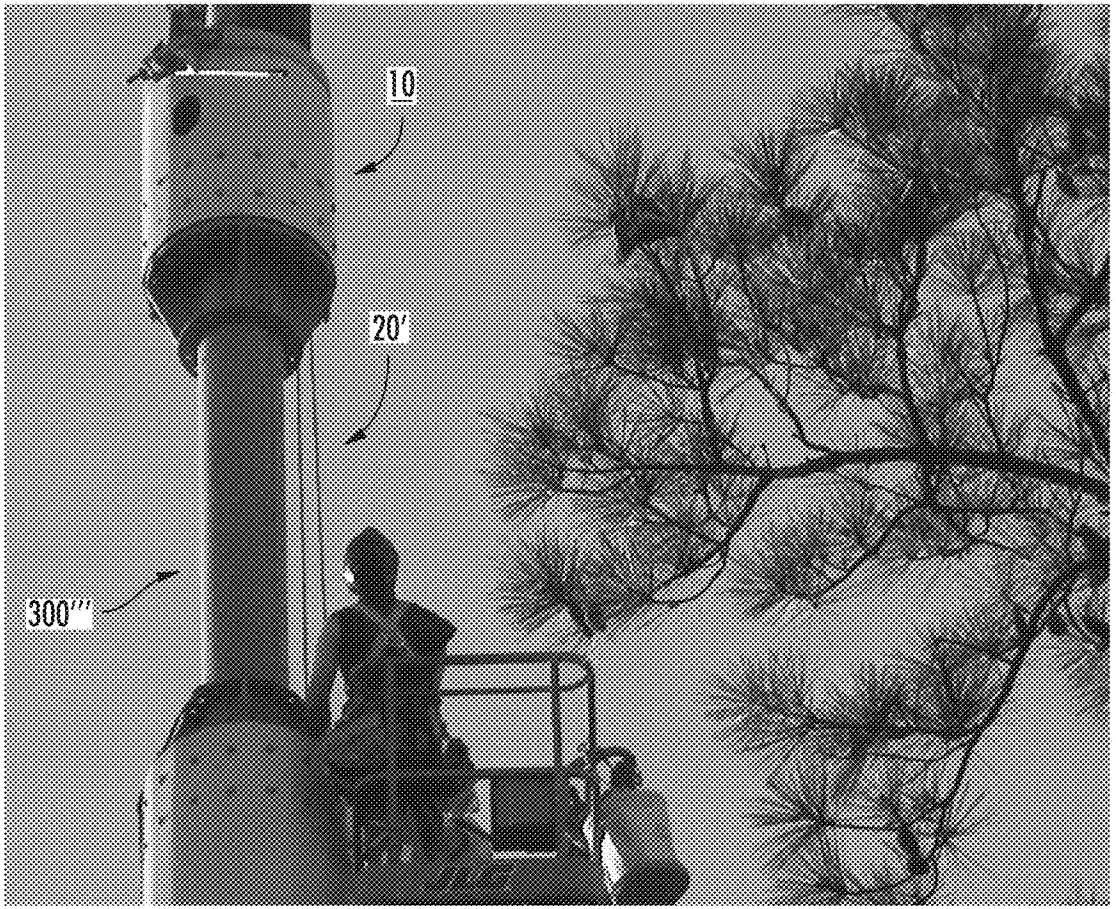
FIG. 87 is a digital photograph of a modified erect concealed antenna pole according to embodiments of the present invention.

FIG. 87 shows the installed medium duty canister assembly 20'.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, if used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A kit for modifying and/or retrofitting an erect concealed antenna pole to be able to accommodate an additional antenna canister, comprising:

a first bracket assembly configured to attach to a concealed antenna pole at a first location;

a second bracket assembly configured to attach to the concealed antenna pole at a second spaced apart location above the first location; and a vertical member having upper and lower ends and a longitudinally extending centerline, wherein the vertical member is configured to attach to the first and second bracket assemblies so that, in position, the first and second bracket assemblies position the centerline of the vertical member to longitudinally align with an axially extending centerline of a hollow core of the pole, wherein the vertical member has a lateral extent that is less than an outer diameter of the pole.

2. The kit of claim 1, wherein the first and second bracket assemblies include at least one curved vertical plate with apertures that attach to an outer wall of the pole.

3. The kit of claim 1, wherein the vertical member comprises a plurality of longitudinally extending arcuate sections that attach together and define an open center space.

4. The kit of claim 1, wherein the vertical member has a length that is between about 5-15 feet.

5. The kit of claim 1, wherein the first and second bracket assemblies comprise curved vertical plates with radially inwardly extending arms, and wherein the arms include respective walls with an open aperture.

6. The kit of claim 1, further comprising:

first and second vertically extending outer brackets that couple to an outer wall of the vertical member; and first and second horizontal plates that couple to respective ones of the first and second vertically extending outer brackets.

7. The kit of claim 1, further comprising first and second tubular sleeves provided as a tube or matable components for forming the tube, wherein the first tubular sleeve couples to the upper end of the vertical member and the second tubular sleeve couples to the lower end of the vertical member.

8. The kit of claim 6, further comprising stiffener arms that are configured to couple to the vertical member and taper outward from the vertical member.

9. The kit of claim 1, further comprising a long brace having a length greater than the vertical member and configured to attach to an outer wall of the pole above and below the first and second bracket assemblies.

10. A kit with a multi-piece vertical rod for an antenna pole, comprising:

a plurality of arcuate or semi-circular longitudinally extending members having opposing upper and lower end portions, wherein each upper and lower end portion has a plurality of radially extending members extending outwardly therefrom, wherein at least one of the radially extending members has an outwardly extending length that is greater than another of the plurality of radially extending members, wherein the longitudinally extending members are arranged to abut together to form the multi-piece vertical rod and define an open longitudinally extending center space, and wherein the multi-piece vertical rod is configured to attach to the antenna pole.

11. The kit of claim 10, wherein the plurality of longitudinally extending members are three arcuate longitudinally extending members that attach together to form a cylindrical center space, and wherein the at least one radially extending member with the greater length resides intermediate first and second shorter radially extending members.

12. The kit of claim 10, wherein the kit further comprises an arcuate inner wall bracket with an inwardly extending arm, and wherein the shorter radially extending members are provided in adjacent pairs that couple to the inwardly extending arm of an arcuate inner wall bracket.

13. A method of modifying an erect concealed antenna pole, comprising:

providing a vertical rod with spaced apart upper and lower end portions;

placing the upper and lower end portions into a hollow core of the antenna pole with the vertical rod exposed along a removed section of the antenna pole at a location that is below a top of the antenna pole and above a bottom of the antenna pole, while the antenna pole is erect; and attaching the upper and lower end portions to respective first and second longitudinally spaced apart antenna pole wall segments to hold the vertical rod in position while the antenna pole is erect.

14. The method of claim 13, wherein the attaching is carried out by attaching a first bracket assembly to the first antenna pole wall segment and attaching a second bracket assembly to the second antenna pole wall segment, and wherein the vertical member has a longitudinally extending centerline, and wherein the attaching is carried out to position the centerline of the vertical member to be longitudinally aligned with an axially extending centerline of the hollow core of the pole, wherein the vertical member has a lateral extent that is less than an outer diameter of the pole.

15. The kit of claim 10, wherein the multi-piece vertical rod is configured to be attached to an erect concealed antenna pole as the antenna pole.

16. The kit of claim 10, wherein the multi-piece vertical rod has a length in a range of 5-15 feet.

17. The kit of claim 10, further comprising a template with a bolt hole pattern.

18. The kit of claim 10, wherein the multi-piece vertical rod is configured to couple to attach to an antenna.

19. The kit of claim 10, further comprising curved vertical plates with radially inwardly extending arms.

20. The kit of claim 10, further comprising a plurality of bolts, a first bracket assembly configured to attach to the multi-piece vertical rod and a second bracket assembly configured to attach to the multi-piece vertical rod, wherein the first bracket assembly and the second bracket assembly are configured to attach the upper and lower portions of the vertical rod to an outer wall of a concealed antenna pole as the antenna pole.

* * * * *